US009370935B2

(12) United States Patent
Nawano

(10) Patent No.: US 9,370,935 B2
(45) Date of Patent: Jun. 21, 2016

(54) FLOW PATH MEMBER, LIQUID EJECTING HEAD AND LIQUID EJECTING APPARATUS

(71) Applicant: SEIKO EPSON CORPORATION, Tokyo (JP)

(72) Inventor: Masahisa Nawano, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/729,842

(22) Filed: Jun. 3, 2015

(65) Prior Publication Data

US 2015/0352855 A1 Dec. 10, 2015

(30) Foreign Application Priority Data

Jun. 10, 2014 (JP) ..... 2014-120021
Jun. 10, 2014 (JP) ..... 2014-120022

(51) Int. Cl.
*B41J 2/175* (2006.01)
*B41J 2/19* (2006.01)

(52) U.S. Cl.
CPC ..... *B41J 2/17563* (2013.01); *B41J 2/19* (2013.01)

(58) Field of Classification Search
CPC ..... B41J 2/17563; B41J 2/19
USPC ..... 347/93
See application file for complete search history.

(56) References Cited

U.S. PATENT DOCUMENTS

2002/0057320 A1 5/2002 Kaga
2006/0201870 A1* 9/2006 Seto ..... B01D 29/15 210/435
2011/0221838 A1 9/2011 Oguchi

FOREIGN PATENT DOCUMENTS

GB 2184066 A * 6/1987 ..... B41J 2/16523
JP 2002-166567 A 6/2002
JP 2003-266727 A 9/2003
JP 2008-218072 A 9/2008
JP 2008-290342 A 12/2008
JP 2009-184202 A 8/2009
JP 2011-189649 A 9/2011
JP 2013-129060 A 7/2013

* cited by examiner

*Primary Examiner* — Alessandro Amari
*Assistant Examiner* — Michael Konczal
(74) *Attorney, Agent, or Firm* — Workman Nydegger

(57) ABSTRACT

The invention is to provide a liquid ejecting head including a flow path member which allows a capacity of an air bubble chamber to be increased as much as possible and in which a filter is not clogged even when the variation of a liquid consumption amount is large, and a liquid ejecting apparatus including the flow path member. Alternatively, the invention is to provide a liquid ejecting head including a flow path member which allows a capacity of an air bubble chamber to be increased as much as possible while being miniaturized in a transporting direction and a liquid ejecting apparatus including the flow path member.

7 Claims, 26 Drawing Sheets

FLOW PATH MEMBER, LIQUID EJECTING HEAD AND LIQUID EJECTING APPARATUS

CROSS-REFERENCE TO RELATED APPLICATIONS

This application claims priority to Japanese Patent Application No. 2014-120021 filed on Jun. 10, 2014 and Japanese Patent Application No. 2014-120022 filed on Jun. 10, 2014. The entire disclosures of Japanese Patent Application Nos. 2014-120021 and 2014-120022 are hereby incorporated herein by reference.

BACKGROUND

1. Technical Field

The present invention relates to a liquid ejecting head including a flow path member in which a flow path through which a liquid flows is formed and a liquid ejecting apparatus including the flow path member.

2. Related Art

A liquid ejecting apparatus which is represented by an ink jet type recording apparatus such as an ink jet type printer or plotter includes a liquid ejecting head that can eject a liquid such as ink stored in a cartridge, a tank, or the like. This liquid ejecting head includes a plurality of head main bodies which eject the liquid, and a flow path member that holds the head main body, and includes a flow path for ink which is supplied to the head main body.

In the flow path member, a portion of a filter chamber is used as an air bubble chamber for storing air bubbles. In addition, the invention has been proposed in which, for example, a shape of a filter 33 in which an air bubble chamber 95 is provided on the upper side in the vertical direction is formed to correspond to a shape of a meniscus of the ink which is introduced to the air bubble chamber 95 from the upper stream, and thus the contact with the meniscus and the filter 33 is allowed to be delayed, thereby lengthening maintenance intervals without increasing the capacity of the air bubble chamber 95 (refer to JP-A-2013-129060).

In the above-described JP-A-2013-129060, the miniaturization of a printing object medium used in the flow path member in a transporting direction is not examined, and the demand for increasing a capacity of an air bubble chamber as much as possible in the miniaturized flow path member in the transporting direction has also not been examined.

In addition, there is a problem in that a large amount of air bubbles may clog the filter depending on the variation of a liquid consumption amount in a filter chamber; however, the examination of arrangement of a flow path which is not affected even in a case where such a variation of the liquid consumption amount is generated in the filter chamber was not performed.

Meanwhile, the above-described demand is required to be examined regarding not only for an ink jet type recording apparatus, but also a liquid ejecting apparatus ejecting a liquid other than ink in the same manner.

SUMMARY

An advantage of some aspects of the invention is to provide a liquid ejecting head including a flow path member which allows a capacity of an air bubble chamber to be increased as much as possible and in which a filter is not clogged even when the variation of a liquid consumption amount is large, and a liquid ejecting apparatus including the flow path member. Alternatively, the invention is to provide a liquid ejecting head including a flow path member which allows a capacity of an air bubble chamber to be increased as much as possible while being miniaturized in a transporting direction and a liquid ejecting apparatus including the flow path member.

Aspect 1

According to an aspect of the invention, there is provided a liquid ejecting head including a head main body that ejects an ink droplet from a nozzle group having nozzle openings of which positions on a liquid ejecting surface are different from each other in a first direction; a flow path member that includes a flow path which supplies a liquid to the head main body, a filter which is provided in the middle of the flow path, a filter chamber which is formed of an upstream filter chamber on an upstream side and a downstream filter chamber on a downstream side of the filter and accommodates the filter, and an air bubble chamber which communicates with the filter chamber on the upstream side and stores air bubbles removed by the filter; a first nozzle group and a second nozzle group of which positions on the liquid ejecting surface in a second direction orthogonal to the first direction are different from each other, and the positions are overlapped with each other at least in a portion in the first direction; and a branched flow path in which the flow path of the flow path member is branched in the middle of the path and then communicates with the first nozzle group and the second nozzle group, in which the air bubble chamber is provided for each branched flow path.

In this aspect, since the air bubble chamber is provided for each branched flow path which is branched to the first nozzle group and the second nozzle group of which positions on the liquid ejecting surface in the second direction are different from each other, and the positions are overlapped with each other at least in a portion in the first direction, even in a case where the variation of the liquid consumption amount in the filter chamber occurs, the variation of a storage amount of the air bubbles in the air bubble chamber corresponding to the amount that the positions are overlapped with each other at least a portion in the first direction is less likely to occur. Therefore, it is possible to realize the liquid ejecting head which includes the flow path member capable of preventing the stored air bubbles from clogging a certain filter chamber. Meanwhile, positions of nozzles of the first and second nozzle groups may be the same as each other in the first direction, and a half of a nozzle pitch may be deviated, and in positions in the first direction, one of the nozzles at both ends of the second nozzle group may be between the nozzles at both ends of the first nozzle group.

Aspect 2

Here, in the liquid ejecting head according to Aspect 1, it is preferable that the first nozzle group includes a first nozzle row and a second nozzle row along the first direction, the second nozzle group includes a third nozzle row and a fourth nozzle row along the first direction, regarding the position in the first direction, an amount of overlap between the first nozzle row and the second nozzle row is smaller than an amount of overlap of the first nozzle row and the third nozzle row, regarding the position in the first direction, an amount of overlap between the third nozzle row and the fourth nozzle row is smaller than an amount of overlap between the second nozzle row and the fourth nozzle row, a first communication air bubble chamber to which the air bubbles in the air bubble chamber corresponding to the nozzle row are mutually movable is commonly provided in the first nozzle row and the second nozzle row, a second communication air bubble chamber to which the air bubbles in the air bubble chamber corresponding to the nozzle row are mutually movable is commonly provided in the third nozzle row and the fourth nozzle row, and the first communication air bubble chamber is one air bubble chamber which is provided for each branched flow path, and the second communication air bubble chamber is the other air bubble chamber which is provided for each the branched flow path. According to this, the air bubble chamber in which the stored air bubbles communicate with each other in such a manner as to be mutually movable is included, and thus it is possible to increase the storage amount of the air bubbles with respect to filter chambers. In addition, focusing on the amount of overlap of the nozzle rows in the first direction, the respective air bubble chambers are allowed to communicate with each other between the nozzle rows which have relatively a small amount of overlap, for example, the first nozzle row and the second nozzle row, and the third nozzle row and the fourth nozzle row, and the respective air bubble chambers are allowed to communicate with each other between the nozzle rows which have a relatively large amount of overlap, for example, the first nozzle row and the third nozzle row, and the second nozzle row and the fourth nozzle row. In addition, since the amounts of liquid consumption by the nozzle rows which have a relatively large amount of overlap are likely to be the same, the respective air bubble chambers are not allowed to communicate with each other between such nozzle rows which have a relatively large amount of overlap, but the respective air bubble chambers are allowed to communicate with each other between the nozzle rows which have a relatively small amount of overlap. Therefore, the storage amount is increased in the respective air bubble chambers while suppressing the variation of the amount of the air bubbles stored in the air bubble chamber. As a result, it is possible to prevent the stored air bubbles from clogging only a certain filter chamber. Note that, in the position in the first direction, the amount of overlap between the first nozzle row and the second nozzle row may be smaller than the amount of overlap between the first nozzle row and the third nozzle row, and thus the first nozzle row and the second nozzle row may not overlap with each other. In the same way, the third nozzle row and the fourth nozzle row may not overlap with each other.

Aspect 3

In addition, in the liquid ejecting head according to Aspect 2, it is preferable that the head main body is configured such that the first nozzle row and the third nozzle row are provided on a single nozzle plate, and the second nozzle row and the fourth nozzle row are provided on a single nozzle plate. In this aspect, a space between two nozzle rows in the second direction can be narrowed, and the positioning of two nozzle rows is easily performed.

Aspect 4

In addition, in the liquid ejecting head according to Aspect 3, it is preferable that the head main bodies are in plural, and each of head main bodies includes a plurality of nozzle rows corresponding to the first communication air bubble chamber, and a plurality of nozzle rows corresponding to the second communication air bubble chamber. According to this aspect, it is possible to easily arrange the nozzle rows in a long line in the first direction.

Aspect 5

In addition, in the liquid ejecting head according to any one of Aspect 2 to Aspect 4, it is preferable that the flow path includes a first branch point that branches in the middle of the flow path, and a second branch point which branches closer to the downstream side than the first branch point, the first communication air bubble chamber corresponds to one filter chamber of a flow path branched at the first branch point, and the second communication air bubble chamber corresponds to the other filter chamber of a flow path branched at the first branch point. According to this aspect, since the air bubbles can movably communicate with the air bubble chamber of the filter chamber which is provided on the flow path branched at the branch point which branches on the downstream side further than the first branch point, the arrangement is easily performed and it is possible to realize the miniaturization thereof.

Aspect 6

In addition, in the liquid ejecting head according to any one of Aspects 1 to 5, it is preferable that the air bubble chamber is two-dimensionally disposed on a surface in parallel with the liquid ejecting surface, the first branch point is a branch point which branches out the flow path extending to one side in the direction orthogonal to the first direction and the flow path extending to the other side, and the second branch point is a branch point which branches out the flow path extending to one side in the first direction and the flow path extending to the other side. According to this aspect, in a case where the air bubble chamber is two-dimensionally disposed, the direction of the flow path branched at the branch point is different in each branch point, and thus it is possible to realize the miniaturization of the flow path member.

Aspect 7

According to an aspect of the invention, there is provided a flow path member including a flow path that supplies a liquid to a head main body which ejects an ink droplet from a liquid ejecting surface, a filter that is provided in the middle of the flow path, a filter chamber that accommodates a filter which is formed of an upstream filter chamber on an upstream side and a downstream filter chamber on a downstream side of the filter, and an air bubble chamber that communicates with the upstream filter chamber and stores air bubbles removed through the filter, in which the filter is disposed along a vertical direction orthogonal to the liquid ejecting surface, and in the vertical direction, an outlet part of a communication flow path which communicates with the upstream filter chamber among the flow paths is disposed at a position lower than an upper end of the filter in the vertical direction.

In this aspect, since the filter is disposed perpendicular to the liquid ejecting surface, particularly, it is possible to make a dimension small in the transporting direction, and thereby dispose the filter on the liquid ejecting surface. Further, the outlet part of the communication flow path which communicates with the upstream filter chamber by disposing the air bubble chamber on the upper side of the upstream filter chamber is disposed at a position lower than the upper end of the filter in the vertical direction, and thus the outlet part of the communication flow path can prevent the air bubble chamber from being clogged by the stored air bubbles.

Aspect 8

Here, in the flow path member according to Aspect 7, it is preferable that an area surrounding the direction along the filter of the upstream filter chamber and the air bubble chamber is defined by the outer wall portion, the communication flow path is disposed by passing through the air bubble chamber and includes a flow path wall portion which partitions the communication flow path and the air bubble chamber, and one side surface of the upstream filter chamber, the air bubble chamber, and the communication flow path is defined by the fixing member which is commonly fixed to the outer wall portion and the flow path wall portion. According to this, it is possible to form the filter chamber and the air bubble chamber by being sealed by one common fixing member, thereby being relatively conveniently manufactured. In addition, it is possible to form the communication flow path, which communicates with the upstream filter chamber via the air bubble chamber, by using the common fixing member, thereby being relatively conveniently manufactured. Further, the flow path wall portion of the communication flow path can stably support the fixing member.

Aspect 9

In addition, in the flow path member according to Aspect 8, it is preferable that a member including the outer wall portion and the flow path wall portion is a resin-molded member, and a fixing trace of the fixing member and the outer wall portion and a fixing trace of the fixing member and the flow path wall portion are discontinuous. According to this, the outer wall portion and the flow path wall portion are discontinuous, and thus a sink in resin-molding is prevented, and the air bubbles can move in the air bubble chamber without interfering with the flow path wall portion, thereby improving the capacitor of the air bubble chamber.

Aspect 10

In addition, in the flow path member according to Aspect 8 or 9, it is preferable that the fixing member is a film, and the outer wall portion and the flow path wall portion are fixed by welding. According to this, it is possible to reduce the cost of the fixing member, and the flatness of the welded surface such as the outer wall portion and the flow path wall portion is not required, thereby realizing further simple manufacture thereof. In addition, the fixing member which is formed of the film has compliance, but the flow path wall portion can reduce the compliance.

Aspect 11

In addition, in the flow path member according to any one of Aspect 8 to 10, it is preferable that a middle wall portion that is provided between the upstream filter chamber and the air bubble chamber is included, in which the middle wall portion is fixed to the fixing member, and a fixing trace of the fixing member and the middle wall portion and the fixing trace of the fixing member and the outer wall portion are discontinuous. According to this, the middle wall portion which is positioned between the filter chamber and the air bubble chamber becomes a guide when providing the filter in the filter chamber, and thus it is easy to provide the filter. In addition, it is possible to support a middle portion of the fixing member with the middle wall portion. Further, since the middle wall portion and the outer wall portion are discontinuous, the air bubbles are not prevented from moving from the filter chamber to the air bubble chamber.

Aspect 12

In addition, in the flow path member according to any one of Aspects 7 to 11, it is preferable when seen from a thickness direction orthogonal to the filter, that the flow path member includes a concavity, in which a conductive plate in a planar shape is disposed, at a position facing the filter, and at least a portion of the air bubble chamber is disposed so as not to face the concavity, and in the thickness direction, a dimension of the air bubble chamber is greater than a dimension of the filter chamber. According to this, it is possible to dispose, for example, a wiring substrate for driving the head main body in the concavity. In addition, since the filter is disposed so as to face the substrate which is disposed in the concavity, it is possible to make a dimension of the filter large, and reduce the pressure loss due to the filter. Further, in the direction perpendicular to the filter, since the dimension of the air bubble chamber is greater than the dimension of the filter chamber, it is possible to store a large amount of the air bubbles.

Aspect 13

In addition, in the flow path member according to Aspect 12, it is preferable that the flow path member includes the filter chamber on each of both sides of the concavity in the thickness direction. According to this, since it is possible to dispose the filter chamber by efficiently using the space on both sides of the substrate, it is possible to further reduce the pressure loss in supplying a liquid to the downstream side.

Aspect 14

In addition, in the flow path member according to Aspect 13, it is preferable that in the middle of the flow path from an inlet of the flow path which is provided in the flow path member to an outlet part of the communication flow path, the flow path is branched in the thickness direction. According to this, since the flow path member includes the flow path which is branched, the connection to the flow path on the upstream side is simply performed.

Aspect 15

In addition, in the liquid ejecting apparatus according to any one of Aspects 7 to 14, it is preferable that a plurality of the filters are disposed along a filter surface and a direction orthogonal to the vertical direction, and the communication flow path is provided to extend to a position between the plurality of filters along the filter surface and in the direction orthogonal to the vertical direction. According to this, the flow path extends between the filter chambers, and thus even in a case of being suctioned from the head main body side, it is possible to supply the liquid sufficient for each filter chamber.

Aspect 16

In addition, in the flow path member according to any one of Aspects 7 to 15, it is preferable that the inlet of the flow path which is provided in the flow path member is provided at a position biased to one side from a center portion along the filter surface and in the direction orthogonal to the vertical direction, the flow path wall portion which defines the communication flow path is provided to extend to the position between the plurality of filters from the biased position, and a fixing wall portion to which the fixing member is fixed is provided at a position symmetrical with the flow path wall portion along the filter surface and in the direction orthogonal to the vertical direction. According to this, the fixing positions of the fixing members are symmetrically provided, and thus are stably fixed even in a case where the fixing member is the film.

Aspect 17

According to an aspect of the invention, there is provided a liquid ejecting head including the flow path member and the head main body according to any one of Aspects 7 to 16.

In this aspect, particularly, it is possible to make a dimension small in the transporting direction, and to arrange the outlet part of the communication flow path which communicates with the upstream filter chamber by disposing the air bubble chamber on the upper side of the upstream filter chamber which is disposed at a position lower than the upper end of the filter in the vertical direction, and thus it is possible to realize the liquid ejecting head including the flow path member in which the outlet part of the communication flow path can prevent the air bubble chamber from being clogged by the stored air bubbles.

Aspect 18

In addition, the liquid ejecting head according to Aspect 17, further includes a circuit board that is electrically connected to the head main body; a cover member that accommodates the circuit board and the flow path member, in which the circuit board includes a connector which is connected to an external wiring, the flow path member includes a feeding needle which supplies a liquid to the flow path, the cover member includes a connector exposing hole which exposes the connector to the outside of the cover member and an exposing portion which exposes the feeding needle to the outside of the cover member, and the connector and the feeding needle are disposed at the same position in the vertical direction orthogonal to the liquid ejecting surface.

In this aspect, since it is possible to provide the feeding needle of the flow path member and the connector of the circuit board at the same position in the vertical direction, it is possible to realize the miniaturization of the liquid ejecting head in the vertical direction while forming the size required for the circuit board or the flow path member in the inner space of the cover member.

Aspect 19

According to an aspect of the invention, there is provided a liquid ejecting apparatus including the liquid ejecting head according to Aspects 1 to 18.

In this aspect, since the air bubble chamber is provided for each branched flow path, even in a case in which the variation of the liquid consumption amount between the filter chambers occurs, the variation of the storage amount of the air bubbles in the air bubble chamber is less likely to be generated, and thus it is possible to realize the liquid ejecting apparatus including the flow path member capable of preventing the stored air bubbles from clogging a certain filter chamber.

Alternatively, particularly, it is possible to make a dimension small in the transporting direction, and to arrange the outlet part of the communication flow path which communicates with the upstream filter chamber by disposing the air bubble chamber on the upper side of the upstream filter chamber which is disposed at a position lower than the upper end of the filter in the vertical direction, and thus it is possible to realize the liquid ejecting apparatus including the flow path member in which the outlet part of the communication flow path can prevent the air bubble chamber from being clogged by the stored air bubbles.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
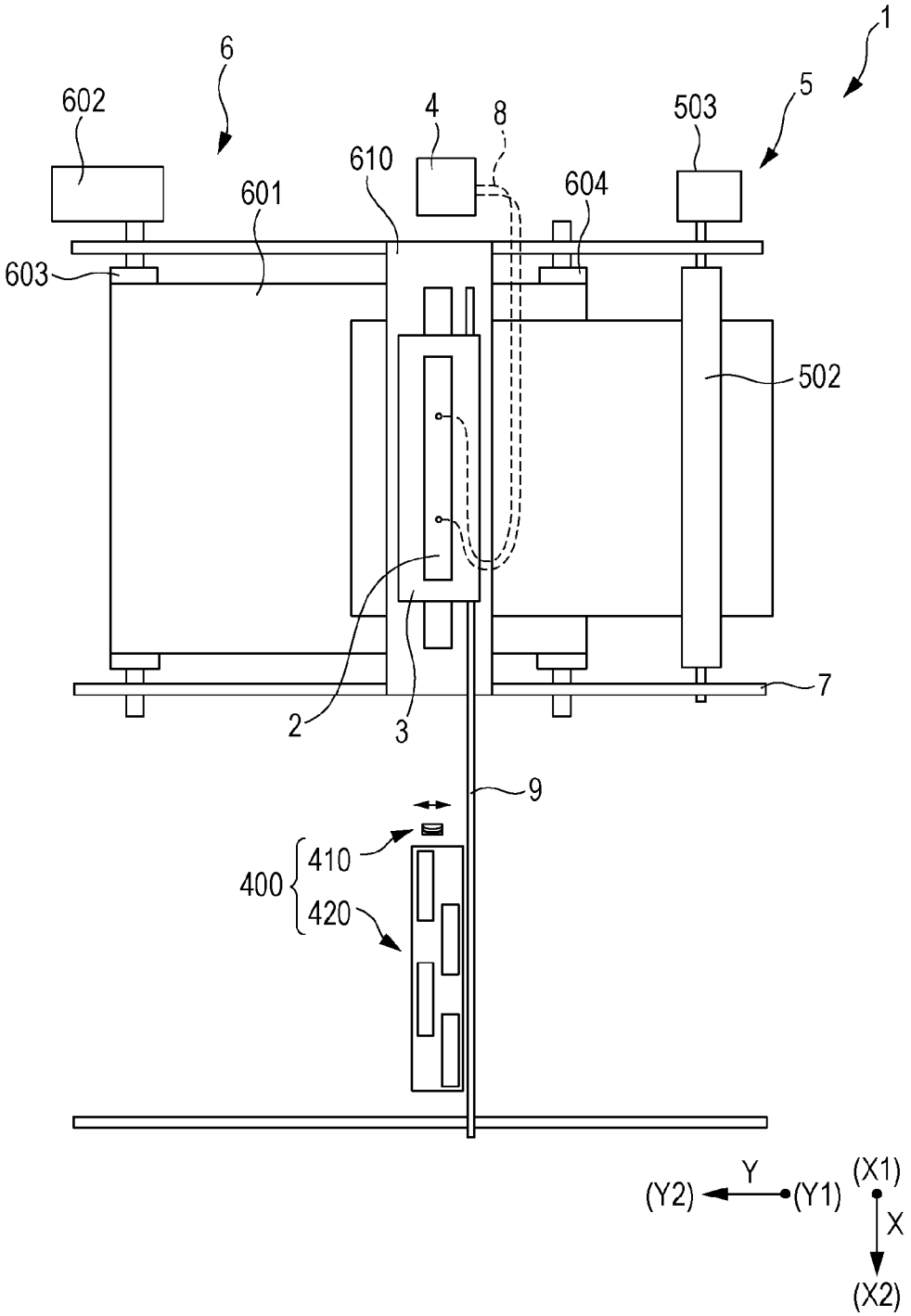
FIG. 1 is a top view of an ink jet type recording apparatus.
Figure 2A:
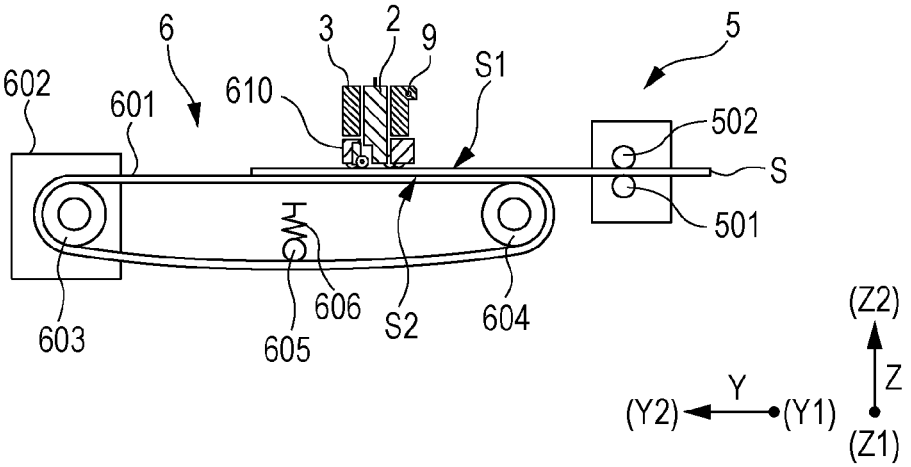
FIG. 2A is a side view of the ink jet type recording apparatus and FIG. 2B is an enlarged view of the side view.
Figure 2B:
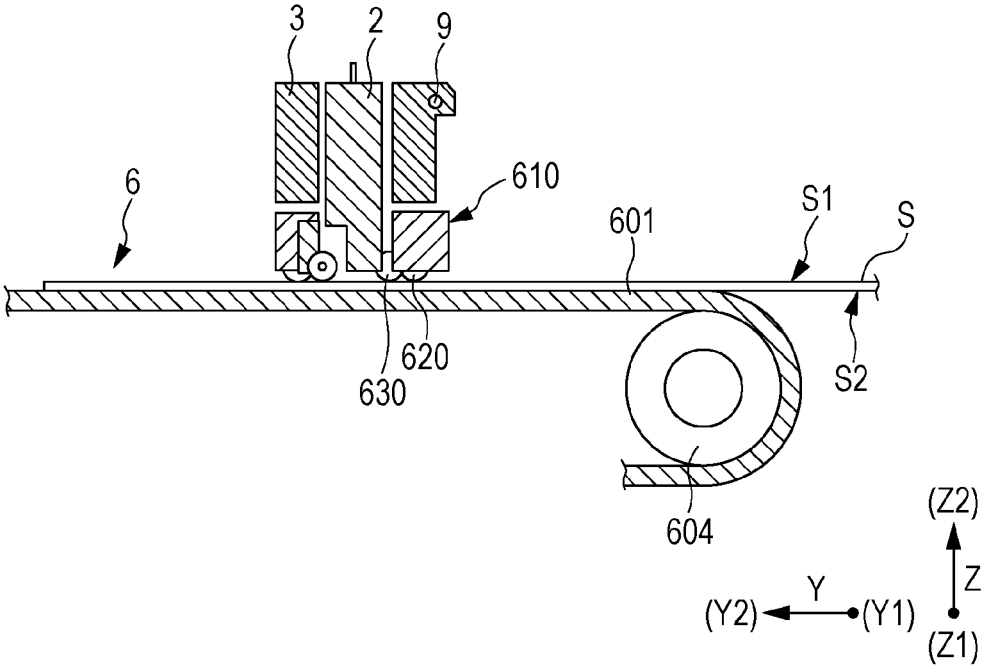

Detailed description will be made based on the embodiments of the present invention. An ink jet type recording head is an example of a liquid ejecting head, and is simply referred to as a recording head in some cases. An ink jet type recording apparatus is an example of the liquid ejecting apparatus. FIG. 1 is a top view schematically illustrating the ink jet type recording apparatus according to the first embodiment, and FIG. 2A is a side view of the ink jet type recording apparatus and FIG. 2B is an enlarged view of the side view.

The ink jet type recording apparatus 1 is a so-called ink jet type recording apparatus 1 which performs a printing process by transporting a recording sheet S which is an ejecting object medium.

A transporting direction of the recording sheet S is referred to as a second direction Y, in an in-plane direction of a landing surface S1 on which ink of the recording sheet S lands, and a direction orthogonal to the second direction Y is referred to as a first direction X. In addition, a direction orthogonal to the first direction X and the second direction Y, that is, a direction orthogonal to the landing surface S1 of the recording sheet S is referred to as a third direction Z. In the embodiment, directions (X, Y, and Z) orthogonal to each other are exemplified, but the invention is not necessarily limited thereto.

The ink jet type recording apparatus 1 is provided with a recording head 2, a carriage 3 on which the recording head 2 is mounted, a liquid storage unit 4 such as an ink tank storing ink, a first transporting unit 5, a second transporting unit 6, a device main body 7, and a maintenance unit 400.

The recording head 2 extends in the first direction X. In the embodiment, although detailed description will be made later, in the recording head 2, a head main body group 202 in which a plurality of head main bodies 200 (refer to FIG. 8) are provided in parallel with the first direction X is formed as a plurality of rows in the second direction Y, and two rows in the embodiment. Note that, the number of the head main body groups 202 of the head main body 200 is not particularly limited, and may be three or more rows. The above-described head main body 200 is disposed in such a manner that a liquid ejecting surface 20*a* which ejects the ink becomes a Z1 side.

The liquid storage unit 4 is used for supplying the ink to the recording head 2, and is fixed to a device main body 7 in the embodiment. The ink supplied from the liquid storage unit 4 which is fixed to the device main body 7 is supplied to the recording head 2 via a supply pipe 8 such as a tube. Meanwhile, the recording head 2 may include the liquid storage unit 4, and for example, the recording head 2 may mount the liquid storage unit 4 on the side opposite to the recording sheet S, that is, the upper side of the third direction Z of the recording head 2.

The first transporting unit 5 is provided on one side of the recording head 2 in the second direction Y (a Y1 side in the embodiment). Meanwhile, in the embodiment, in the second direction Y, one side with respect to the recording head 2 is referred to as the Y1 side and the other side is referred to as a Y2 side.

The first transporting unit 5 is provided with a first transporting roller 501 and a first driven roller 502 which is driven by the first transporting roller 501. The first transporting roller 501 is provided on a rear surface S2 opposite to the landing surface S1 of the recording sheet S, and is driven by a driving force of a first driving motor 503. In addition, the first driven roller 502 is provided on the landing surface S1 of the recording sheet S, and the recording sheet S is interposed between the first driven roller 502 and the first transporting roller 501. The above described first driven roller 502 presses the recording sheet S toward the first transporting roller 501 by using a biasing member such as a spring (not shown).

The second transporting unit 6 is provided with a transporting belt 601, a second driving motor 602, a second transporting roller 603, a second driven roller 604, a tension roller 605 and a roller unit 610.

The second transporting roller 603 is driven by the driving force of the second driving motor 602. The transporting belt 601 is formed of an endless belt, and is wrapped around the periphery of the second transporting roller 603 and the second driven roller 604. The above-described transporting belt 601 is provided on a rear surface S2 of the recording sheet S. The tension roller 605 is provided between the second transporting roller 603 and the second driven roller 604, and contacts an inner surface of the transporting belt 601, and imparts tensile strength to the transporting belt 601 through a biasing force of the biasing member 606 such as the spring. Accordingly, the transporting belt 601 is provided between the second transporting roller 603 and the second driven roller 604 and the surface thereof facing the recording head 2 is made to be flat.

The roller unit 610 is provided on the landing surface S1 of the recording sheet S, and includes a plurality of rollers in the head and outside of the head on the landing surface S1 of the recording sheet S. The roller unit 610 interposes the recording sheet S between the rollers in the head and outside of the head and the transporting belt 601. The roller unit 610 will be described in detail.

In the above-described ink jet type recording apparatus 1, so called printing is performed in such a manner that the ink is ejected from the ink jet type recording head of the recording head 2, and the ejected ink lands on the landing surface S1 of the recording sheet while the recording sheet S is transported to the Y2 side from Y1 side in the second direction Y with respect to the recording head 2 by the first transporting unit 5 and the second transporting unit 6.

In addition, the plurality of recording heads 2 are mounted on the carriage 3 in the ink jet type recording apparatus 1, and are movably provided in the axial direction of a carriage axis 9. The carriage axis 9 is disposed in such a manner that the axial direction thereof is in the same direction as the first direction X, and a driving force of a driving motor (not shown) is transferred to the carriage 3 via a gear or a belt. Therefore, the carriage 3 is moved in the axial direction of the carriage axis 9. In addition, the carriage 3 or the carriage axis 9 is provided in the direction orthogonal to the landing surface S1 with respect to the device main body 7 by a lifting unit (not shown), that is, is movably provided in the third direction Z. In the embodiment, a process in which the recording head 2 is moved to the direction orthogonal to the landing surface S1 of the recording sheet S when performing the printing is referred to as lifting. That is, in the third direction Z, a process in which the recording head 2 is moved from a Z1 side which is the recording sheet S side to a Z2 side which is far from the recording sheet S when performing the printing is referred to as rise, and a process in which the recording head 2 is moved from the Z2 side which is far from the recording sheet S to the Z1 side which is the recording sheet S side when performing the printing is referred to as fall.

Such a carriage 3 moves to the maintenance position which does not face the recording sheet S or the transporting belt 601 in such a manner that the recording head 2 moves in the first direction X which is the axial direction of the carriage axis 9 after the recording head 2 rises to the Z2 side in the third direction Z from the landing position at which the ink is ejected in the direction facing the transporting belt 601 and lands on the recording sheet S by a lifting unit (not shown). Then, a maintenance unit 400 maintains the recording head 2 at the maintenance position. Meanwhile, in the embodiment, a side on which the second transporting unit 6 such as the transporting belt 601 of an inner portion of the device main body 7 is provided in the first direction X is referred to as an X1 side, and the maintenance position side on which the maintenance unit 400 is provided is referred to as an X2 side.

In the embodiment, the maintenance unit 400 is provided with a wiping unit 410 which includes a blade wiping the liquid ejecting surface, and a capping unit 420 which includes a cap covering the liquid ejecting surface.

The wiping unit 410 is a member for wiping the liquid ejecting surface 20*a* of the head main body 200 of the recording head 2, and is provided in the device main body 7 along the second direction Y so as to move relative thereto. With respect to the recording head 2 which is moved to the maintenance position, the wiping unit 410 is allowed to contact the liquid ejecting surface 20*a* of the head main body 200, and move in the second direction Y, and thus, it is possible to wipe the liquid ejecting surface 20*a* of the head main body 200.

The capping unit 420 includes a cap which is formed of rubber or the like which is provided for each head main body 200, and a cap holding portion which holds the cap. The cap contacts the liquid ejecting surface 20*a* of the head main body 200, and is provided to cover all of the nozzle openings. If the cap covers the liquid ejecting surface 20*a*, a sealed space is formed therebetween. A suction path (not shown) is provided inside the cap holding portion. One end of this suction path communicates with the sealed space, and the other end communicates with a suction device such as a suction pump. The above described capping unit 420 allows the suction device to perform the suction operation in a state in which the liquid ejecting surface 20*a* of the head main body 200 is covered by the cap. Due to this suction operation, the inside of the sealed space which is formed by the cap is made to have negative pressure, and the ink in the flow path is suctioned from the nozzle opening 21 together with impurities such as air bubbles. In addition, it may be possible to prevent the ink in the vicinity of the nozzle opening 21 from being dried by covering the liquid ejecting surface 20*a* with the cap when the printing is not performed.

Meanwhile, either the wiping unit 410 or the capping unit 420 may be provided at the maintenance position as the maintenance unit 400. Further, it is not necessary to provide a mechanism for moving the recording head 2 to the maintenance position, or a space for the maintenance position in the ink jet type recording apparatus 1.

Figure 3:
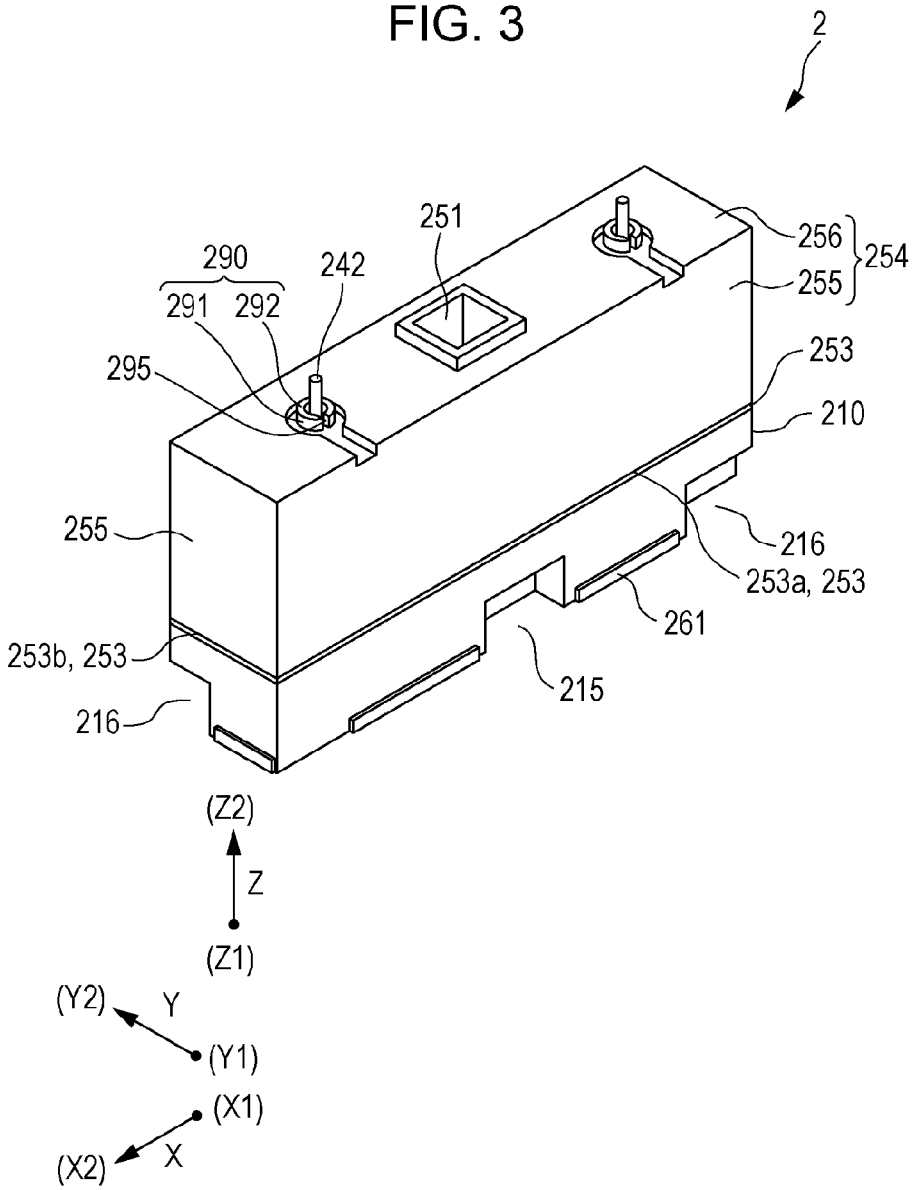
FIG. 3 is a perspective view of a recording head according to the embodiment.
Figure 4:
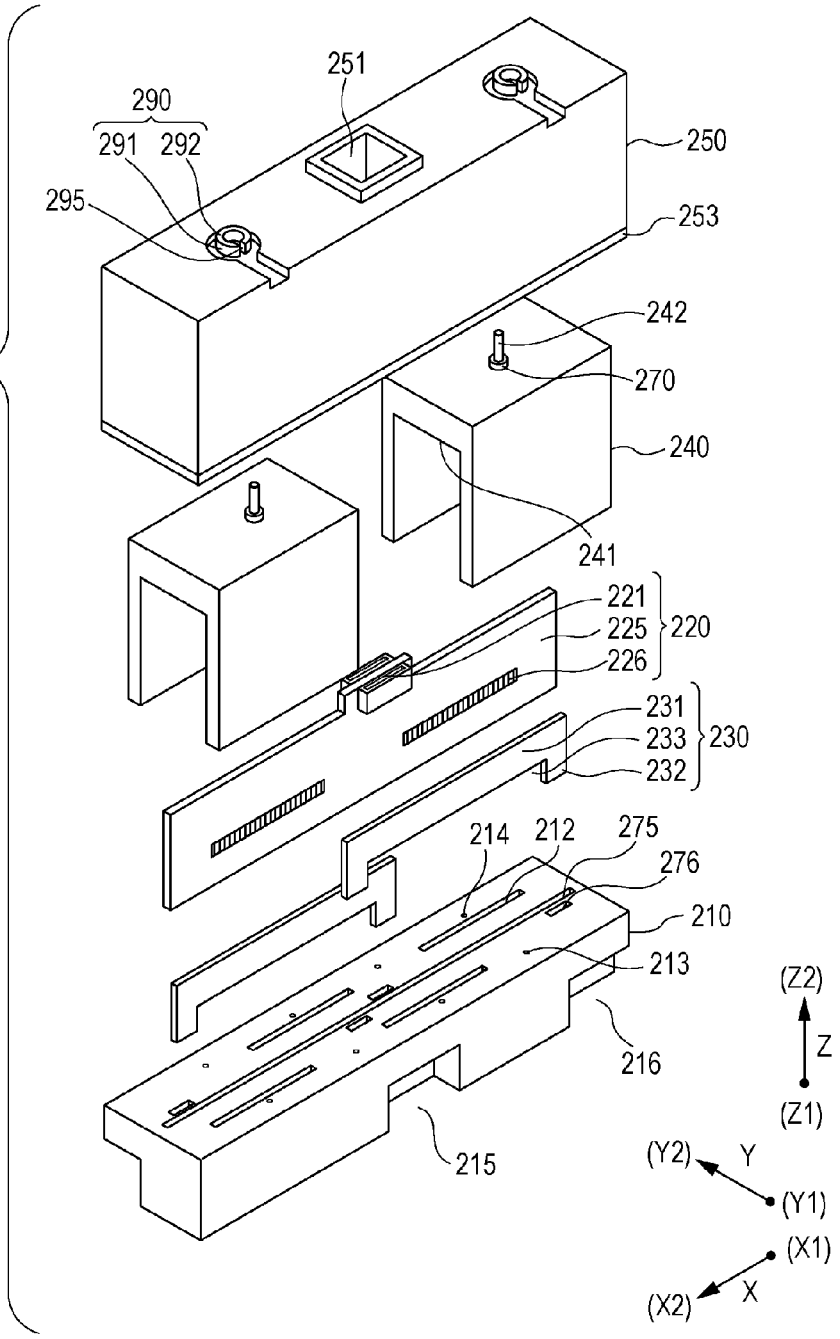
FIG. 4 is an exploded perspective view of the recording head according to a first embodiment.
Figure 5:
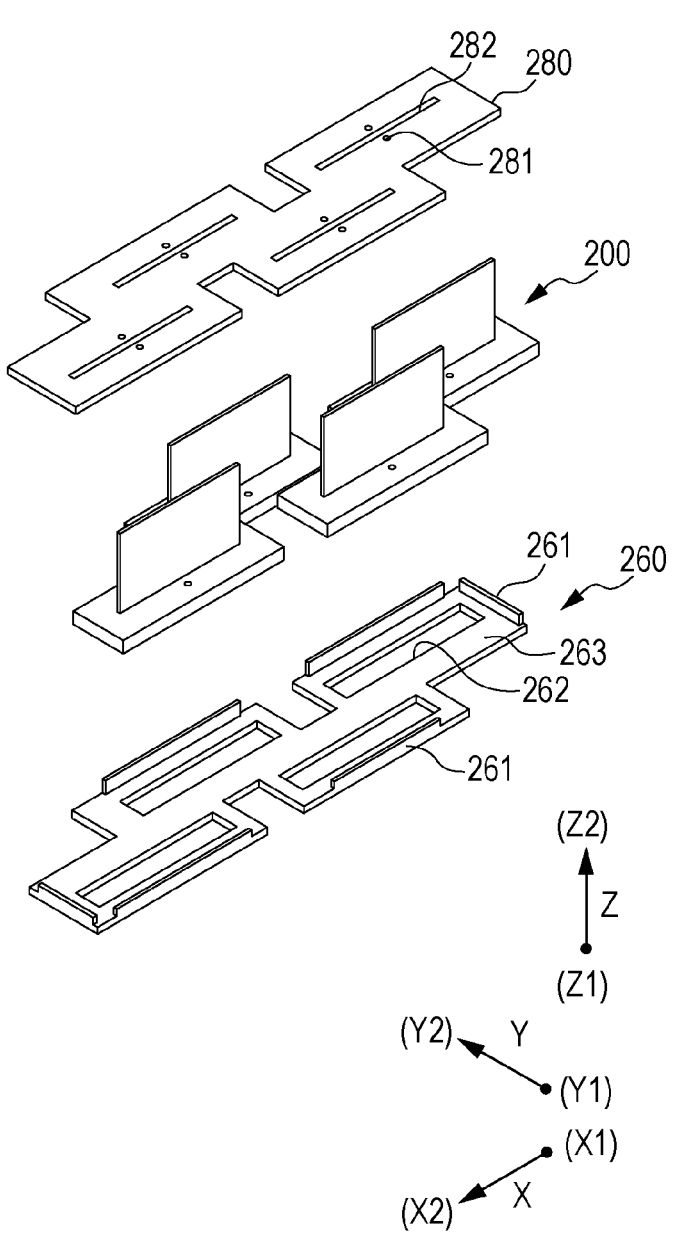
FIG. 5 is an exploded perspective view of the recording head according to the first embodiment.
Figure 6:
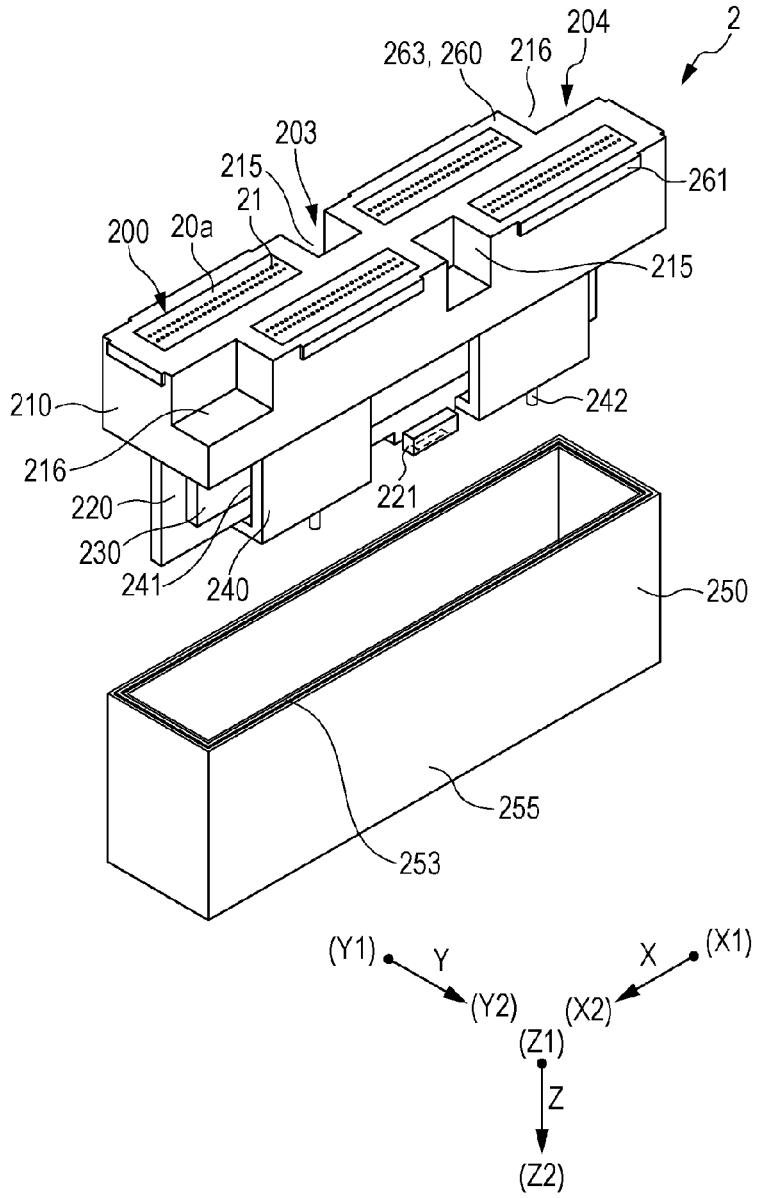
FIG. 6 is an exploded perspective view of the recording head according to the first embodiment.

FIG. 3 is a perspective view of a recording head according to the embodiment, FIG. 4 is an exploded perspective view of the recording head, FIG. 5 is an exploded perspective view of the recording head, and FIG. 6 is an exploded perspective view of the recording head.

As illustrated, the above described recording head 2 includes a plurality of head main bodies 200, a holder member 210 which holds the plurality of head main bodies 200 in the Z1 side which is one side of the third direction Z, a circuit board 220 which is fixed on to a surface on the Z2 side of the holder member 210 in the third direction Z, a first correcting plate 230 which is fixed onto the surface of the Z2 side of the holder member 210, a second correcting plate 280 which is fixed to a surface on the Z1 side of the holder member 210, a flow path member 240 which is fixed to the surface on the Z2 side of the holder member 210, a cover member 250 which accommodates the head main body 200 which is fixed to the surface on the Z2 side of the holder member 210, the circuit board 220, the first correcting plate 230, and the flow path member 240, and a fixing plate 260 which is fixed to the plurality of head main bodies 200.

Figure 24:
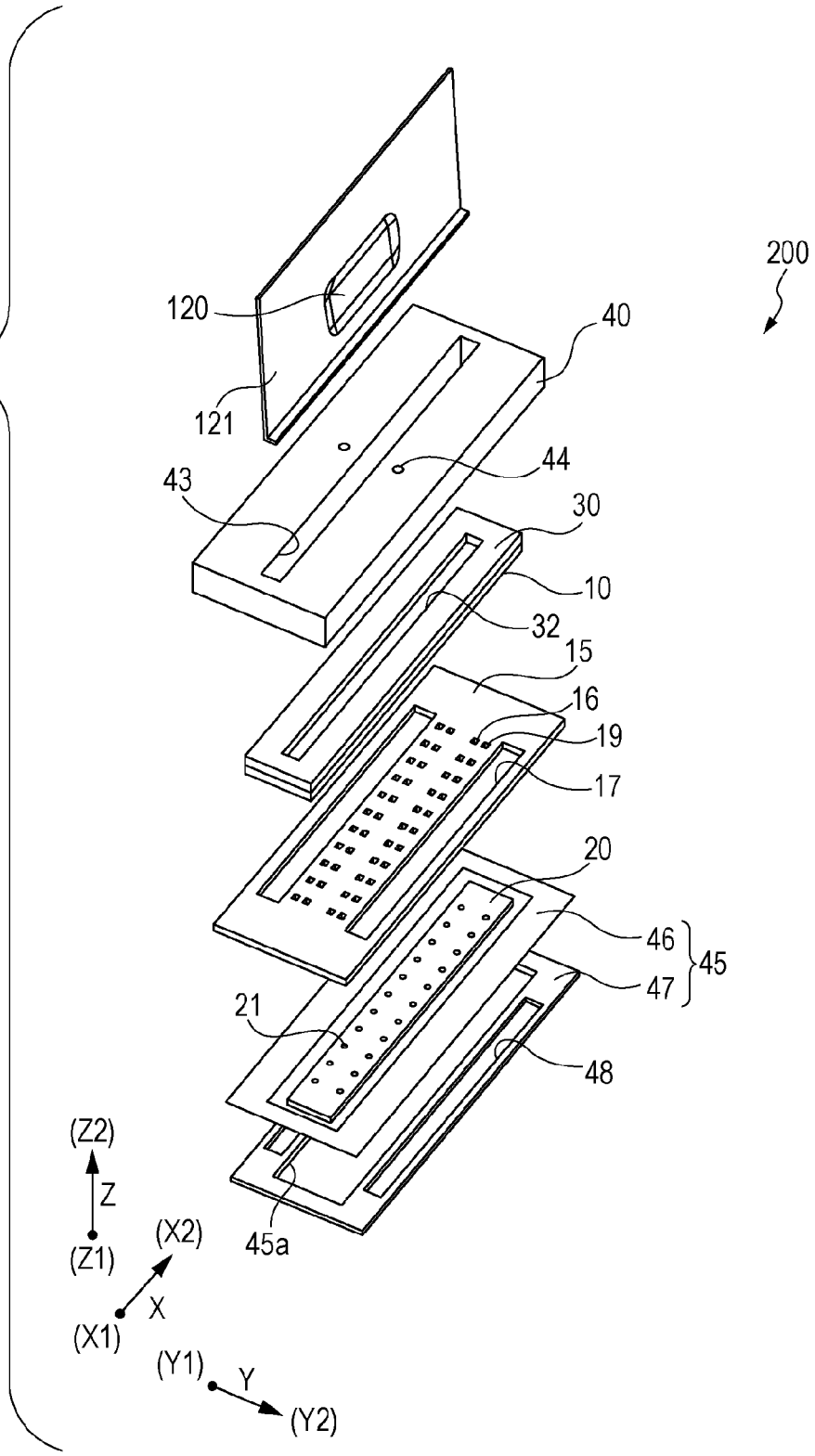
FIG. 24 is an exploded perspective view of a head main body.
Figure 25:
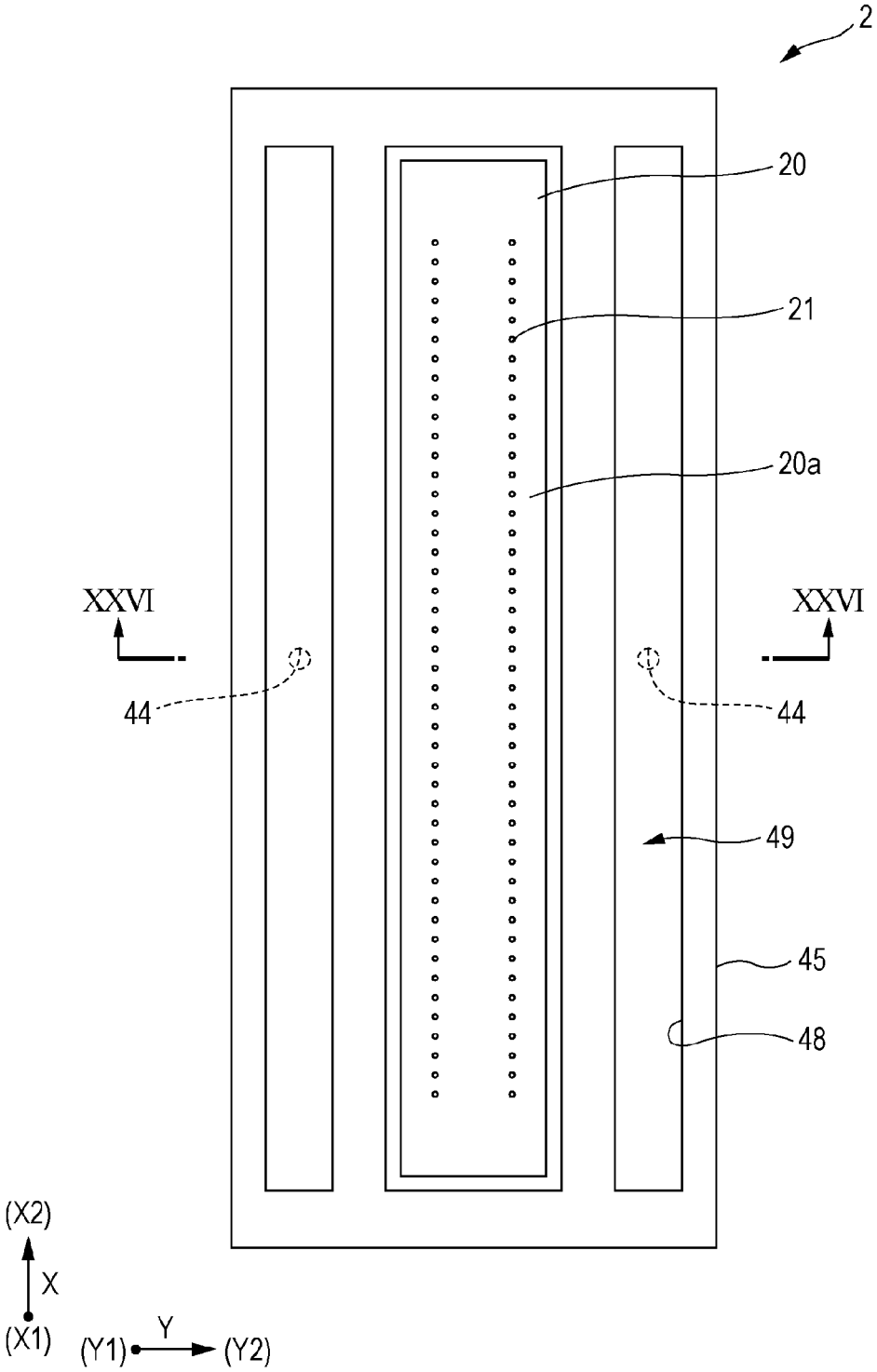
FIG. 25 is a top view of the liquid ejecting surface of the head main body.
Figure 26:
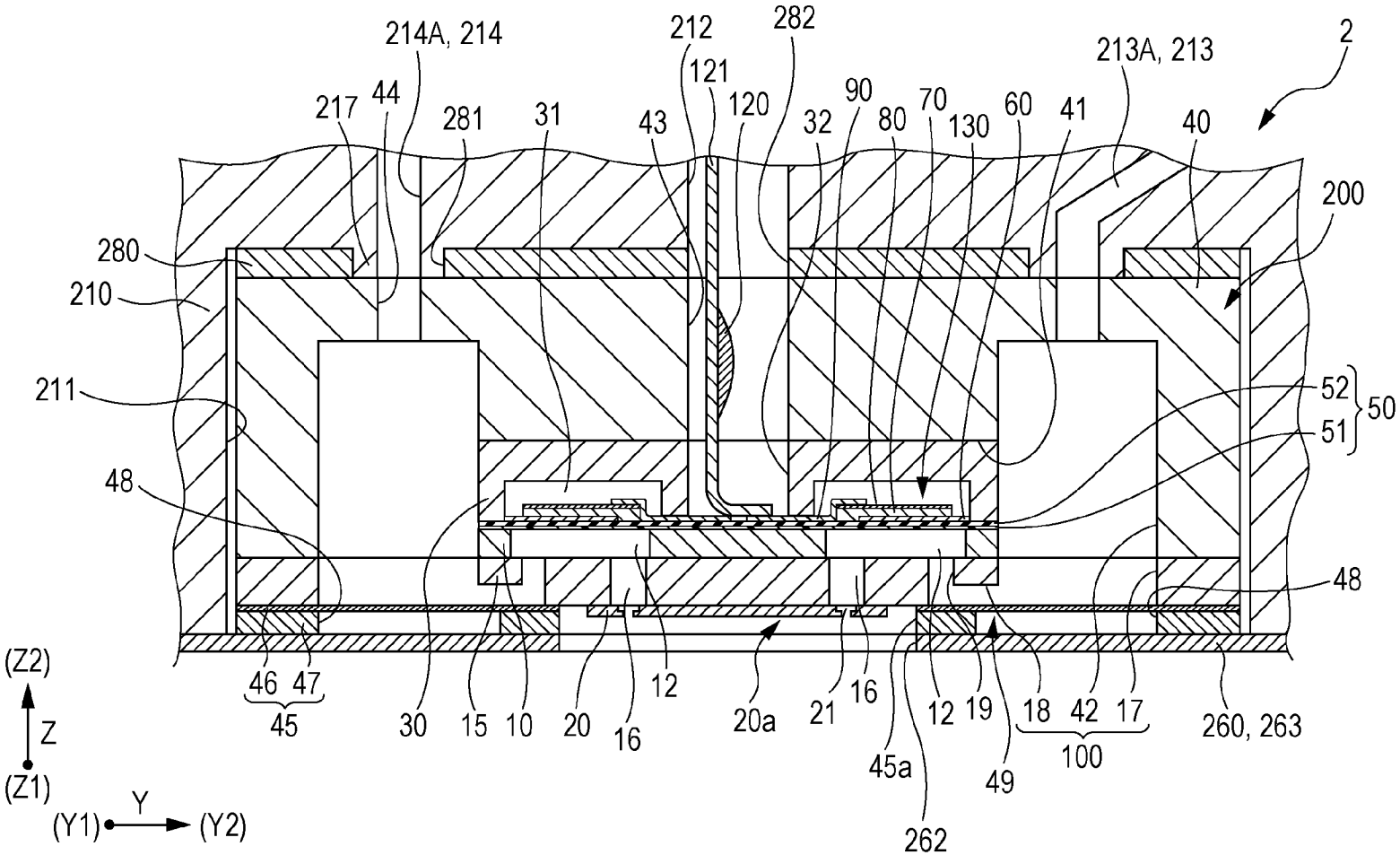
FIG. 26 is a cross-sectional diagram of FIG. 25, taken along line IIXV-IIXV.

First, the head main body 200 which ejects an ink droplet as an example of a liquid droplet will be described with reference to FIG. 24 to FIG. 26. FIG. 24 is an exploded perspective view of the head main body, and FIG. 25 is a top view of the liquid ejecting surface of the head main body, and FIG. 26 is a cross-sectional diagram of FIG. 25, taken along line IIXV-IIXV.

The head main body 200 is configured to include a plurality of members such as a flow path forming substrate 10, a communication plate 15, a nozzle plate 20, a protective substrate 30, a compliance substrate 45, and a case member 40.

A plurality of pressure generating chambers 12 which are formed by being partitioned with the plurality of partition walls are provided in parallel on the flow path forming substrate 10. The recording head 2 is mounted on the ink jet type recording apparatus 1 in such a manner that a juxtaposed direction of the pressure generating chambers 12 of the head main body 200 corresponds to the first direction X. Thereafter, the juxtaposed direction of the pressure generating chamber 12 is referred to as the first direction X in some cases. In addition, in the flow path forming substrate 10, a plurality of rows in which the pressure generating chambers 12 are disposed in parallel with the first direction X (two rows in the embodiment) are disposed in parallel with the second direction Y orthogonal to the first direction X.

The flow path forming substrate 10 can be formed of metal such as stainless steel or Ni, a ceramic material represented by $ZrO_2$ or $Al_2O_3$, a glass ceramic material, and an oxide such as MgO and $LaAlO_3$. In the embodiment, the flow path forming substrate 10 is formed of a silicon single crystal substrate. In the flow path forming substrate 10, the pressure generating chambers 12 which are partitioned by the plurality of partition walls are provided in parallel with the direction in which a plurality of nozzle openings 21 which eject the ink are provided in parallel, by performing anisotropic etching from one side.

The communication plate 15 and the nozzle plate 20 are successively stacked on the Z1 side of the flow path forming substrate 10 in the third direction Z. That is, the communication plate 15 is provided on the surface on the Z1 side of the flow path forming substrate 10 in the third direction Z, and the nozzle plate 20 which includes the nozzle opening 21 is provided on the side opposite to the flow path forming substrate 10 of the communication plate 15, that is, on the surface on the Z1 side of the communication plate 15.

A nozzle communication path 16 which communicates with the pressure generating chamber 12 and the nozzle opening 21 is provided in the communication plate 15. The communication plate 15 has a greater area than that of the flow path forming substrate 10, whereas the nozzle plate 20 has a smaller area than that of the flow path forming substrate 10. Since the nozzle opening 21 of the nozzle plate 20 and the pressure generating chamber 12 are separated from each other by providing the communication plate 15 as described above, the ink in the pressure generating chamber 12 is less likely to be affected by the viscosity of the ink due to evaporation of water which is generated in the vicinity of the nozzle opening 21. In addition, the nozzle plate 20 may only cover an opening of the nozzle communication path 16 communicating with the pressure generating chamber 12 and the nozzle opening 21, and thus it is possible to make the area of the nozzle plate 20 relatively small, thereby realizing cost reduction.

In addition, the communication plate 15 is provided with a first manifold portion 17 which forms a portion of a manifold 100, and a second manifold portion 18 (a diaphragm flow path and an orifice flow path).

The first manifold portion 17 is provided by passing through the communication plate 15 in the thickness direction. Here, the thickness direction means the third direction Z in which the communication plate 15 and the flow path forming substrate 10 are stacked on each other. The second manifold portion 18 is provided to open to the nozzle plate 20 side of the communication plate 15 without passing through the communication plate 15 in the thickness direction.

In the communication plate 15, a supply communication path 19 which communicates with one end portion of the pressure generating chamber 12 in the second direction Y is independently provided for each of the pressure generating chambers 12. The above-described supply communication path 19 communicates with the second manifold portion 18 and the pressure generating chamber 12.

Examples of the material used for the communication plate 15 can include metal such as stainless steel or nickel (Ni), or ceramics such as zirconium (Zr). Meanwhile, it is preferable that the communication plate 15 is formed of a material with approximately the same linear expansion coefficient of the flow path forming substrate 10. That is, in a case where the flow path forming substrate 10 and materials with the greatly different linear expansion coefficients are used as the communication plate 15, warpage may occur on the flow path forming substrate 10 and the communication plate 15 during the heating or cooling process. In the embodiment, it is possible to suppress the warpage, cracking, or peeling due to the heat by using the same material as that of the flow path forming substrate 10, that is, by using the silicon single crystal substrate, as the communication plate 15.

In the nozzle plate 20, the nozzle opening 21 is formed in such a manner as to be able to communicate with each of the pressure generating chambers 12 via the nozzle communication path 16. The above-described nozzle openings 21 are disposed in parallel with the first direction X, and the rows of the nozzle openings 21 disposed in parallel with the first direction X are formed in two rows in the second direction Y. In addition, one surface onto which an ink droplet is ejected between both surfaces of the nozzle plate 20, that is, the surface of the side opposite to the pressure generating chamber 12 is referred to as the liquid ejecting surface 20*a*.

Examples of the nozzle plate 20 can include, metal such as stainless steel (SUS), an organic material such a polyamide resin, and the silicon single crystal substrate. Meanwhile, using the silicon single crystal substrate as the nozzle plate 20 results in the nozzle plate 20 and the communication plate 15 having the same linear expansion coefficient, and therefore, it is possible to prevent the warpage due to the heating and cooling process or cracks and peeling due to the heat.

The vibrating plate 50 is formed on the side opposite to the communication plate 15 of a flow path forming substrate 10. In the embodiment, the vibrating plate 50 includes an elastic film 51 which is formed of a silicon oxide provided on the flow path forming substrate 10, and an insulator film 52 which is formed of a zirconium oxide provided on the elastic film 51. Meanwhile, a liquid flow path such as the pressure generating chamber 12 is formed by performing the anisotropic etching on one surface of the flow path forming substrate 10 (the surface onto which the nozzle plate 20 is bonded), and the other surface of the liquid flow path such as the pressure generating chamber 12 is defined by the elastic film 51.

A piezoelectric actuator 130 which is a pressure generating unit of the embodiment, and includes a first electrode 60, a piezoelectric layer 70, and a second electrode 80 is provided on the vibrating plate 50 of the flow path forming substrate 10. Here, the piezoelectric actuator 130 represents a part including the first electrode 60, the piezoelectric layer 70 and, the second electrode 80. Typically, a configuration is made in such a manner that one electrode of the piezoelectric actuator 130 is set to be a common electrode and the other electrode is patterned for each of the pressure generating chambers 12. In the embodiment, a configuration is made in such a manner that the first electrode 60 is continuously provided over a plurality of piezoelectric actuators 130 so as to be a common electrode, and the second electrode 80 is independently provided for each of the piezoelectric actuators 130 so as to be an individual electrode. Of course, it does not matter that the above configuration can be reversed depending on the state of a driving circuit or a wiring. In addition, in the above described example, the vibrating plate 50 is formed of the elastic film 51 and the insulator film 52, but the configuration of the vibrating plate 50 is not limited thereto, and for example, the vibrating plate 50 may be formed of either of the elastic film 51 and the insulator film 52, or the vibrating plate 50 may be neither the elastic film 51 nor the insulator film 52 such that only the first electrode 60 is used as the vibrating plate 50. In addition, the piezoelectric actuator 130 may substantially function as the vibrating plate.

The piezoelectric layer 70 is formed of an oxide piezoelectric material having a polarization structure, and for example, can be formed of a Pervoskite-type oxide indicated by a general formula $ABO_3$, and can be used in a lead-based piezoelectric material including a lead or a non-lead piezoelectric material which does not include a lead piezoelectric material.

The second electrode 80 which is an individual electrode of the above-described piezoelectric actuator 130 is connected to an end portion of the lead electrode 90 which is formed of, for example, metal (Au) and is pulled out from the vicinity of the end portion on the side opposite to the supply communication path 19, and then is extended onto the vibrating plate 50.

Further, a wiring substrate 121 on which the driving circuit 120 for driving the piezoelectric actuator 130 is provided is connected to the other end portion of the lead electrode 90. The wiring substrate 121 can use a sheet-like substance having flexibility, for example, a COF substrate. Meanwhile, the driving circuit 120 is provided on the wiring substrate 121. That is, the wiring substrate 121 may be an FFC, an FPC, or the like without being limited to the COF substrate.

The protective substrate 30 having substantially the same size as the flow path forming substrate 10 is bonded on the surface of the piezoelectric actuator 130 of the flow path forming substrate 10. The protective substrate 30 includes a holding unit 31 which is a space for protecting the piezoelectric actuator 130. The holding unit 31 does not pass through the protective substrate 30 in the third direction Z which is the thickness direction, and is formed into a concave shape opening to the flow path forming substrate 10. In addition, the holding unit 31 is independently provided for each row which is formed of the plurality of piezoelectric actuators 130 disposed in the first direction X. That is, the holding unit 31 is provided in such a manner as to accommodate the rows of the piezoelectric actuator 130 which are disposed in parallel with the first direction X, and for each row of the piezoelectric actuators 130 two holding units 31 are provided in parallel with the second direction Y. The above-described holding unit 31 may include enough space to drive the piezoelectric actuator 130, and the space may or may not be sealed.

The protective substrate 30 includes a through hole 32 passing through in the third direction Z which is the thickness direction. The through hole 32 is provided in the first direction X which is the juxtaposed direction of the plurality of piezoelectric actuators 130 between two holding units 31 provided in parallel with the second direction Y. That is, the through hole 32 is assumed to be the opening having a long side in the juxtaposed direction of the plurality of piezoelectric actuators 130. The other end portion of the lead electrode 90 extends so as to expose the inner side of the through hole 32, and the lead electrode 90 and the wiring substrate 121 which are electrically connected to each other in the through hole 32.

Examples of the protective substrate 30 preferably include a material having substantially the same coefficient of thermal expansion as the flow path forming substrate 10, for example, glass or ceramics, and in the embodiment, a silicon single crystal substrate which is the same material as that in the flow path forming substrate 10. In addition, a bonding method of the flow path forming substrate 10 and the protective substrate 30 is not limited the above description, for example, the flow path forming substrate 10 and the protective substrate 30 are bonded to each other via an adhesive (not shown) in the embodiment.

The case member 40 has substantially the same shape of the above-described communication plate 15 in a plan view, and is not only connected to the protective substrate 30 but also bonded to the communication plate 15. Specifically, the case member 40 includes a concavity 41 having a depth into which the flow path forming substrate 10 and the protective substrate 30 are accommodated, on the protective substrate 30. The concavity 41 has an opening area which is wider than a surface onto which the flow path forming substrate 10 of the protective substrate 30 is bonded. The opening surface on the nozzle plate 20 of the concavity 41 is sealed by the communication plate 15 in a state where the flow path forming substrate 10 or the like is accommodated in the concavity 41. For this reason, in the outer periphery portion of the flow path forming substrate 10, a third manifold portion 42 is defined by the case member 40. Further, the embodiment of the manifold 100 is configured to include the first manifold portion 17 and the second manifold portion 18 which are provided on the communication plate 15, and the third manifold portion 42 defined by the case member 40. That is, the manifold 100 is provided with the first manifold portion 17, the second manifold portion 18, and the third manifold portion 42.

The manifold 100 of the embodiment is disposed on both outer sides of the two pressure generating chambers 12 in the second direction Y, and two manifolds 100 disposed on both outer sides of the two pressure generating chambers 12 are independently provided so as not to communicate with each other in the head main body 200. That is, one manifold 100 is provided in such a manner as to be able to communicate with each row of the pressure generating chamber 12 of the embodiment. In other words, the manifold 100 is provided for each nozzle row. Of course, the two manifolds 100 may communicate with each other.

In addition, the case member 40 includes an introduction port 44 communicating with the manifold 100. The ink is introduced from the introduction port 44 to the manifold 100. Meanwhile, although specifically described later, the introduction port 44 communicates with a first connection flow path 213 and a second connection flow path 214 which are formed in the holder member 210, and the ink is supplied from the first connection flow path 213 and the second connection flow path 214 to the introduction port 44.

In addition, a connection port 43 through which the wiring substrate 121 passes while communicating with the through hole 32 of the protective substrate 30 is provided in the case member 40. Meanwhile, although specifically described later, the connection port 43 communicates with a first wiring insertion hole 212 which is formed on the holder member 210, and a second wiring insertion hole 282 which is formed on the second correcting plate 280 enforcing the holder member 210. That is, an insertion hole is formed which communicates with the connection port 43, the first wiring insertion hole 212, and the second wiring insertion hole 282, and then the wiring substrate 121 is inserted into the insertion hole.

As the material of the case member 40, for example, resin, metal, or the like can be used. Incidentally, it is possible to realize mass production of the case member 40 at low cost by molding the resin material.

The compliance substrate 45 is provided on a surface to which the first manifold portion 17 and the second manifold portion 18 of the communication plate 15 open. The compliance substrate 45 has substantially the same size as that of the above-described communication plate 15 in a plan view, and is provided with a first exposure opening 45*a* exposing the nozzle plate 20. Further, the opening of the first manifold portion 17 and the second manifold portion 18 to the liquid ejecting surface 20*a* side is sealed in a state where the compliance substrate 45 allows the nozzle plate 20 to be exposed through the first exposure opening 45*a*. That is, a portion of the manifold 100 is defined by the compliance substrate 45.

The compliance substrate 45 according to the embodiment is provided with a sealing film 46 and a fixing substrate 47. The sealing film 46 is formed of a thin film having flexibility (for example, a thin film is formed of polyphenylene sulfide (PPS) or the like and has a thickness of 20 μm or smaller), and the fixing substrate 47 is formed of a hard material, for example, metal such as stainless steel (SUS). Since a region facing the manifold 100 of the fixing substrate 47 corresponds to an opening portion 48 which is completely removed in the thickness direction, one side surface of the manifold 100 corresponds to the compliance portion 49 which is a flexible part in which only the sealing film 46 having the flexibility is sealed. In the embodiment, one compliance portion 49 is provided corresponding to one manifold 100. That is, in the embodiment, since there are two manifolds 100 provided, two compliance portions 49 are provided on both sides in the second direction Y in such a manner as to interpose the nozzle plate 20 therebetween.

In the above-described configuration, when ejecting the ink, the head main body 200 absorbs the ink via the introduction port 44, and causes the inside of the flow path from the manifold 100 to the nozzle opening 21 to be filled with the ink. Thereafter, in accordance with a signal from the driving circuit 120, a voltage is applied to the piezoelectric actuator 130 corresponding to the pressure generating chamber 12, and thereby the piezoelectric actuator 130 and the vibrating plate 50 are flexibly deformed. For this reason, the pressure in the pressure generating chamber 12 increases, and thus ink droplets are ejected from a predetermined nozzle opening 21.

Figure 7:
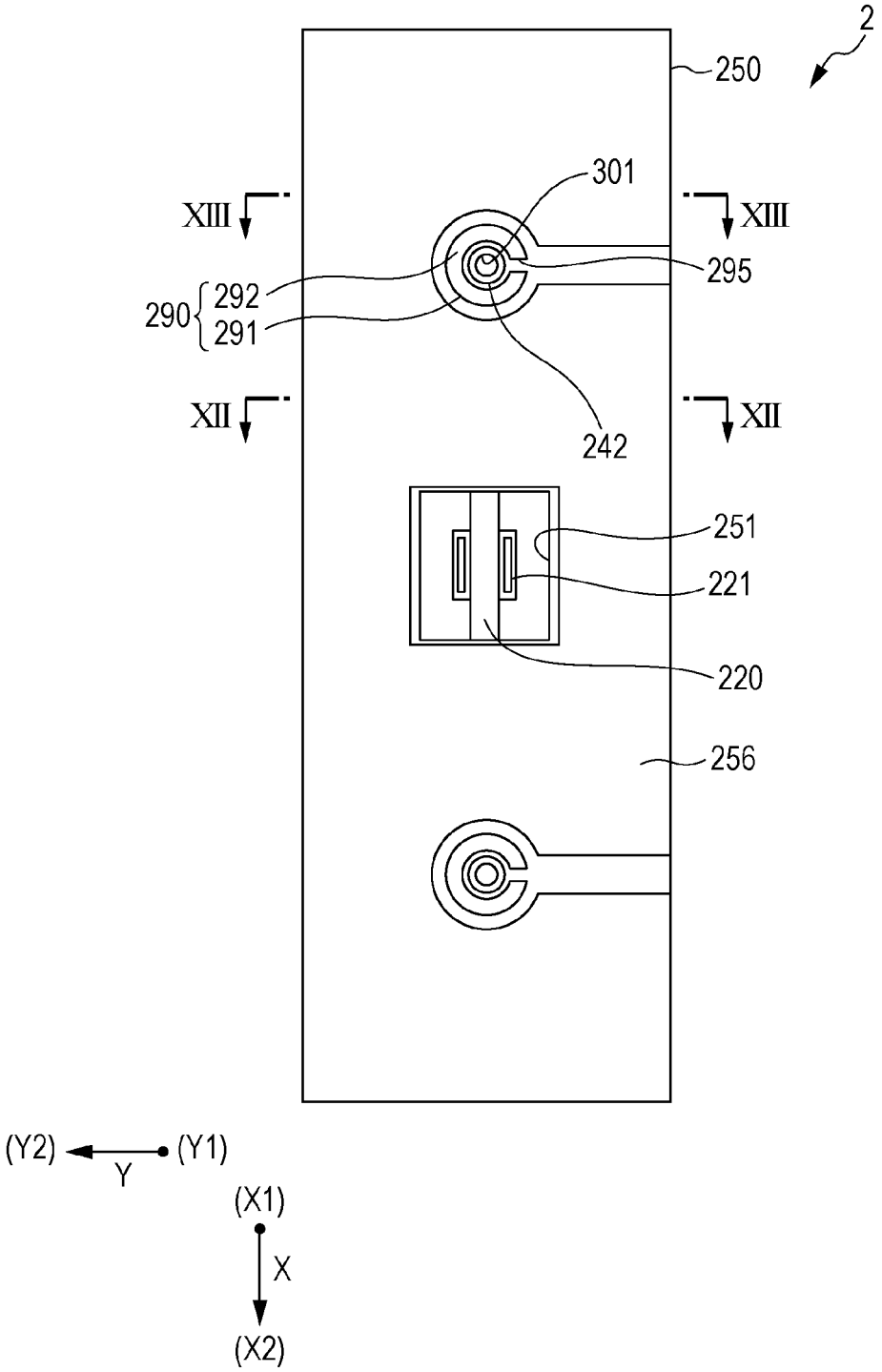
FIG. 7 is a top view of the recording head according to the first embodiment.
Figure 8:
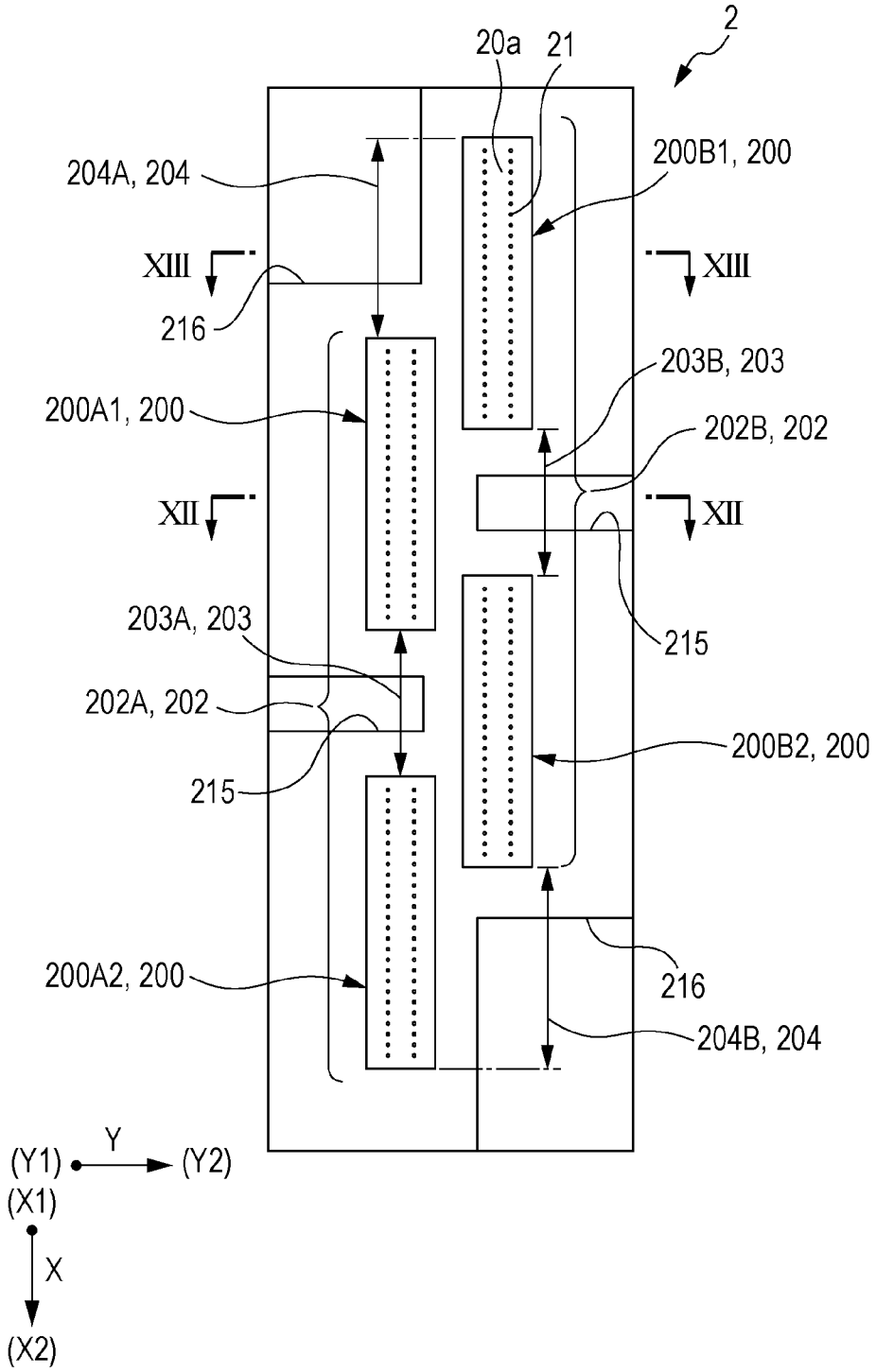
FIG. 8 is a bottom view of the recording head according to the first embodiment.
Figure 9:
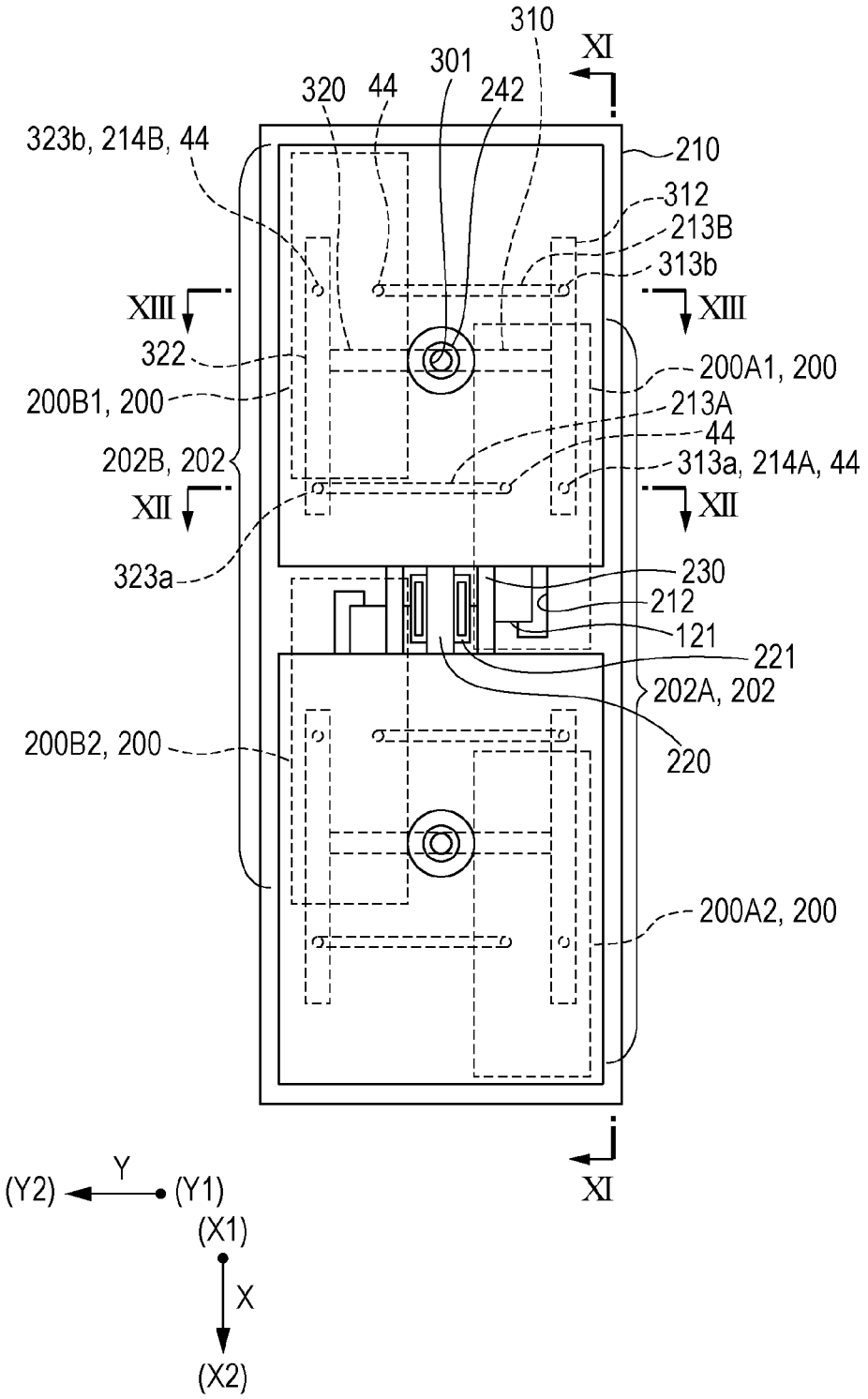
FIG. 9 is a top view of the recording head with a cover member detached therefrom.
Figure 10:
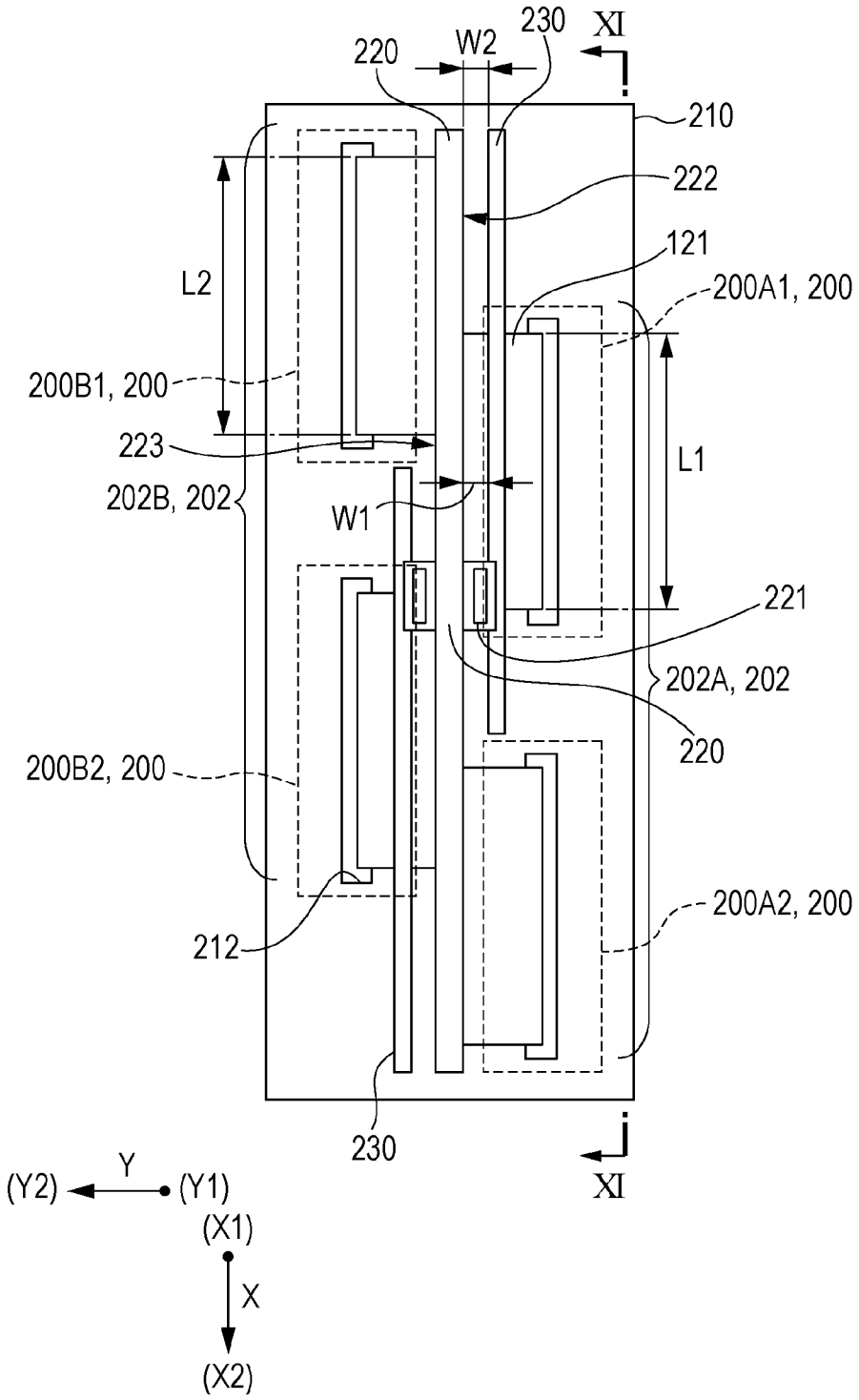
FIG. 10 is a top view of the recording head with the cover member and a flow path member which are detached therefrom.
Figure 11:
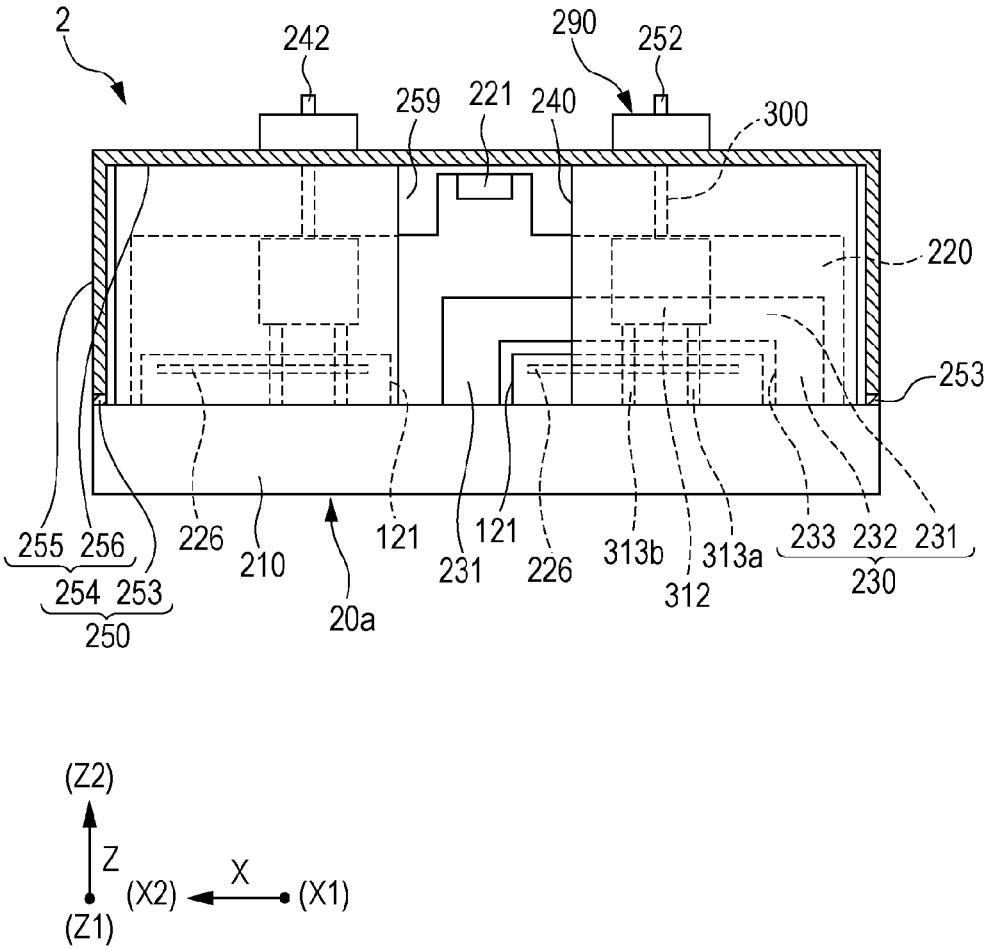
FIG. 11 is a cross-sectional diagram of FIG. 9 and FIG. 10, taken along line XI-XI.
Figure 12:
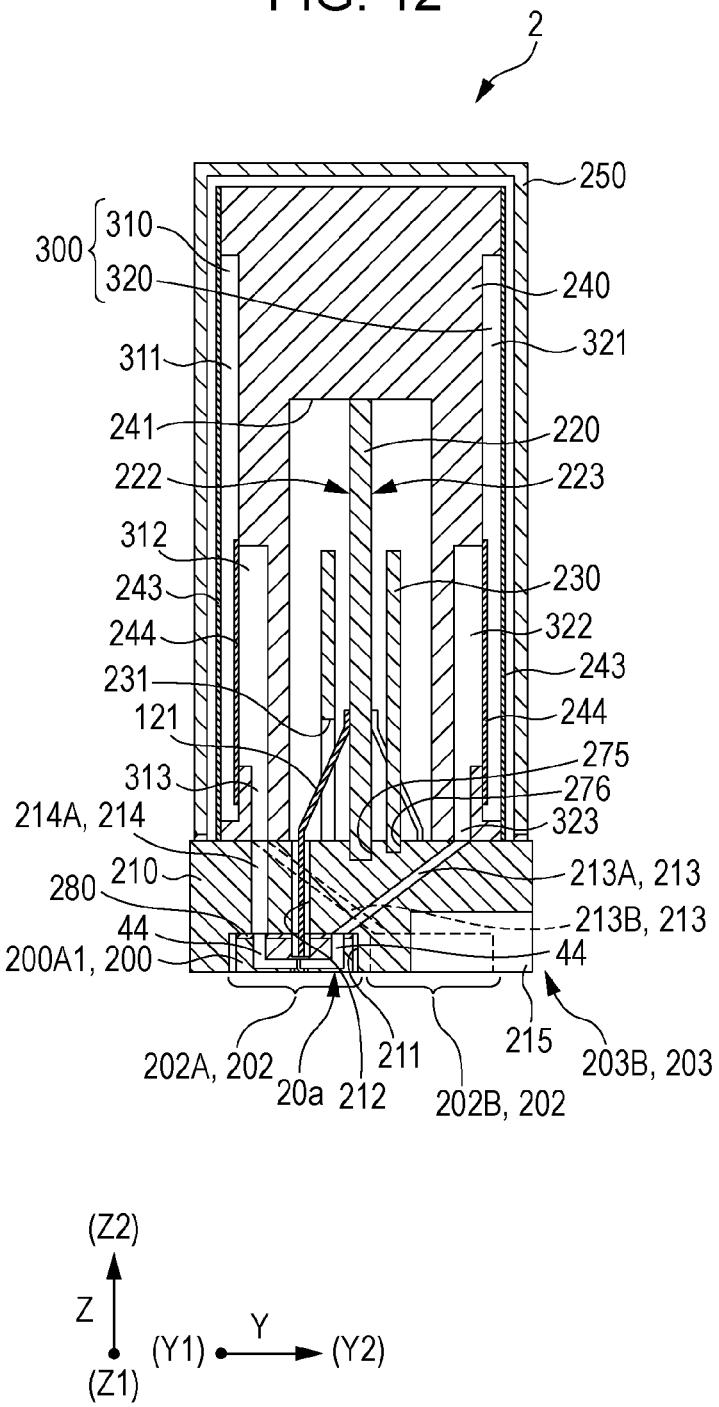
FIG. 12 is a cross-sectional diagram of FIG. 7 to FIG. 9, taken along line XII-XII.
Figure 13:
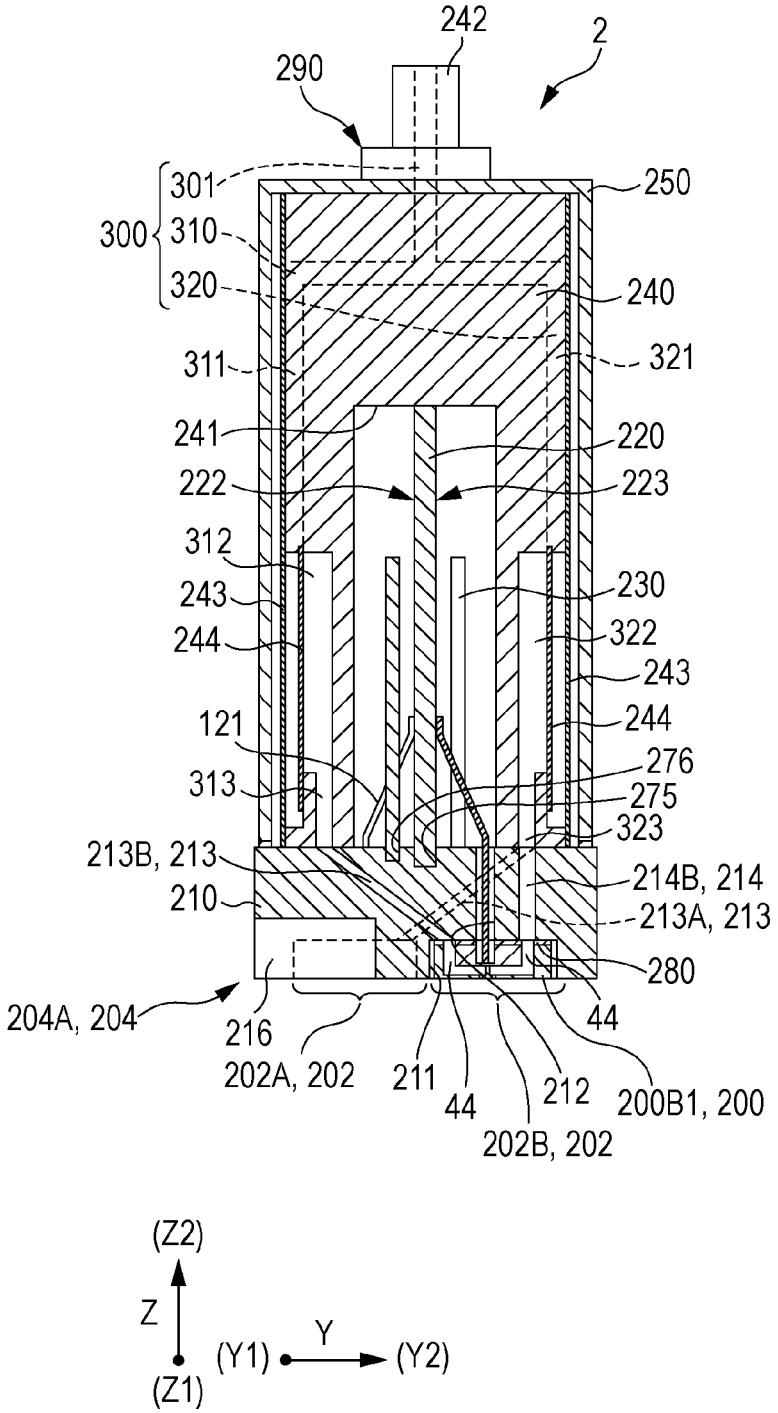
FIG. 13 is a cross-sectional diagram of FIGS. 7 to 9, taken along line XIII-XIII.
Figure 14A:
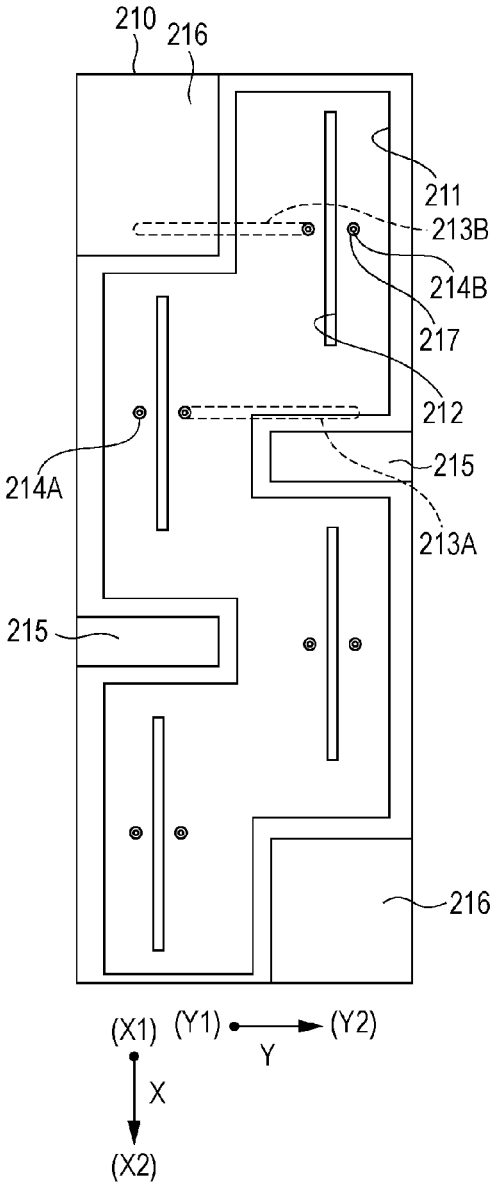
FIG. 14A is a bottom view of a holder member to which a second correcting plate is fixed.
Figure 14B:
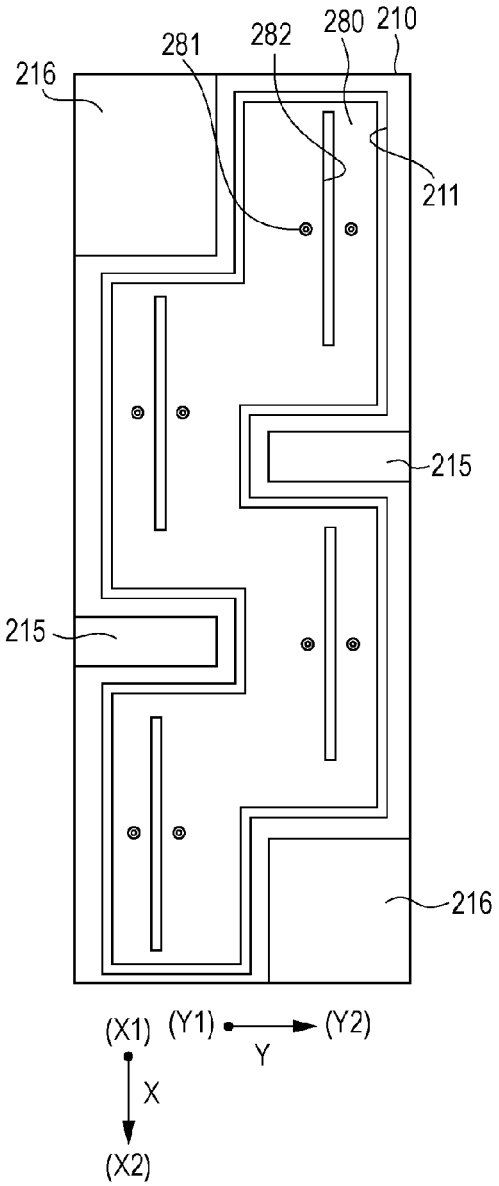
FIG. 14B is a bottom view of the holder member.
Figure 15:
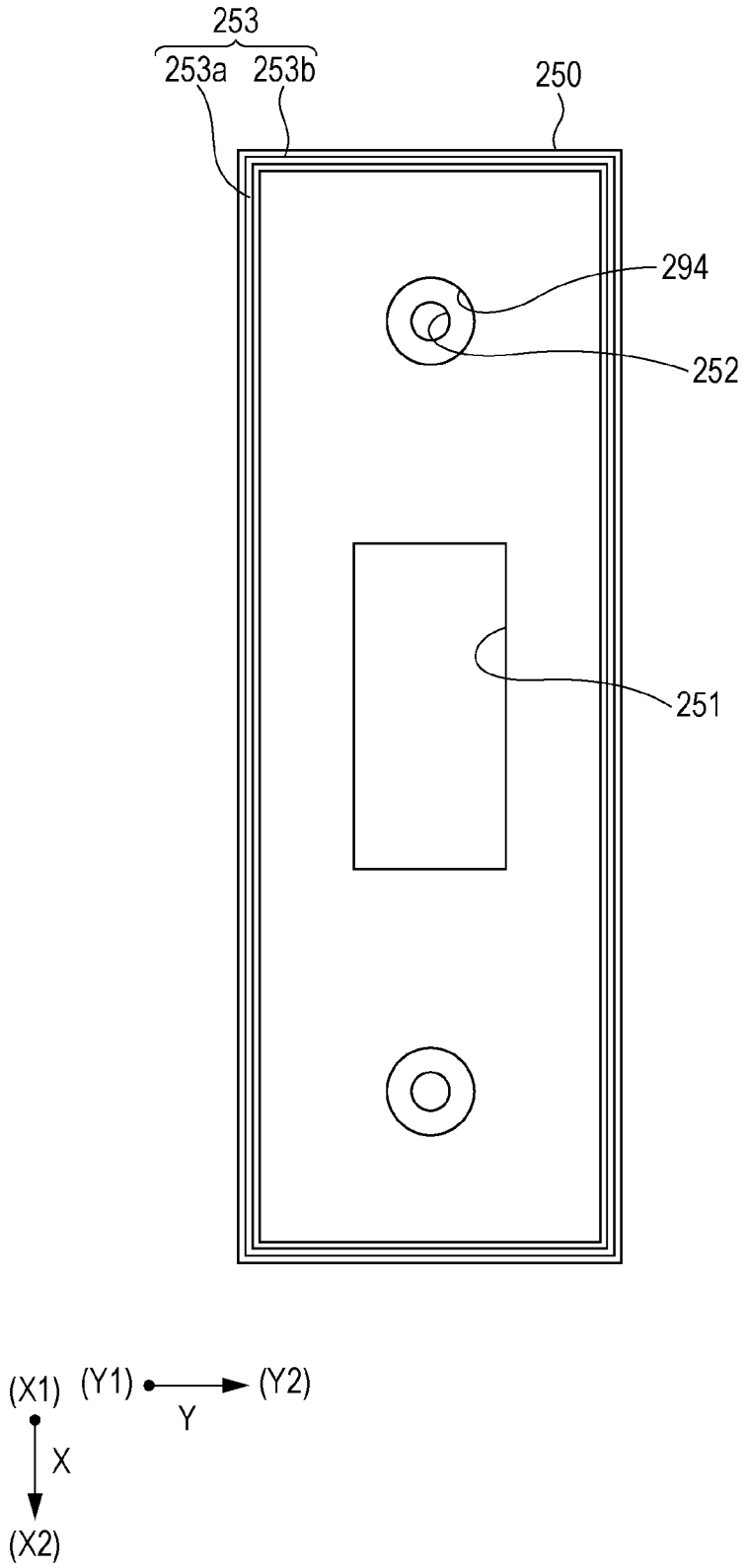
FIG. 15 is a bottom view of the cover member.

The above-described head main body 200 is held by the recording head 2. Here, the recording head 2 will be described with reference to FIG. 3 to FIG. 6, and FIG. 7 to FIG. 17. FIG. 7 is a top view of the recording head, FIG. 8 is a bottom view of the recording head, FIG. 9 is a top view of the recording head with a cover member detached therefrom, FIG. 10 is a top view of the recording head from which the cover member and a flow path member are detached, FIG. 11 is a cross-sectional diagram of FIG. 9 and FIG. 10, taken along line XI-XI, FIG. 12 is a cross-sectional diagram of FIG. 7 to FIG. 9, taken along line XII-XII in the second direction Y, FIG. 13 is a cross-sectional diagram of FIGS. 7 to 9, taken along line XIII-XIII in the second direction Y, FIG. 14A is a bottom view of a holder member to which a second correcting plate is fixed, FIG. 14B is a bottom view of the holder member, and FIG. 15 is a bottom view of the cover member. Further, the top views in FIG. 7, FIG. 9, and FIG. 10 correspond to a Z2 side surface in the third direction Z, and the bottom surface in FIG. 8, FIG. 14A and FIG. 14B, and FIG. 15 correspond to a Z1 side surface in the third direction Z.

As illustrated in FIG. 5, FIG. 6, and FIG. 8, in the embodiment, four head main bodies 200 are disposed zigzagging along the first direction X in one recording head 2. Specifically, the recording head 2 includes a first head main body group 202A which is disposed at a first interval 203A in the first direction X, and the second head main body group 202B which is disposed at a second interval 203B in the first direction X. The head main body 200 is held in such a manner that the juxtaposed direction of the nozzle opening 21 corresponds to the first direction X of the recording head 2.

The head main body group 202 provided on the Y1 side is referred to as the first head main body group 202A, and the head main body group 202 provided on the Y2 side is referred to as a second head main body group 202B. In addition, the head main body 200 on the X1 side is referred to as a head main body 200A1, and the head main body 200 on the X2 side is referred to as a head main body 200A2 of the first head main body group 202A. Further, the head main body 200 on the X1 side is referred to as a head main body 200B1, and the head main body 200 on the X2 side is referred to as a head main body 200B2 of the second head main body group 202B.

In the head main body 200, the first head main body group 202A and the second head main body group 202B are disposed at positions which are different from each other in the second direction Y orthogonal to the first direction X, a certain head main body 200 in the first head main body group 202A is disposed at a position in which the second interval 203B is provided in the first direction X, and a certain head main body 200 of the second head main body group 202B is disposed at a position in which the first interval 203A is provided.

That is, the first head main body group 202A and the second head main body group 202B are disposed by being shifted from each other in the first direction X. An amount of variation between the first head main body group 202A and the second head main body group 202B in the first direction X is a half of a pitch of the head main body 200 configuring the head main body group 202. In the embodiment, the first head main body group 202A is disposed to be shifted to the X2 side with respect to the second head main body group 202B. That is, the first interval 203A between the head main bodes 200 which are adjacent to each other in the first direction X in the first head main body group 202A is provided in such a manner as to face to the head main body 200 configuring the second head main body group 202B, that is, the head main body 200B2 in the second direction Y in the embodiment. In addition, the second interval 203B between the head main bodes 200 which are adjacent to each other in the first direction X in the second head main body group 202B is provided in such a manner as to face to the head main body 200 configuring the first head main body group 202A, that is, the head main body 200A1 in the second direction Y in the embodiment. By disposing the first head main body group 202A and the second head main body group 202B as described above, it is possible to continuously provide the nozzle opening 21 at the same pitch in parallel with the first direction X as four head main bodies 200.

As illustrated in FIG. 9 to FIG. 14A and FIG. 14B, the holder member 210 holds the plurality of head main bodies 200 on the surface facing the recording sheet S, that is, on the Z1 side surface in the third direction Z. Specifically, a head holding unit 211 having a concave shape which opens to the Z1 side is provided on the surface on the Z1 side of the holder member 210. The head holding unit 211 accommodates a second correcting plate 280 described later, and the plurality of head main bodies 200 fixed with the fixing plate 260. The opening of the head holding unit 211 is sealed by the fixing plate 260. That is, the head main body 200 and the second correcting plate 280 are accommodated in the inside in which the head holding unit 211 and the fixing plate 260 are formed.

The head holding unit 211 is formed into a shape into which the head main body 200 configuring the first head main body group 202A and the second head main body group 202B can be accommodated. In the embodiment, the head holding unit 211 is formed so as to face a position of the head main body 200 which configures the first head main body group 202A and the second head main body group 202B, by causing four concavities, which have a rectangular opening slightly larger than the head main body 200, to communicate with each other. In other words, the head holding unit 211 is formed on the surface on the Z1 side of the holder member 210 having a substantially rectangular shape, by providing the concavity in a region other than a first accommodation unit 215 and a second accommodation unit 216 (described later).

In addition, although specifically described later, the holder member 210 is provided with first connection flow paths 213A and 213B, and second connection flow paths 214A and 214B as examples of a first flow path. The first flow path is the flow path which is provided in the holder member 210, to which ink is supplied from the flow path member 240, and supplies the ink to the head main body 200.

The first connection flow path 213 is the flow path which is provided in the holder member 210 by being inclined with respect to the third direction Z. In the embodiment, as the first connection flow path 213, two flow paths which are the first connection flow path 213A and the first connection flow path 213B are provided in the holder member 210 with respect to the flow path member 240 on the X1 side, the head main body 200A1, and the head main body 200B1. In the same way, as the first connection flow path 213, two flow paths which are the first connection flow path 213A and the first connection flow path 213B are provided in the holder member 210 with respect to the flow path member 240 on the X2 side, the head main body 200A2, and the head main body 200B2.

The first connection flow path 213A communicates with a second supply path 323 of the flow path member 240 (that is, the second supply path 323 on the X2 side of the two flow paths), and the introduction port 44 on the Y2 side of the head main body 200A1 which is disposed on the X1 side of the first head main body group 202A. The first connection flow path 213B communicates with a first supply path 313 of the flow path member 240 (that is, the first supply path 313 on the X1 side of two supply paths), and the introduction port 44 on the Y1 side of the head main body 200B1 which is disposed on the X1 side of the second head main body group 202B. Meanwhile, the same is true for the first connection flow path which connects the flow path member 240 on the X2 side, the head main body 200A2, and the head main body 200B2.

In addition, a projecting portion 217 which protrudes to the Z1 side in the third direction Z is provided on the bottom surface of the head holding unit 211, and the openings on the Z1 side of the first connection flow paths 213A and 213B open to a top surface of the projecting portion 217. The opening on the Z2 side of the first connection flow path 213A opens to the position facing a second supply path 323 (described later) of the flow path member 240. The opening on the Z2 side of the first connection flow path 213B opens to the position facing a first supply path 313 (described later) of the flow path member 240. Note that, the same is true for the first connection flow path which connects to the flow path member 240 on the X2 side, the head main body 200A2, and the head main body 200B2.

The second connection flow path 214 is the flow path which extends to the holder member 210 along the third direction Z. In the embodiment, as the second connection flow path 214, two flow paths which are a second connection flow path 214A, and a second connection flow path 214B are provided in the holder member 210 with respect to the flow path member 240 on the X1 side, the head main body 200A1, and the head main body 200B1. In the same way, as the second connection flow path 214, two flow paths which are the second connection flow path 214A and the second connection flow path 214B are provided in the holder member 210 with respect to the flow path member 240 on the X2 side, the head main body 200A2, and the head main body 200B2.

The second connection flow path 214A communicates with the first supply path 313 of the flow path member 240 (that is, the first supply path 313 on the X2 side of the two flow paths), and the introduction port 44 on the Y1 side of the head main body 200A1 which is disposed on the X1 side of the first head main body group 202A. The second connection flow path 214B communicates with the second supply path 323 of the flow path member 240 (that is, the second supply path 323 on the X1 side of two supply paths), and the introduction port 44 on the Y2 side of the head main body 200B1 which is disposed on the X1 side of the second head main body group 202B. Additionally, the same is true for the second connection flow path which connects the flow path member 240 on the X2 side, the head main body 200A2, and the head main body 200B2.

In addition, a projecting portion 217 which protrudes to the Z1 side in the third direction Z is provided on the bottom surface of the head holding unit 211, and the openings on the Z1 side of the second connection flow paths 214A and 214B open to a top surface of the projecting portion 217. The opening on the Z2 side of the second connection flow path 214A opens to the position facing a first supply path 313 (described later) (that is, the first supply path 313 on the X2 side of two flow paths) of the flow path member 240. The opening on the Z2 side of the second connection flow path 214B opens to the position facing the second supply path 323 (described later) (that is, the second supply path 323 on the X1 side of two flow paths) of the flow path member 240. Note that, the same is true for the first connection flow path which connects to the flow path member 240 on the X2 side, the head main body 200A2, and the head main body 200B2.

Further, a first wiring insertion hole 212 which opens to the bottom surface of the head holding unit 211 is provided in the holder member 210. The first wiring insertion hole 212 is a wiring insertion hole which is formed as a member for the holder described in claims. The first wiring insertion hole 212 passes through the head holding unit 211 and the holder member 210 on the Z2 side.

The above-described head holding unit 211 accommodates the second correcting plate 280. The second correcting plate 280 is formed of a plate member which is fixed to the surface on the Z1 side of the holder member 210, and is disposed in such a manner that the direction including the first direction X and the second direction Y is a surface direction, that is, a surface direction of the liquid ejecting surface 20*a*. In the embodiment, the second correcting plate 280 is formed into a shape into which the head holding unit 211 can be accommodated. Specifically, the second correcting plate 280 is formed by cutting out the region facing the first accommodation unit 215 and the second accommodation unit 216 among the substantially rectangular plate members.

In addition, in a plan view with respect to the liquid ejecting surface 20*a*, the second correcting plate 280 has a large enough size to cover the liquid ejecting surface 20*a* of the entire head main body 200, that is, the nozzle plate 20. The above-described second correcting plate 280 is accommodated in the head holding unit 211 and bonded by, for example, the adhesive. Of course, regardless of the adhesive, the head holding unit 211 may be fixed to the holder member 210 by a fixing unit, for example, a screw or the like, and may be fixed to the holder member by being interposed between the holder member 210 and another member (the head main body 200 or the like).

The second wiring insertion hole 282 communicating with the first wiring insertion hole 212 which is provided in the holder member 210 is formed on the second correcting plate 280. The first wiring insertion hole 212 and the second wiring insertion hole 282 communicate with each other so as to form one communication hole. The wiring substrate 121 of the head main body 200 which is held in the head holding unit 211 is led to the holder member 210 on the Z2 side via the first wiring insertion hole 212 and the second wiring insertion hole 282, and then the led end portion of the wiring substrate 121 is connected to the circuit board 220.

In addition, an opening 281 which passes through in the third direction Z is provided on the second correcting plate 280. The opening 281 is formed into a shape into which the projecting portion 217 provided in the holder member 210 is inserted. The projecting portion 217 which is inserted into the opening 281 is bonded to the case member 40 of the head main body 200, and the first connection flow path 213 and the second connection flow path 214 which open to the top surface of the projecting portion 217 communicate with the introduction port 44 of the head main body 200.

As described above, the second connection flow path 214 is provided so as to linearly extend in the holder member 210 along the third direction Z. In addition, the opening 281 which passes through in the third direction Z is provided on the second correcting plate 280. The projecting portion 217 to which the second connection flow path 214 opens is inserted into the opening 281 along the third direction Z, and therefore, it is possible to cause the second connection flow path 214 to be inserted into the introduction port 44 of the head main body. According to the above configuration, since the opening 281 of the second correcting plate may be formed as the through hole along the third direction Z, the processing of the second correcting plate 280 is easily performed. That is, it is not necessary to be provided inclined with respect to the third direction Z unlike the second connection flow path 214.

The second correcting plate 280 is formed of a material having the higher rigidity than that of the holder member 210, for example, a metallic plate and is bonded to the holder member 210, and thereby twisting or the strain in a plane surface of the holder member 210 in the first direction X and the second direction Y is corrected. That is, although the twisting or the strain are generated when manufacturing or heating the holder member 210, it is possible to maintain a state where the twisting or the strain in the holder member 210 is corrected by bonding the second correcting plate 280 to the holder member 210 in the state where the twisting or the strain in the holder member 210 is corrected. In this way, the flatness of the Z1 side surface onto which the head main body 200 of the holder member 210 is bonded is improved, and thus it is possible to prevent the position in which the ink lands onto the recording sheet S from being shifted.

In addition, the second correcting plate 280 as described above has a large enough size to cover the nozzle plate 20 which is the liquid ejecting surface 20*a* of the entire head main body 200, and is bonded to the holder member 210. That is, since the second correcting plate 280 is bonded to the holder member 210 which holds the entire head main body 200, it is possible to reliably correct the twisting or the strain which is generated at the time of manufacturing. Further, it is possible to improve the rigidity of the recording head 2 by using the second correcting plate 280.

As illustrated in FIG. 3, FIG. 5, FIG. 6 and FIG. 8, the fixing plate 260 covering the opening of the head holding unit 211 is provided on the surface on the Z1 side of the holder member 210 which holds the second correcting plate 280 and the head main body 200 in the head holding unit 211.

The fixing plate 260 is a member to which the head main body 200 is fixed. In the embodiment, the fixing plate 260 is formed by bending a flat plate member, and is provided with a nozzle surface forming portion 263 which is provided on the liquid ejecting surface 20*a*, and a bent portion 261 which is formed by bending a portion of outer edge of the nozzle surface forming portion 263 to the Z2 side in the third direction Z.

In addition, a second exposure opening portion 262 which exposes the liquid ejecting surface 20*a* of the head main body 200 is formed in the nozzle surface forming portion 263 of the fixing plate 260. Four second exposure opening portions 262 are formed so as to independently expose the liquid ejecting surface 20*a* of each head main body 200.

The above-described fixing plate 260 is bonded to the Z1 side in the third direction Z which is the side opposite to the communication plate 15 of the compliance substrate 45 in the head main body 200. Meanwhile, the fixing plate 260 seals the compliance portion 49 and prevents the ink from attaching to the compliance portion 49.

Then, a part facing the holder member 210 among the nozzle surface forming portions 263 of the fixing plate 260, and the bent portion 261 are fixed to the holder member 210 by using the fixing unit such as the adhesive or the screw. That is, the plurality of head main bodies 200 is accommodated in the head holding unit 211 of the holder member 210 in a state of being fixed to the fixing plate 260.

In addition, in the head main body 200 which is fixed to the fixing plate 260, the surface on the Z2 side of the case member 40 is boded to the surface on the Z1 side of the second correcting plate 280 by using the adhesive. Note that, the above-described adhesive also functions as a seal which prevents the ink from leaking from the boundary between the introduction port 44 of the case member 40, and the first connection flow path 213 and the second connection flow path 214 which communicate with the introduction port 44.

Meanwhile, the head main body 200 is not necessarily bonded to the second correcting plate 280. The head main body 200 and the second correcting plate 280 may be apart from each other.

As described in the embodiment, when the head main body 200 and the second correcting plate 280 are bonded to each other, components disposed between the holder member 210 and the fixing plate 260 become two kinds of the head main body 200 and the second correcting plate 280. Accordingly, it is necessary that a size tolerance of the depth of the head holding unit 211 in which the components are accommodated in the third direction Z is designed by considering two kinds of the head main body 200 and the second correcting plate 280.

On the other hand, as the configuration that the head main body 200 and the second correcting plate 280 are apart from each other, for example, there is a configuration that in the head main body 200, the surface on the Z1 is bonded to the surface on the Z2 side of the holder member 210, and the liquid ejecting surface 20*a* is bonded to the fixing plate 260 in a state where the introduction port 44 communicates the first connection flow path 213 and the second connection flow path 214. In addition, the second correcting plate 280 is bonded to only the surface on the Z1 side of the holder member 210, but is not bonded to the head main body 200.

In the above-described configuration of the recording head 2, the component disposed between the holder member 210 and the fixing plate 260 is only the head main body 200 in effect. Therefore, the size tolerance of the depth of the head holding unit 211 in the third direction Z may by designed by considering one kind of the head main body 200. As described above, it is possible to make the size tolerance small in the third direction Z by as much as the decreased second correcting plate 280 as a component which directly contact between the holder member 210 and the fixing plate 260, and thus the miniaturization of the recording head 2 can be realized in the third direction Z.

On the other hand, the circuit board 220, the first correcting plate 230, the flow path member 240, and the cover member 250 are fixed to the surface on the Z2 side of the holder member 210 in the third direction Z.

As illustrated in FIG. 4, FIG. 9 to FIG. 13, the circuit board 220 is provided with a substrate 225 along the third direction Z which is the direction perpendicular to the liquid ejecting surface 20*a*, and a connection portion 226 which is electrically connected to the wiring substrate 121 and is provided on both surfaces of the substrate 225. The circuit board 220 is fixed in state of being erected with respect to the surface on the Z2 side of the holder member 210. That is, the circuit board 220 is fixed to the surface on the Z2 side of the holder member 210 in a state where the direction including the first direction X and the third direction Z is a surface direction. The position to which the circuit board 220 is fixed is substantially at the center of the holder member 210 in the second direction Y, and is provided so as to correspond to the position between two rows of the head main body groups 202. That is, the head main body groups 202 are respectively disposed by interposing the circuit board 220 therebetween.

In addition, each of the wiring substrates 121 having the flexibility, which is led from each of the head main bodies 200 is connected to the circuit board 220. In the embodiment, the wiring substrate 121 of the head main body 200 which configures the first head main body group 202A provided on the circuit board 220 on the Y1 side in the second direction Y is connected to a first surface 222 of the circuit board 220 on the Y1 side. Similarly, the wiring substrate 121 of the head main body 200 which configures the second head main body group 202B provided on the circuit board 220 on the Y2 side in the second direction Y is connected to a second surface 223 of the circuit board 220 on the Y2 side. That is, the wiring substrate 121 of the head main body 200 does not disposed across the circuit board 220 in the second direction Y, but is connected to both surfaces of circuit board 220.

Further, in the embodiment, as illustrated in FIG. 10, a region L1 to which the wiring substrate 121 led from the head main body 200 of the first head main body group 202A is connected, and a region L2 to which the wiring substrate 121 led from the head main body 200 of the second head main body group 202B is connected are disposed in such a manner as to overlap with each other in at least a portion in the second direction Y. As described above, the connection between the circuit board 220 and the wiring substrate 121 is performed on both surface of a first surface 222 and a second surface 223 of the circuit board 220, and thus even though a portion of the head main body 200 in the second direction Y overlaps, and the region L1 and the region L2 which are respectively connected to the circuit board 220 of the wiring substrate 121 overlap with each other in a portion in the second direction Y, it is possible to easily connect the wiring substrate 121 and the circuit board 220 of the head main body 200.

In contrast, for example, in a case where only one side surface of the circuit board 220 is connected to the wiring substrate 121 of the entire head main body 200, the wiring substrates 121 are interfered with each other. For this reason, in order to prevent the connection portions of the wiring substrate 121 from interfering each other, the wiring substrate 121 is required to change the position of the portion which is connected to the circuit board 220 is to the different position in the third direction Z, and thus the circuit board 220 becomes larger in the third direction Z. In the embodiment, in order to connect the wiring substrate 121 to the both surfaces of the circuit board 220, it is possible to miniaturize the circuit board 220 in the third direction Z.

Meanwhile, the reason for that the region L1 to which the wiring substrate 121 led from the head main body 200 of the first head main body group 202A is connected, and the region L2 to which the wiring substrate 121 led from the head main body 200 of the second head main body group 202B is connected are disposed so as to overlap with each other in at least a portion in the second direction Y is that the wide wiring substrate 121 is used as the width in the first direction X. That is, in a case where the narrow wiring substrate 121 is used as the width in the first direction X, portions in which the wiring substrate 121 is connected to the circuit board 220 do not overlap with each other in the second direction Y.

Here, regarding the head main body 200, recently, multi-nozzles (including a large number of nozzle openings) and high density of nozzles (the nozzle openings disposed at the high density) have been required, and thus the miniaturization has been realized in accordance with high density of the nozzle opening and the number of wirings has been increased in accordance with. Accordingly, it is difficult to make the width of the wiring substrate 121 narrow in the first direction X, and in effect, the width of the wiring substrate 121 in the first direction X is substantially the same as the width of the head main body 200 in the first direction X.

In addition, since the wiring substrate 121 which is connected to the first surface 222 and the wiring substrate 121 which is connected to the second surface 223 can be disposed so as to overlap with each other, it is possible to freely design an amount for overlapping the head main bodies 200 which are adjacent to each other in the first direction X with each other in the second direction Y. Accordingly, it is possible to increase the number of nozzle openings 21 disposed at the position, in the second direction Y, corresponding to the position of the head main bodies 200 which are adjacent to each other in the first direction X, and it is possible to decrease degradation of printing quality of joints of the head main body 200 in the first direction X.

Meanwhile, as illustrated in FIG. 12 and FIG. 13, the regions L1 and L2 in which the wiring substrate 121 is connected to the circuit board 220 are provided on the side opposite to the liquid ejecting surface 20*a* in the third direction Z, rather than the surface connected to a flow path 300 of the flow path member 240 of the holder member 210. With this configuration, when connecting the wiring substrate 121 and the circuit board 220 by using a heating tool, it is possible to easily and reliably connect the wiring substrate 121 and the circuit board 220 without any interference of a portion to which the flow path 300 of the holder member 210 is connected.

In addition, since the circuit board 220 is erected perpendicular with respect to the liquid ejecting surface 20*a*, in the surface direction of the liquid ejecting surface 20*a*, it is possible to make the region which is occupied by the circuit board 220 small. For this reason, it is possible to realize the miniaturization of the recording head 2 in the surface direction of the liquid ejecting surface 20*a*.

In addition, in the third direction Z, the circuit board 220 is provided with a connector 221, which is an example of electronic components, on the side opposite to the holder member 210, that is, on the Z2 side of the end portion. In the embodiment, the circuit board 220 is provided between two flow path members 240 so as to extend to the Z2 side, and the connectors 221 of the circuit board 220 are respectively provided on the surfaces of the end portions of the circuit board 220 on the Y1 side surface and the Y2 side surface. The above-described connector 221 is connected to a control unit via an external wiring (not shown). With this, the signal from the control unit is transmitted to the circuit board 220 via the connector 221, and then the signal is transmitted to the head main body 200 from the circuit board 220 via the wiring substrate 121. Meanwhile, the cover member 250 is provided with a connector exposing hole 251, for exposing the connector 221 to the outside, in a region corresponding to the connector 221, and the external wiring is connected to the connector 221 exposed by the connector exposing hole 251.

As illustrated in FIG. 10 to FIG. 13, the first correcting plate 230 is formed into a planar shape, and a member for correcting the holder member 210. Specifically, the first correcting plate 230 is provided with a correcting main body portion 231 having a plane surface in the first direction X and the third direction Z, an opening portion 233 which is provided on the correcting main body portion 231 and into which the wiring substrate 121 is inserted, and a leg portion 232 which is provided on both surface of the opening portion 233 in the first direction X.

The above-described first correcting plate 230 is fixed to the surface on the Z2 side of the holder member 210, and is disposed so as to face each of the both surfaces of the circuit board 220. In the embodiment, a pair of the first correcting plates 230 is fixed to the surface on the Z2 side of the holder member 210 by interposing the circuit board 220 therebetween. Note that, the first correcting plate 230 may be two or more pairs.

In addition, as illustrated in FIG. 11, the first correcting plate 230 is disposed across the connection portion 226 of the circuit board 220 in the third direction Z which is the direction perpendicular to the liquid ejecting surface 20*a*. Here, "the first correcting plate 230 is disposed across the connection portion 226" means a state where, in a plan view of the circuit board 220, the positions of the correcting main body portion 231 and the leg portion 232 in the third direction Z overlap with at least a portion of the position of the connection portion 226 in the third direction Z. In other words, a straight line along the third direction Z passes through at least a portion of the correcting main body portion 231 and the leg portion 232, and a portion of the connection portion 226. In the embodiment, correcting main body portion 231 is provided over the entire width of the connection portion 226 in the first direction X, and overlaps with a portion of the connection portion 226 in the third direction Z. A range that the above-described correcting main body portion 231 is disposed across of the connection portion 226 corresponds to the entire width of the connection portion 226 in the first direction X, and thus it is possible to more reliably correct the holder member 210. Note that, the correcting main body portion 231 may be not necessarily disposed across the connection portion 226 of the circuit board 220.

In addition, if the opening portion 233 is provided in the correcting main body portion 231, it is possible to realize the miniaturization of the recording head 2 in the third direction Z as compared with a case of using the first correcting plate 230 which does not include the opening portion 233.

Incidentally, when using the first correcting plate which does not include the opening portion 233, the wiring substrate 121 is necessary to be detoured over a top portion on the Z2 side of the first correcting plate 230 in the third direction Z so as to be bonded to the connection portion 226 of the circuit board 220. That is, the connection portion 226 of the circuit board 220 is necessary to be disposed closer to the Z2 side than the first correcting plate 230 in the third direction Z, and the size of the circuit board 220 becomes larger in the third direction Z.

In the embodiment, since the correcting main body portion 231 is disposed across the connection portion 226, the wiring substrate 121 can be connected to the connection portion 226 via the opening portion 233. That is, since the connection portion 226 can be formed so as to overlap with the correcting main body portion 231 in at least a portion, it is possible to make the size of the circuit board 220 small in the third direction Z. With this, it is possible to realize the miniaturization of the recording head 2 in the third direction Z.

The above-described first correcting plate 230 has an area smaller than the circuit board 220, and disposed on the sides of both surfaces of the circuit board 220 with an interval between the first correcting plate 230 and the circuit board 220. In addition, the first correcting plate 230 includes the opening portion 233 which is capable of inserting into the wiring substrate 121 at the position facing the connection portion 226 connecting the circuit board 220 and the wiring substrate 121 in the second direction Y. The opening portion 233 is formed by being cut into a concavity in a range from the end portion, on the Z1 side, which is fixed to the holder member 210 of the first correcting plate 230 to the middle of the Z2 side. Meanwhile, in the embodiment, the first correcting plate 230 has a length shorter than that of the holder member 210 in the first direction X, and two first correcting plates 230 are respectively disposed at the end portions of the holder member 210 on the X1 side and the X2 side in the first direction X. Specifically, the first correcting plate 230 which is provided closer to the Y1 side than the circuit board 220 is provided at the end portion of the holder member 210 on the X1 side, and has the length which is not sufficient to reach the wiring substrate 121 on the X2 side of the head main body 200A2. That is, only one opening portion 233 which inserts into the wiring substrate 121 of the head main body 200A1 is provided on the first correcting plate 230 on the Y1 side, and the wiring substrate 121 of the head main body 200A2 on the X2 side is connected to the circuit board 220 on the X2 side which is the external side of the first correcting plate 230. In addition, the first correcting plate 230 which is provided on the Y2 side is provided at the end portion of the holder member 210 on the X2 side, and the length which is not sufficient to reach the head main body 200B1 on the X1 side. That is, only one opening portion 233 which inserts into the wiring substrate 121 of the head main body 200B2 is provided on the Y2 side of the first correcting plate 230, and the wiring substrate 121 of the head main body 200A1 on the X1 side is connected to the circuit board 220 on the X1 side which is the external side of the first correcting plate 230. The above-described first correcting plates 230 which are provided on the Y1 side and the Y2 side are provided to face each other in a portion in the middle of the holder member 210 in the second direction Y. That is, two first correcting plates 230 are provided over the almost entire holder member 210 in the first direction X in such a manner as to overlap with each other in the second direction Y.

The first correcting plate 230 is formed of a material having the rigidity higher than that of the holder member 210, for example, a metallic plate and is bonded to the holder member 210, and thereby correcting the warpage generated in the holder member 210 in the third direction Z. That is, although the warpage which is generated when manufacturing or heating the holder member 210, it is possible to maintain a state where the warpage of the holder member 210 is corrected by bonding the first correcting plate 230 to the holder member 210 in the state where warpage of the holder member 210 is corrected. In this way, the flatness of the surface of the Z1 side onto which the head main body 200 of the holder member 210 is bonded is improved, and thus it is possible to prevent the position in which the ink lands onto the recording sheet S from being shifted. Therefore, a recording head 2 having improved ejecting quality can be obtained.

In addition, the first correcting plate 230 is disposed on both surface of the circuit board 220 so as to face the circuit board 220. For this reason, the first correcting plate 230 is contributed to correct the twisting or the strain which is generated when manufacturing the holder member 210 and enhance the rigidity of the recording head 2 as well.

A manufacturing method of the recording head 2 which is capable of correcting the warpage of the holder member 210 includes the steps of mounting, with respect to the holder member 210 to which the fixing plate 260 is not fixed, the surface on the Z1 side in the third direction Z, which is the surface onto which the fixing plate 260 of the holder member 210 is fixed on a unchangeable member, for example, a member capable of securing the flatness, and then fixing the first correcting plate 230 onto the holder member 210 by being pressed to the holder member 210 side. Therefore, it is possible to correct the warpage generated by forming the holder member.

Meanwhile, a piece of the first correcting plate 230 does not have the length sufficient for the entire holder member 210 in the first direction X, two pieces of first correcting plates 230 are disposed in the first direction X so as to be shifted to each other, then the two pieces of the first correcting plates 230 overlap with each other in the second direction Y, and thus can be formed to cover almost the entire holder member 210 in the first direction X, thereby efficiently correcting the warpage of the holder member 210. Incidentally, it may be considered that the length of one piece of the first correcting plate 230 is formed to cover substantially the entire holder member 210 in the first direction X, but it is necessary that two opening portions 233 into which the wiring substrate 121 is inserted is formed on the first correcting plate 230, and a spare region for forming the opening portion 233, and thus the size of the holder member 210 is increased in the first direction X. In the embodiment, when providing each opening portion 233 on two first correcting plates 230, the spare region for the first correcting plate 230 is not necessary, and thus it is possible to realize the miniaturization of the holder member 210 in the first direction X.

In addition, as illustrated in FIG. 10, the circuit board 220 includes a connector 221 as an example of the electronic component as described above. The width which is the direction in which a pair of the first correcting plates 230 face each other, that is, a dimension of the connector 221 in the second direction Y is referred to as W1. In addition, in the second direction Y, an interval between the circuit board 220 and the first correcting plate 230 is referred to as W2.

The width W1 of the connector 221 is greater than the interval W2 between the circuit board 220 and the first correcting plate 230. Then, as illustrated in FIG. 11, the connector 221 is disposed at a position of the circuit board 220, in which the first correcting plates 230 do not face each other. That is, in a plan view with respect to the circuit board 220, the connector 221 is disposed at a position of the circuit board 220, which does not overlap with the first correcting plate 230. In the embodiment, in the third direction Z, the connector 221 is disposed closer to the Z2 side than the first correcting plate 230.

As described above, even in a case where the width W1 of the connector 221 is greater than the interval W2, if the connector 221 is disposed on the Z2 side from the first correcting plate 230, it is possible to dispose the first correcting plate 230 in the vicinity of the circuit board 220 so as to be the interval W2 smaller than the width W1. In other words, it is not necessary that the first correcting plate 230 is apart from the circuit board 220 equal to or greater than the width W1 in the second direction Y so as not to interfere with the connector 221. Accordingly, it is possible to realize the miniaturization of the recording head 2 in the second direction Y.

Meanwhile, as an example of the electronic component, other than the above-described connector 221, for example, there are a capacitor, a transistor, and an integrated circuit. In addition, the dimension of the connector 221, and the interval between the circuit board 220 and the first correcting plate 230 are not limited to the above description.

As described above, the circuit board 220 and the first correcting plate 230 are fixed onto the surface on the Z2 side of the holder member 210 in a state of being erected. Specifically, as illustrated in FIG. 4 and FIG. 12, on the surface on the Z2 side of the holder member 210, a circuit board fixing portion 275, as a concavity into which the circuit board 220 is inserted, and a correcting plate fixing portion 276, as the concavity into which the first correcting plate 230 is inserted.

The circuit board fixing portion 275 is formed to be long along in the first direction X, and the width thereof is substantially the same as the width of the circuit board 220 in the first direction X. In addition, the circuit board fixing portion 275 is positioned substantially at the center of the holder member 210 in the second direction Y.

The end portion on the Z1 side of the circuit board fixing portion 275 in the third direction Z is inserted into the circuit board fixing portion 275. If the circuit board 220 is inserted into the circuit board fixing portion 275, the circuit board 220 is fixed to the holder member 210 in a state of being erected in the third direction Z.

The correcting plate fixing portion 276 is formed to be long along in the first direction X, and the width thereof is substantially the same as the width of the leg portion 232 of the first correcting plate 230 in the first direction X. In the embodiment, since there are two leg portions 232 of the first correcting plate 230, two correcting plate fixing portions 276 are disposed on each first correcting plate 230 in the first direction X. Then, the two correcting plate fixing portions 276 which are provided in parallel with the first direction X are provided on both sides in the second direction Y by interposing the circuit board fixing portion 275 between the sides.

The end portion on the Z1 side of the leg portion 232 in the third direction Z is inserted into the correcting plate fixing portion 276. If the leg portion 232 is inserted into the correcting plate fixing portion 276, the first correcting plate 230 is fixed to the holder member 210 in a state of being erected in the third direction Z. Meanwhile, the depth of the correcting plate fixing portion 276 set in such a manner that the opening portion 233 opens to the surface on the Z2 side of the holder member 210, and the wiring substrate 121 can be inserted into the opening portion 233 in a state where the leg portion 232 is inserted into the correcting plate fixing portion 276.

Then, the first correcting plate 230 and the circuit board 220 are fixed to the holder member 210 so as to be along the first connection flow path 213 which is inclined with respect to the third direction Z.

That is, as illustrated in FIG. 12, in a plan view including the second direction Y, which is the direction to which the first connection flow path 213 is provided to be extended, and the third direction Z, the distance between the first connection flow path 213 and the surface on the Z1 side of the holder member 210 becomes longer as the first connection flow path 213 is close to the center from the outside in the second direction Y. On the other hand, the circuit board 220 which is positioned closer to the center portion than the first correcting plate 230 in the second direction Y is deeply inserted into the circuit board fixing portion 275 of the holder member 210 to the Z1 side from the first correcting plate 230.

If the first connection flow path 213 which is inclined as described above is provided in the holder member 210, at the center portion in the second direction Y, it is possible to make a region in which the circuit board fixing portion 275 can be formed larger than the correcting plate fixing portion 276. In other words, it is possible to easily form the circuit board fixing portion 275 without interfering with the first connection flow path 213.

Accordingly, the circuit board fixing portion 275 can be formed deeper than the correcting plate fixing portion 276, and the circuit board 220 can be deeply inserted into the circuit board fixing portion 275. For this reason, the connection portion 226 of the circuit board 220 can be close to the Z1 side, and it is possible to make the wiring substrate 121 which is connected to the connection portion 226 short. Particularly, in a case where the wiring substrate 121 is formed to be flexible, it costs a lot; however, since the wiring substrate 121 can be shortened, it is possible to reduce the cost relating to the wiring substrate 121. Of course, the first correcting plate 230 and the circuit board 220 may not formed in the holder member 210 along the first connection flow path 213.

As illustrated in FIG. 9, FIG. 11 to FIG. 13, the flow path member 240 functions of supplying the ink which is introduced from the liquid storage unit 4 to the head main body 200, and the flow path 300 which is an example of the second flow path is provided inside the flow path member 240.

Each of the flow path members 240 of the embodiment is provided with respect to two head main bodies 200 which are close to each other in the second direction Y. That is, there are two flow path members 240 are provided, for example, the flow path member 240 which are common to the head main body 200 of the first head main body group 202A on the X1 side and the head main body 200 of the second head main body group 202B on the X1 side, and the flow path member 240 which are common to the head main body 200 of the first head main body group 202A on the X2 side and the head main body 200 of the second head main body group 202B on the X2 side.

The flow path member 240 is disposed on the sides of both surfaces of the circuit board 220 across the circuit board 220 in the second direction Y. In the embodiment, the flow path member 240 is continuously provided in the second direction Y across the circuit board 220 and two of the first correcting plates 230. Specifically, the flow path member 240 includes the width substantially same as the width of the holder member 210 in the second direction Y, and the concavity 241 which opens to the Z1 side surface is formed at the center portion the flow path member 240 in the second direction Y. The concavity 241 has the width into which the circuit board 220 and the two first correcting plates 230 can be inserted, and is formed deeper than the height from the surface of on the Z2 side of the holder member 210 to the end portion (except for a part in which the connector 221 is provided) on the Z2 side of the circuit board 220, in the third direction Z. With this, when the circuit board 220 and the two first correcting plates 230 are inserted into the concavity 241 of the flow path member 240, it is possible to fix the flow path member 240 onto the surface on the Z2 side of the holder member 210 on both sides of the circuit board 220 and the two first correcting plates 230.

The flow path 300 is provided inside the flow path member 240. The flow path 300 is provided with an introduction path 301 which is connected to the supply pipe 8 (refer to FIG. 1), a first liquid flow path 310 which is provided on the circuit board 220 on the Y1 side in such a manner as to be branched to two from the introduction path 301, and a second liquid flow path 320 which is provided on the circuit board 220 on the Y2 side.

The introduction path 301 is provided to open to a tip end of a feeding needle 242 which is provided by protruding from the surface on the Z2 side of the flow path member 240 in the third direction Z. The feeding needle 242 is a portion which formed into a needle shape extending to the direction intersecting with the liquid ejecting surface 20*a*. In the embodiment, the feeding needle 242 extends to the third direction Z which is orthogonal to the liquid ejecting surface 20*a*. As described above, if the feeding needle 242 is provided so as to intersect with the liquid ejecting surface 20*a*, it is possible to make a dimension of the liquid ejecting surface 20*a* in an in-plane direction. Here, the in-plane direction means either one of the first direction X including the liquid ejecting surface 20*a*, the second direction Y, and a certain direction obtained by combining the first direction X and the second direction Y.

The cover member 250 is provided with an exposing portion 290 which exposes the feeding needle 242 to the outside of the cover member 250. When the supply pipe 8 is connected to the feeding needle 242 exposed by the above-described exposing portion 290, the supply pipe 8 and the introduction path 301 communicate with each other. Meanwhile, the detailed description of the exposing portion 290 will be made later.

The first liquid flow path 310 and the second liquid flow path 320 are provided by respectively communicating with each of two introduction ports 44 which is provided in the head main body 200. Specifically, the first liquid flow path 310 is provided with a first communicating path 311 which communicates with the introduction path 301, a first liquid storage portion 312 which communicates with the first communicating path 311, and two first supply paths 313 which communicate with the first liquid storage portion 312.

A portion of the first communicating path 311 and the first liquid storage portion 312 are the side surfaces of the flow path member 240, that is, the surfaces on the side opposite to the circuit board 220, and are provided in a concave portion which is provided so as to open to the Y1 side surface. The concave portion is surrounded by an outer wall portion 245, and an opening portion part of the first liquid storage portion 312 is sealed by welding the film 243 which is the fixing member to the outer wall portion 245.

In addition, although specifically described later, the first liquid storage portion 312 is provided with two filters 244 which remove foreign matters such as dust or the air bubbles in parallel with the first direction X, and the ink flowing into the first liquid storage portion 312 from the first communicating path 311 is supplied to two first supply paths 313 from the first liquid storage portion 312 via the two filters 244. That is, the first liquid storage portion 312 is a filter chamber for accommodating the filter 244, and the upstream side thereof is referred to as an upstream filter chamber 3121, and the downstream side thereof is referred to as a downstream filter chamber 3122.

Regarding the flow path member 240 on the X1 side in the first direction X of the two flow path members 240, the first liquid storage portion 312 extends to the first direction X across the head main body 200A1 on the X1 side of the first head main body group 202A which is provided in parallel with the first direction X and the head main body 200B1 on the X1 side of the second head main body group 202B. Then, two first supply paths 313 are provided in parallel with the first direction X, and the two first supply paths 313 open to the surface on the Z1 side of the flow path member 240. Here, the two first supply paths are respectively referred to as a first supply path 313*a* and a first supply path 313*b*. The first supply path 313*a* is connected to the introduction port 44 on the Y2 side of the head main body 200A1 via the second connection flow path 214A. The first supply path 313*b* is connected to the introduction port 44 on the Y1 side of the head main body 200B1 via the first connection flow path 213B which is formed in the holder member 210.

The second liquid flow path 320 is provided with a second communicating path 321 which communicates with the introduction path 301, a second liquid storage portion 322 which communicates with the second communicating path 321, and two second supply paths 323 which communicate with the second liquid storage portion 322.

A portion of the second communicating path 321 and the second liquid storage portion 322 are the side surfaces of the flow path member 240, that is, the surfaces on the side opposite to the circuit board 220, and are provided in a concave portion which is provided so as to open to the surface on the Y2 side. The concave portion is surrounded by the outer wall portion 245, and an opening portion part of the second liquid storage portion 322 is sealed by welding the film 243 which is the fixing member to the outer wall portion 245.

In addition, although specifically described later, the second liquid storage portion 322 is provided with two filters 244 which remove foreign matters such as dust or the air bubbles in parallel with the first direction X, and the ink flowing into the second liquid storage portion 322 from the second communicating path 321 is supplied to two second supply paths 323 from the second liquid storage portion 322 via the two filters 244. That is, the second liquid storage portion 322 is a filter chamber for accommodating the filter 244, and the upstream side thereof is referred to as an upstream filter chamber 3221, and the downstream side thereof is referred to as a downstream filter chamber 3222.

Regarding the flow path member 240 on the X1 side in the first direction X of the two flow path members 240, the second liquid storage portion 322 extends to the first direction X across the head main body 200A1 on the X1 side of the first head main body group 202A which is provided in parallel with the first direction X and the head main body 200B1 on the X1 side of the second head main body group 202B. Then, two second supply paths 323 are provided in parallel with the first direction X, and the two second supply paths 323 open to the surface on the Z1 side of the flow path member 240. Here, the two first supply paths are respectively referred to as a second supply path 323*a* and a second supply path 323*b*. The second supply path 323*a* is connected to the introduction port 44 on the Y1 side of the head main body 200A1 via the first connection flow path 213A. The second supply path 323*b* is connected to the introduction port 44 on the Y2 side of the head main body 200B1 via the second connection flow path 214B which is formed in the holder member 210.

The flow path member 240 on the X2 side in the first direction X among the two flow path members 240 is configured in the same way. That is, the flow path member 240 is provided with a first supply path 313*a* which communicates with the introduction port 44 on the Y1 side of the head main body 200A2, a first supply path 313*b* which communicates with the introduction port 44 on the Y2 side of the head main body 200B2, a second supply path 323*a* which communicates with the introduction port 44 on the Y2 side of the head main body 200A2, and a second supply path 323*b* which communicates with the introduction port 44 on the Y2 side of the head main body 200B2.

The holder member 210 is provided with the first connection flow path 213 which is an example of the first flow path and the second connection flow path 214 with respect to one head main body 200. In the embodiment, since four head main bodies 200 are fixed to the holder member 210, a total of eight first connection flow paths 213 and second connection flow paths 214 are provided.

Specifically, the second connection flow path 214A, which communicates with the introduction port 44 on the Y1 side the head main body 200A1 on the X1 side of the first head main body group 202A, is provided so as to linearly extend to the third direction Z, and communicates with the first supply path 313*a* on the Y1 side of the circuit board 220. In addition, the first connection flow path 213A which communicates with the introduction port 44 on the Y2 side of the head main body 200A1 is provided so as to linearly extend to the direction inclined with respect to the third direction Z. The opening on the Z2 side which is an inlet for ink of the first connection flow path 213A is closer to the Y2 side in the second direction Y than the circuit board 220, and the opening on the Z1 side which is an outlet for ink is closer to the Y1 side in the second direction Y than the circuit board 220. That is, the first connection flow path 213A is provided by being inclined with respect to the circuit board 220 from the Y2 side which is connected to the second supply path 323*a* to the Y1 side of the circuit board 220 on which the head main body 200A1 is provided. For this reason, it is possible to easily connect the second supply path 323*a* which is provided on the Y2 side of the circuit board 220, and the introduction port 44 on the Y2 side of the head main body 200A1 which is provided on the Y1 side via the first connection flow path 213A. Meanwhile, the first connection flow path 213A of the embodiment is provided by being inclined with respect to the third direction Z, but the first connection flow path 213A is not particularly limited thereto. For example, the first connection flow path 213A may be formed of a vertical flow path which is provided in the third direction Z and a horizontal flow path which is provided in the second direction Y. Here, By providing the first connection flow path 213A which is inclined in the above-described embodiment, it is possible to form the holder member 210 by molding with one component. Therefore, it is possible to realize the cost reduction by decreasing the number of components compared with a case of providing the horizontal flow path or the like.

In the same way, the second connection flow path 214B which communicates with the introduction port 44 on the Y2 side the head main body 200B1 on the X1 side of the second head main body group 202B is provided so as to linearly extend to the third direction Z, and communicates with the second supply path 323 on the Y2 side of the circuit board 220. In addition, the first connection flow path 213B which communicates with the introduction port 44 on the Y1 side of the head main body 200B1 is provided so as to linearly extend to the direction inclined with respect to the third direction Z. The opening on the Z2 side which is an inlet for ink of the first connection flow path 213B is closer to the Y1 side in the second direction Y than the circuit board 220, and the opening on the Z1 side which is an outlet for ink is closer to the Y2 side in the second direction Y than the circuit board 220. That is, the first connection flow path 213B is provided by being inclined with respect to the circuit board 220 from the Y1 side which is connected to the first supply path 313*b* to the Y2 side of the circuit board 220 on which the head main body 200B1 is provided. For this reason, it is possible to easily connect the first supply path 313*b* which is provided on the Y1 side of the circuit board 220, and the introduction port 44 on the Y1 side of the head main body 200B1 which is provided on the Y2 side via the first connection flow path 213B. Meanwhile, the first connection flow path 213B of the embodiment is provided by being inclined with respect to the third direction Z, but the first connection flow path 213B is not particularly limited thereto. For example, the first connection flow path 213A may be formed of a vertical flow path which is provided in the third direction Z and a horizontal flow path which is provided in the second direction Y, similar to the first connection flow path 213A.

In addition, the configuration of the flow path member 240, in which the head main body 200A2 on the X2 side of the first head main body group 202A, and the head main body 200B2 on the X2 side of the second head main body group 202B are provided to correspond to each other, is the same as that of the above-described flow path member 240, and thus repeated description will be omitted.

As described above, in the first connection flow path 213 and the second connection flow path 214 which are connected to one head main body 200, the width of the part which is connected to the head main body 200 in the second direction Y which is the transporting direction is set to be smaller than the width of the part which is connected to the flow path 300. That is, it is possible to reduce the interval between two nozzle rows which are provided in parallel with the second direction Y, and thereby, it is less likely to generate the shift of the landing position of the ink ejected from the two nozzle rows.

Further, as illustrated in FIG. 11 and FIG. 12, in the embodiment, the two first connection flow paths 213 which are connected to the head main body 200A1 and the head main body 200B1 are disposed so as to intersect with each other when seen from in the first direction X. Accordingly, it is possible to realize the miniaturization by decreasing a space accommodating the two first connection flow paths 213 in the second direction Y. The same is true for two first connection flow paths 213 of a head main body A2 and a head main body B2.

As illustrated in FIG. 8, and FIG. 12 to FIG. 14A and FIG. 14B, the above-described holder member 210 is provided with the first accommodation unit 215, which is formed by being cutting into a concave shape, in an interval 203 between the head main bodies 200 which are provided in parallel with the first direction X, in each of the head main body groups 202. That is, the holder member 210 is provided with the first accommodation unit 215 corresponding to a first interval 203A of the first head main body group 202A, and a second interval 203B of the second head main body group 202B.

The first accommodation unit 215 is provided so as to open to the Z1 side surface of the holder member 210, and opens to one side surface in the second direction Y. That is, the first accommodation unit 215 which is provided in the first interval 203A of the first head main body group 202A on the Y1 side opens to the side surface on the Y1 side of the holder member 210. In addition, the first accommodation unit 215 which is provided in the second interval 203B of the second head main body group 202B on the Y2 side opens to the side surface on the Y2 side of the holder member 210. Meanwhile, in the embodiment, the head main body group 202 is formed of two head main bodies 200 and is provided with one interval 203, and thus the first accommodation unit 215 is provided for each head main body group 202. Of course, in a case where the head main body group 202 is formed of three or more of head main bodies 200, since the interval 203 is formed equal to or more than two, two or more first accommodation units 215 may be provided for each head main body group 202. As above-described first accommodation unit 215 is formed to have the depth which does not interfere with the first connection flow path 213. That is, if the first connection flow path 213 is provided by being inclined with respect to the third direction Z, it is possible to form the first accommodation unit 215 on the Z1 side of the first connection flow path 213. In contrast, when the first connection flow path 213 is provided so as to pass through the Z1 side of the holder member 210, it is not possible to provide the first accommodation unit 215. Of course, in a case where the first accommodation unit 215 interferes with the first connection flow path 213, a part protruding from the inside of the first connection flow path 213 may be provided in a portion of the first accommodation unit 215.

In addition, the holder member 210 is provided with an interval 204 between the end portion of the first head main body group 202A and the end portion of the second head main body group 202B in the first direction X, by disposing the first head main body group 202A and the second head main body group 202B to be shifted to each other in the first direction X. That is, the interval 204 is provided each of the X1 side of the first head main body group 202A and the X2 side of the second head main body group 202B. In the embodiment, the interval 204 which is provided on the X1 side of the first head main body group 202A is referred to as an interval 204A, and the interval 204 which is provided on the X2 side of the second head main body group 202B is referred to as an interval 204B.

In addition, each interval 204 is provided with a second accommodation unit 216 which is cut into the concave shape. The second accommodation unit 216 is provided so as to open to the Z1 side surface of the holder member 210, and opens to one side surface in the first direction X and one side surface in the second direction Y. That is, the second accommodation unit 216 which is provided in the interval 204A on the Y1 side is provided so as to open to the side surface on the Y1 side and the side surface on the X2 side of the holder member 210. In addition, the second accommodation unit 216 which is provided in the interval 204B on the Y2 side is provided so as to open to the side surface on the Y2 side and the side surface on the X1 side of the holder member 210. That is, the second accommodation unit 216 which is provided in the interval 204A faces the head main body 200B1 of the second head main body group 202B in the second direction Y, and the second accommodation unit 216 which is provided in the interval 204B faces the head main body 200A2 of the first head main body group 202A in the second direction Y.

In the embodiment, the above-described first accommodation unit 215 and the second accommodation unit 216 accommodate at least a portion of a roller 630 in the head of a roller unit 610.

In addition, the recording head 2 is, as illustrated in FIG. 2, mounted on the carriage 3 in such a manner that the liquid ejecting surface 20*a* side further protrudes to the recording sheet S side than the carriage 3.

As described above, the holder member 210 holds the plurality of head main bodies 200, the circuit board 220, and the flow path member 240 which supplies the ink to the head main body 200. The cover member 250 which accommodates the circuit board 220, the flow path member 240, and the like is provided on the Z2 side of the holder member 210.

Figure 16:
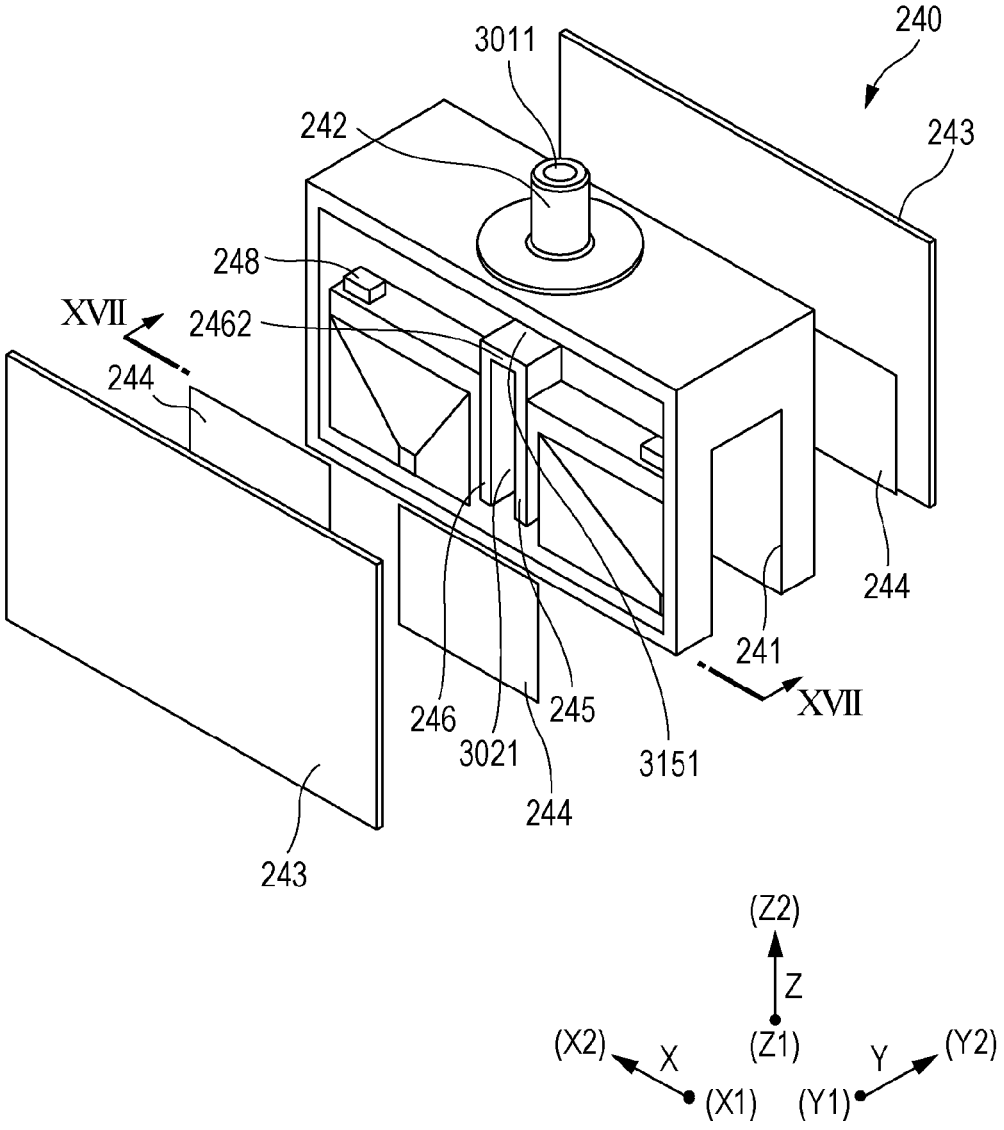
FIG. 16 is an exploded perspective view of the flow path member.
Figure 17:
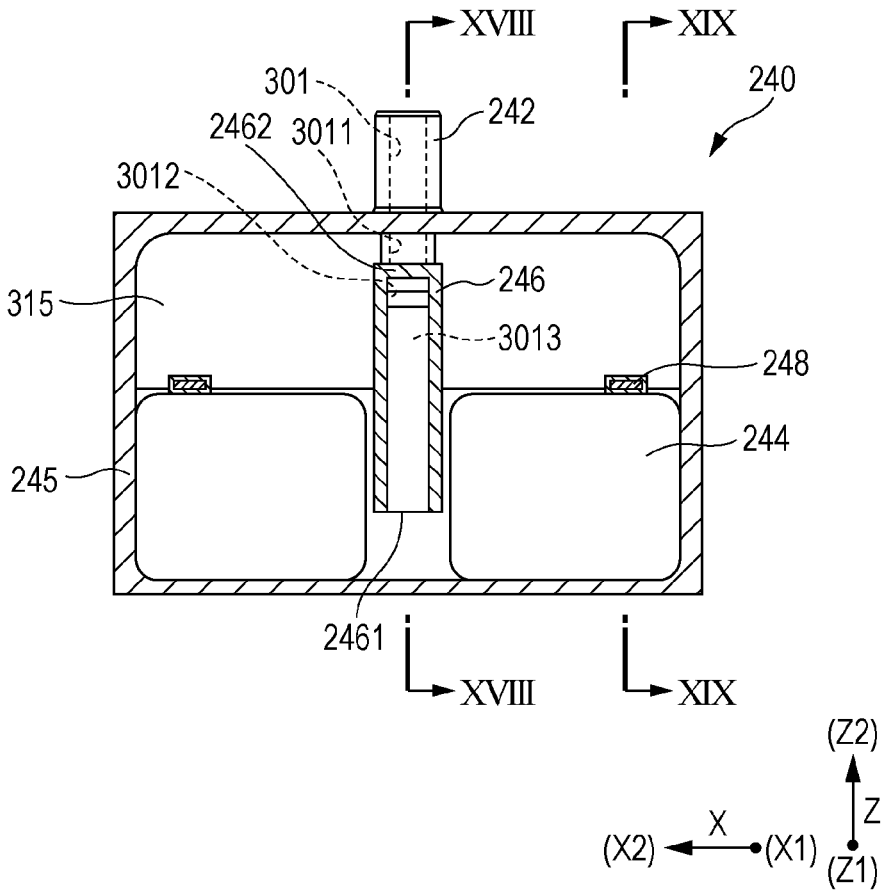
FIG. 17 is a cross-sectional diagram of FIG. 16, taken along line XVII-XVII.

Here, the flow path member 240 according to the embodiment will be more specifically described. FIG. 16 is an exploded perspective view of the flow path member 240, FIG. 17 is a cross-sectional diagram of FIG. 16, taken along line XVII-XVII in the second direction Y and the third direction Z, FIG. 18 is a cross-sectional diagram of FIG. 17, taken along line XVIII-XVIII in the second direction Y, and FIG. 19 is a cross-sectional diagram of FIG. 17, taken along line XVIIII-XVIIII in the second direction Y.

As illustrated in FIG. 16 to FIG. 19, the flow path member 240 has the width substantially the same as the width of the holder member 210 in the second direction Y, and the concavity 241 which opens to the surface on the Z1 side is provided in the center portion in the second direction Y. The concavity 241 has the width into which the circuit board 220 and the two first correcting plates 230 can be inserted, and is formed deeper than the height from the surface on the Z2 side of the holder member 210 to the end portion (except for a part in which the connector 221 is provided) on the Z2 side of the circuit board 220, in the third direction Z. With this, when the circuit board 220 and the two first correcting plates 230 are inserted into the concavity 241 of the flow path member 240, it is possible to fix the flow path member 240 onto the surface on the Z2 side of the holder member 210 on both sides of the circuit board 220 and the two first correcting plates 230.

Figure 18:
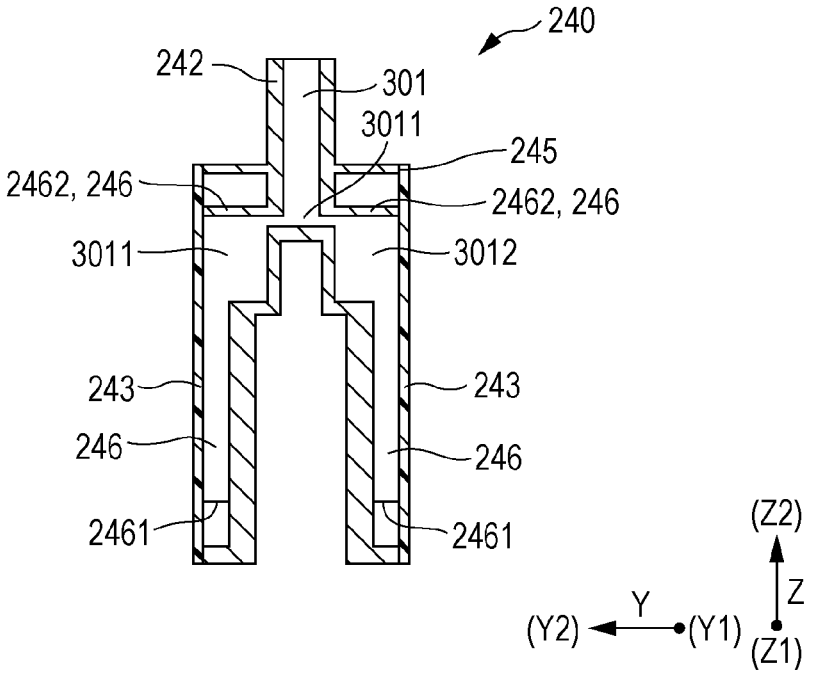
FIG. 18 is a cross-sectional diagram of FIG. 17, taken along line XVIII-XVIII.
Figure 19:
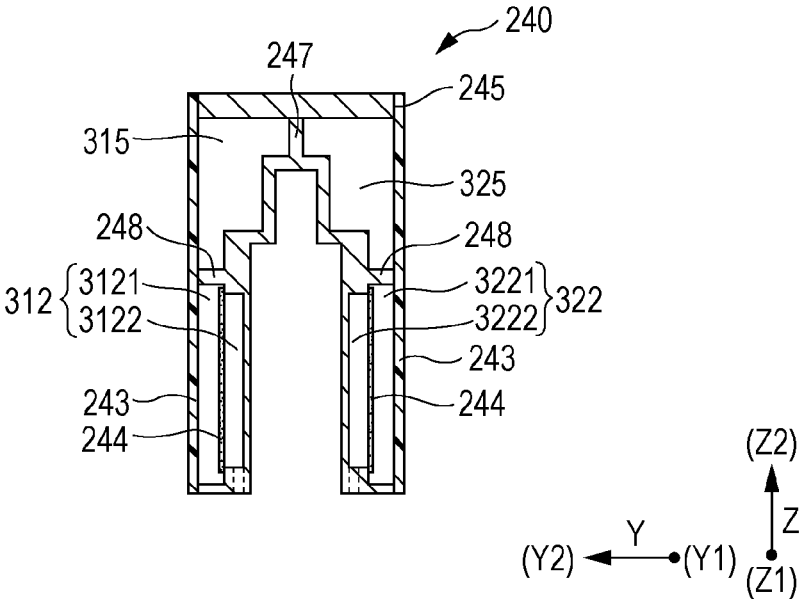
FIG. 19 is a cross-sectional diagram of FIG. 17, taken along line XVIIII-XVIIII.

The introduction path 301, which is provided to open to the tip end of the feeding needle 242 which is provided by protruding from the surface on the Z2 side of the flow path member 240 in the third direction Z, communicates with a branched flow path 3011 which is provided so as to extend in the right and left direction as illustrated in FIG. 18, and the branched flow path 3011 communicates with a communication flow path 3012. The above the branched flow path 3011 functions of branching the introduction path 301 to the Y1 side and the Y2 side in the second direction Y, and corresponds to a first branch point of the flow path member. The communication flow path 3012 is defined by a flow path wall portion 246. The flow path wall portion 246 is provided so as to extend from the position slightly separated from the outer wall portion 245 to the position on the way between two filters 244 in the vertical direction, and a film 243 which is a fixing member welded to the outer wall portion 245 is welded and sealed on the surface on the Y1 side and the Y2 side which is the side surface of the flow path member 240, that is, the surface on the side opposite to the circuit board 220. With this, the communication flow path 3012, of which the upstream side communicates only with the introduction path 301, communicates with the upstream filter chambers 3121 and 3221 of the first liquid storage portion 312 and the second liquid storage portion 322 via an outlet part 2461 on the downstream.

As described above, the flow path member 240 is provided with the first liquid storage portion 312 and the second liquid storage portion 322 which are the filter chambers, on both sides of the concavity in the thickness direction, that is, both sides in the second direction Y. According to this, since it is possible to dispose the filter chamber by efficiently using the space of both sides of the substrate, it is possible to further reduce the pressure loss in supplying a liquid to the downstream side.

In addition, in the embodiment, the branching is performed on the branched flow path 3011 which is provided on the inlet side of the flow path member 24 in the thickness direction, that is, in the second direction Y. However, the branching is not limited to the above-described flow path. For example, the branching may be performed on the flow path on the middle of the outlet part 2461 of the communication flow path 3012 in the second direction Y. According to this, since the flow path member includes the flow path which is branched, the connection to the flow path on the upstream side is simply performed.

In the embodiment, each of the upstream filter chambers 3121 and 3221 is provided with two filters 244. That is, each of the upstream filter chambers 3121 and 3221 is the common filter chamber to the two filters 244. On the other hand, the downstream filter chambers 3122 and 3222 are separated from each other by corresponding to the filters 244 which are provided in parallel whit the first direction X. Meanwhile, the number of filters 244 which are provided in each of the upstream filter chambers 3121 and 3221 may be changed from two to one, and each of the downstream filter chambers 3122 and 3222 may be divided into two. Further, the number of filters 244 which are provided in each of the upstream filter chambers 3121 and 3221 may be changed from two to one, and the downstream filter chambers 3122 and 3222 also may be one.

In any case, after the downstream filter chambers 3122 and 3222, since the flow path is branched into the X1 side and the X2 side in the first direction X, and are led to the first supply path 313 and the second supply path 323, this branching point becomes a second branch point.

Spaces disposed above the upstream filter chambers 3121 and 3221 in the vertical direction are for air bubble chambers 315 and 325. The air bubble chambers 315 and 325 are spaces for storing the air bubbles which are removed by the filter 244, and are the spaces other than upstream filter chambers 3121 and 3221 among the spaces which are surrounded by the outer wall portion 245, and sealed by the film 243. Meanwhile, the upstream filter chambers 3121 and 3221, and the air bubble chambers 315 and 325 are the spaces completely communicating with each other, and are the spaces in which the air bubbles can be stored without a need to particularly define a boundary. In addition, the air bubble chambers 315 and 325 are the range functioning as the flow path member 240 even in a case where the air bubbles are stored. In the embodiment, it is assumed that an upper end of the filter 244 in the vertical direction is a lower end of the air bubble chambers 315 and 325. That is, even in a case where the air bubbles have been stored so far, the filter 244 does not contact the air bubbles and thus the function of the flow path member 240 is not inhibited.

In addition, a portion of the above-described communication flow path 3012 is provided inside the air bubble chambers 315 and 325, but since the outlet part 2461 is provided so as to extend to the side lower than the upper end of the filter 244 in the vertical direction, that is, the flow path wall portion 246 is provided so as to extend to the upstream filter chambers 3121 and 3221, and thus the outlet part 2461 opens to the inside of the upstream filter chambers 3121 and 3221. Accordingly, there is no concern that the outlet part 2461 clogged due to the air bubbles. In this way, the outlet part 2461 of the communication flow path 3012 open to the position which is equal to lower than the upper end of the filter 244, and preferably opens to the position lower than the middle position of the filter 244 in the vertical direction.

Meanwhile, an upper end wall portion 2462 of the flow path wall portion 246 defining the communication flow path 3012 is provided at a certain interval from the outer wall portion 245. Intervals 3151 and 3251 between the upper end wall portion 2462 and the outer wall portion 245 become the flow paths of the air bubbles in the air bubble chambers 315 and 325, and function of not dividing the air bubble chambers 315 and 325 by the flow path wall portion 246 in the first direction X.

As described above, the air bubble chamber 315 corresponding to two filters 244 is a communication air bubble chamber which communicates in the first direction X. In addition, the air bubble chamber 325 corresponding to two filters 244 in the same way is the communication air bubble chamber which communicates in the first direction X. Accordingly, even though the storage amount of the air bubbles are varied in the two filters, the uniformity can be realized, and thus it is possible to store the large amount of air bubbles at the end.

In addition, the outlet part 2461 of the communication flow path 3012 is preferably provided between the two filters 244. This is because that the liquid can be equally supplied to both of the filters 244. Note that the outlet part 2461 of the communication flow path 3012 is not necessarily disposed between the filters 244 as long as the liquid is sufficiently supplied to both filters 244.

Here, as illustrated in FIG. 19, sine the air bubble chambers 315 and 325 are formed above the concavity 241, a dimension of the second direction Y in the upper portion is set to be larger than dimensions of a total of the upstream filter chambers 3121 and 3221, and the downstream filter chambers 3122 and 3222, a large amount of the air bubbles can be stored. Meanwhile, the air bubble chamber 315 and the air bubble chamber 325 which are positioned on both sides in the second direction Y are separated from each other by the partition wall 247 in the embodiment (refer to FIG. 19). When providing the partition wall 247 as described above, in a case where any one of the downstream filter chamber 3122 and the downstream filter chamber 3222 is a large negative pressure, it is possible to prevent the air bubbles which are stored on both air bubble chambers 315 and 325 from being moved to the negative pressure side to enter the upstream filter chambers 3121 and 3221.

Meanwhile, a guide member 248 that appears to separate the upstream filter chambers 3121 and 3221 and the air bubble chambers 315 and 325 from each other in FIG. 19 is provided in a portion of the filter 244 in the first direction X along the upper end of the filter 244 as illustrated in FIG. 17, and a member that functions as a guide when providing the filter 244. In addition, the guide member 248 corresponds to the welding portion of the film 243, and thus it is possible to more reliably supporting the film 243. Of course, it is not necessarily to provide the guide member 248. Meanwhile, the guide member 248 is an example of a middle wall portion.

As described above, the first liquid storage portion 312 and the air bubble chamber 315 which are the filter chamber are provided in the concavity which is surrounded by the outer wall portion 245 on the X1 side of the flow path member 240 in the first direction X, and the second liquid storage portion 322 and the air bubble chamber 325 which are the filter chamber are provided in the concavity which is surrounded by the outer wall portion 245 on the X2 side of the flow path member 240 in the first direction X. Then, the communication flow path 3012 which is surrounded by the first liquid storage portion 312 and the air bubble chamber 315, and the flow path wall portion 246 are sealed by welding the film 243 which is one of the fixing member common to the outer wall portion 245 and the flow path wall portion 246. In addition, the communication flow path 3012 which is surrounded by the second liquid storage portion 322 and the air bubble chamber 325, and the flow path wall portion 246 are sealed by welding the film 243 which is one of the fixing member common to the outer wall portion 245 and the flow path wall portion 246. According to this, the first and second liquid storage portions 312 and 322, and the air bubble chambers 315 and 325 which are the filter chamber can be formed by sealing the film 243 which is a common fixing member, therefore, can be manufactured in a relatively simple manner. Further, the communication flow path which communicates with the upstream filter chambers 3121 and 3221 via the air bubble chambers 315 and 325 can be also formed of the film 243 which is the common fixing member, and thus can be manufactured in a relatively simple manner. Therefore, the flow path wall portion of the communication flow path can reliably support the fixing member.

Here, the flow path member 240 is preferably formed by resin-molding; however, since the outer wall portion 245 and the flow path wall portion 246 are not continuously disposed, a sink in the resin-molding is prevented, and the air bubbles can move in the air bubble chambers 315 and 325 without interfering with the flow path wall portion 246, thereby increasing the capacitor of the air bubble chambers 315 and 325.

In addition, the fixing member may be a rigid plate member instead of the film 243, but when employing the film 243, it is possible to reduce the cost of the fixing member, and the flatness of the welded surface such as the outer wall portion 245 and the flow path wall portion 246 is not required, thereby realizing further simple manufacture. In addition, the fixing member which is formed of the film 243 has compliance, but the flow path wall portion 246 can reduce the compliance.

The concavity, in which the first liquid storage portion 312 and the air bubble chamber 315 which are the filter chamber are provided, and the second liquid storage portion 322 and the air bubble chamber 325 which are the filter chamber, as illustrated in FIG. 19, has a dimension of the second direction Y of the upper side in the vertical direction, that is, the side upper than the first liquid storage portion 312 and the second liquid storage portion 322. That is, the concavity is deeply formed. According to this, it is possible to make a dimension of the filter large while efficiently disposing the wiring substrate or the like for driving the head main body, therefore, it is possible to reduce the pressure loss due to the filter 244. Further, in the direction perpendicular to the filter, the dimension of the air bubble chambers 315 and 325 is larger than the dimension of the first liquid storage portion 312 and the second liquid storage portion 322 which are the filter chamber, and thus it is possible to store a large amount of the air bubbles.

Further, as described above, each of the air bubble chambers 315 and 325 correspond to each of two filters 244, and is the communication air bubble chamber which communicates in the first direction X, but, in the second direction Y, the air bubble chamber 315 and the air bubble chamber 325 are separated from each other by the partition wall 247. With this configuration, even in a case of, in the first direction X, ejecting the liquid over the width of a portion of the recording head 2 instead of ejecting the liquid over the entire width of the recording head 2, it is possible to reduce variation of the amount of the air bubbles stored in the air bubble chamber 315 and the air bubble chamber 325 which are separated from each other by the partition wall 247. As a result, it is possible to prevent the air bubbles which are variably stored on either one of the air bubble chambers 315 and 325 from being moved to the negative pressure side to enter the upstream filter chambers 3121 and 3221.

Next, the cover member 250 will be described in detail. As illustrated in FIG. 3, FIG. 6, FIG. 7, FIG. 11 to FIG. 13, FIG. 15, and FIG. 17, the cover member 250 is integrated with the holder member 210, and is a member for accommodating the circuit board 220 and the flow path member 240 therein. That is, the cover member 250 is integrated with the holder member 210, and is a member capable of forming an inner space 259 having a size enough for accommodating the circuit board 220 and the flow path member 240.

In the embodiment, the cover member 250 opens to the Z1 side in the third direction Z, and is formed into a box shape having a bottom portion on the Z2 side. Then, the opening on the Z1 side of the cover member 250 is sealed on the surface on the Z2 side of the holder member 210, and thereby inner space 259 is formed.

The above-described cover member 250 includes a sealed part 253 which contacts the holder member 210, and a rigid part 254 having Young's modulus higher than that of the sealed part 253.

The sealed part 253 contacts the holder member 210, and is a portion which is formed of a different material having Young's modulus higher than that of the rigid part 254 described later. The sealed part 253 is elastically deformed by being compressed to the holder member 210 side by the cover member 250 so as to remove the interval of the boundary between the cover member 250 and the holder member 210, and thereby preventing the ink from entering the inner space 259.

The rigid part 254 is a portion which substantially forms the holder member 210 and the inner space 259, and is formed of a material having Young's modulus higher than that of the sealed part 253. When forming the rigid part 254 with the above-described material, the rigidity of the cover member 250 can be improved, and it is possible to protect the circuit board 220 and the flow path member 240 which are accommodated in the inner space 259.

In addition, the rigid part 254 opens to the Z1 side in the third direction Z, and is formed into the box shape having the bottom portion on the Z2 side. Specifically, the rigid part 254 includes four side surfaces 255 which are orthogonal to the first direction X and in the second direction Y and are connected to the sealed part 253, and a ceiling 256 which is provided on the Z2 side in the third direction Z by connecting to all side surfaces 255, and is formed into in rectangular shape in a whole. As described above, since the rigid part 254 includes the ceiling 256 in addition to the side surface 255, it is possible to enhance the strength of the cover member 250.

Note that, in the embodiment, the cover member 250 is formed into the box shape, but the shape is not limited thereto. For example, the holder member 210 may be formed into the box shape which opens to the Z2 side, and the cover member 250 may be formed into the plate shape which seals the opening.

The sealed part 253 is provided at the end portion which opens to the Z1 side of the rigid part 254 the third direction Z, that is, if the sealed part 253 is not provided at the end portion, the sealed part 253 is provided at a portion which contact to the surface on the Z2 side of the holder member 210. The above-described sealed part 253 and rigid part 254 are formed by two-color molding. As described above, there is no particular limitation as long as the rigid part 254 is formed of a material having Young's modulus higher than that of the sealed part 253, for example, an elastomer can be used to the sealed part 253 as an elastic material by using a resin material as the rigid part 254.

The sealed part 253 which is formed by two-color molding has a contour accommodating the circuit board 220 and the flow path member 240 in a plane view with respect to the liquid ejecting surface 20*a*, in the embodiment, in a plan view seen from the third direction Z. The contour of the sealed part 253 according to the embodiment is formed into a circular shape and a substantially rectangular shape in accordance with an opening shape on the Z1 side of the rigid part 254. That is, the sealed part 253 is formed of two long side portions 253*a* and two side portions 253*b*. The long side portion 253*a* is a part which extends in the first direction X among the sealed part 253, and two long side portions 253*a* are provided in parallel with the second direction Y. The short side portion 253*b* is a part which extends in the second direction Y and is shorter than the long side portion 253*a* among the sealed part 253, and two short side portions 253*b* are provided in parallel with the first direction X.

As described above, accommodating the circuit board 220 and the flow path member 240 in the contour, in the above plan view, means that the circuit board 220 and the flow path member 240 are disposed in the inside of the contour of the sealed part 253.

Then, in the above-described contour of the sealed part 253, a part intersecting with the second direction Y which is the transporting direction to which at least the recording sheet S is transported forms the outermost of the recording head 2. Among the contours, the part intersecting with the second direction Y represents a part including a component intersecting with the second direction Y in a plan view. In the embodiment, the long side portion 253*a* which extends in the first direction X orthogonal to the second direction Y is a part which intersects with the second direction Y.

The long side portion 253*a* which is a portion of the contour of the sealed part 253 forms the outermost of the recording head 2. This means that the long side portion 253*a* forms a portion of the contour of the entire recording head 2 in a cross section parallel with the liquid ejecting surface 20*a* and a cross section including the sealed part 253. In other words, at least in the second direction Y, a component forming the recording head 2 on the outer side further than the long side portion 253*a* is not present.

In the invention, a part intersecting with at least the second direction Y forms the outermost of the recording head 2, but among the contours of the sealed part 253, the parts which do not intersect with the second direction Y may form the outermost of the recording head 2.

In the embodiment, the part which does not intersect with the second direction Y, that is, the sealed part 253 is configured that the short side portion 253*b* in parallel with the second direction Y also forms the outermost of the recording head 2.

Specifically, in a plan view, the contour of the holder member 210 and the cover member 250 is configured to include the contour of the entire recording head 2. That is, the side surface of the holder member 210 (that is, the side surface orthogonal to the first direction X and the second direction Y) and the side surface 255 of the cover member 250 form the outermost of the recording head 2. Then, the sealed part 253 is formed into a circular shape on an end surface on the Z1 side of the side surface 255 of the cover member 250.

As described above, by forming the cover member 250, the sealed part 253 forms the outermost of the contour of the entire recording head 2 which is formed of the holder member 210 and the cover member 250 in the cross section in parallel with the liquid ejecting surface 20*a*.

As described above, in the recording head 2 according to the embodiment; the sealed part 253 is formed in the cover member 250. With this, a boundary portion between the holder member 210 and the cover member 250 is sealed by the sealed part 253, and thus it is possible to reliably prevent the ink from entering the inner space 259 from the boundary portion. Accordingly, it is possible to protect the electronic component such as the circuit board 220 which forms the recording head 2.

In addition, the cover member 250 includes the sealed part 253 which is formed by two-color molding and the rigid part 254. When employing the two-color molding, even with the end surface on the Z1 side of the side surface 255 which has small width, it is possible to form the sealed part 253 so as to be accommodated in the width. With this configuration, if the contour of the recording head 2 in a plan view is defined by the cover member 250 and the holder member 210 which include the rigid part 254 having the high rigidity, it is possible to provide the sealed part 253 without protruding outer side than the contour.

Here, in a case where the sealed part 253 is formed of a different sealing member instead of the rigid part 254 without employing the two-color molding, the width of the sealing member will be fit to the width of the side surface 255 of the rigid part 254. When attempting the sealing with the sealing member by sandwiching the above-described sealing member between the surface on the Z2 side of the holder member 210 and the end surface on the Z1 side of the side surface 255 of the rigid part 254, due to the small width of the sealing member, the side surface 255 is shifted from the sealing member, and thus it is difficult to achieve the reliable sealing. In addition, in order to achieve the reliable sealing, the width of the sealing member is allowed to be greater than the width of the side surface 255, and the side surface 255 is prevented from being shifted from the sealing member. As a result, the size of the recording head 2 is increased at least in the second direction Y as much as the width of the sealing member becomes greater.

In the recording head 2 according to the embodiment, as described above, since the rigid part 254 and the sealed part 253 are integrally formed by two-color molding, the sealed part 253 is not greater than the contour of the rigid part 254, and thus it is possible to prevent the size of the recording head 2 from being increased.

Further, in the recording head 2 according to the embodiment, the sealed part 253 includes the long side portion 253*a* intersecting with the second direction Y which is the transporting direction forms the contour of the entire recording head 2. That is, it is possible to realize the miniaturization of the recording head 2 in the second direction Y.

Here, as an aspect that the long side portion intersecting with the second direction Y does not form the contour of the entire recording head 2, for example, there is a configuration of providing another member forming the recording head 2 on the outer side than the sealed part 253 in the second direction Y. According to the above aspect, there is a possibility that the size of the recording head 2 is increased in the second direction Y once another member is provided.

In the recording head 2 according to the embodiment, unlike the above-described aspect, since there is no other members of forming the recording head 2 on the outer side than the sealed part 253, it is possible to prevent the size of the recording head 2 from being increased in the second direction Y.

Particularly, in the recording head 2 according to the embodiment, the short side portion 253*b* is allowed to form the contour which is the outermost of the recording head 2 in addition to the long side portion 253*a* intersecting with the second direction Y. Accordingly, it is possible to prevent the size of the recording head 2 from being increased in the first direction X.

Figure 20A:
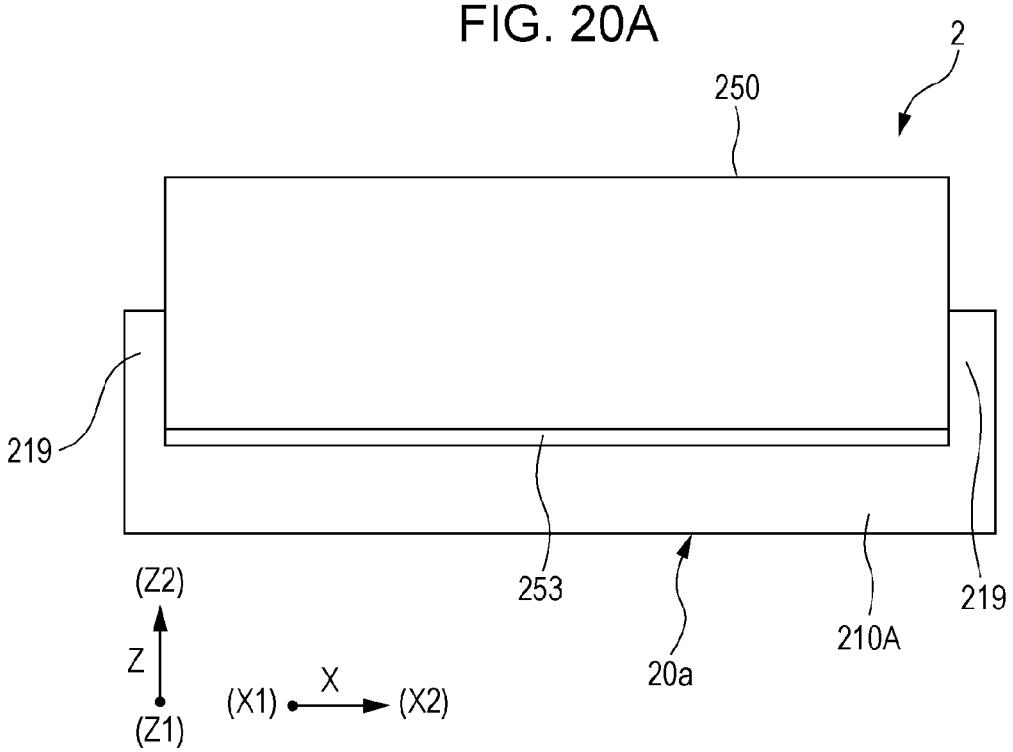
FIG. 20A and FIG. 20B are respectively a top view and a side view illustrating disposition of a first correcting plate and a circuit board.
Figure 20B:
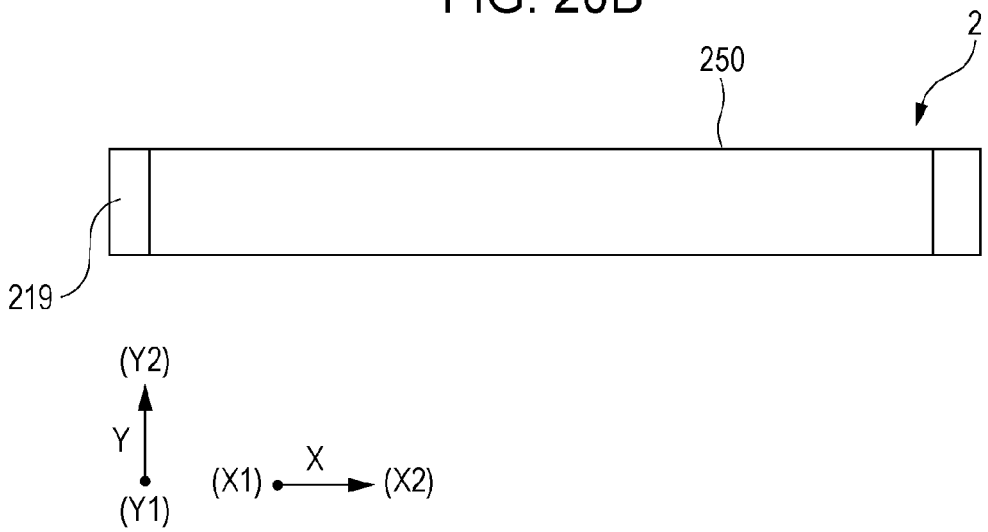

Next, with reference to FIG. 20A and FIG. 20B, the configuration of the first correcting plate 230 and the circuit board 220 of the recording head 2 according to the embodiment will be described in detail. FIG. 20A and FIG. 20B are respectively a top view and a side view illustrating disposition of the first correcting plate and the circuit board which are fixed to the holder member according to the embodiment. FIG. 20A is a side view of the second head main body group 202B side, that is, the Y2 side in the second direction Y, and FIG. 20B is a top view thereof. In addition, in FIG. 20A and FIG. 20B, description of the flow path member 240 and the wiring substrate 121 is not illustrated.

The recording head 2 according to the embodiment includes the first correcting plate 230 including the correcting main body portion 231, the opening portion 233, and the leg portion 232 which is disposed on both sides of the opening portion 233 in the first direction X. In two first correcting plates 230 interposing the circuit board 220 therebetween in the second direction Y, the first correcting plates 230 which is provided on the first head main body group 202A side is referred to as a first correcting plate 230*a*, and the first correcting plates 230 which is provided on the second head main body group 202B side is referred to as a first correcting plate 230*b*.

In addition, the connection portion 226 is provided on both surfaces of the circuit board 220. Among respective connection portions 226, the connection portion 226 which is provided on the surface of the Y1 side in the second direction Y is referred to as a first connection portion 226*a*, and the connection portion 226 which is provided on the surface of the Y2 side is referred to as the second connection portion 226*b*.

The first connection portion 226*a* is connected to the wiring substrate 121 of the head main body 200 which forms the first head main body group 202A, and the second connection portion 226*b* is connected to the wiring substrate 121 of the head main body 200 which forms the second head main body group 202B.

The leg portion 232 of one of the first correcting plates 230*a* from a pair of the first correcting plates 230 overlaps with the second connection portion 226*b* in the first direction X, and is not disposed so as not to overlap with the first connection portion 226*a*.

In addition, the leg portion 232 of the other first correcting plates 230*b* from the pair of the first correcting plates 230 overlaps with the first connection portion 226*a* in the first direction X, and is not disposed so as not to overlap with the second connection portion 226*b*.

The leg portion 232 of each of the first correcting plate 230*a* and the first correcting plate 230*b* is disposed with respect to the first connection portion 226*a* and the second connection portion 226*b* as described above, and thus one on the X1 side of two first connection portions 226*a*, and one on the X2 side of two second connection portions 226*b* are not disposed inside the opening portion 233 of the first correcting plate 230 in a plan view.

In the recording head 2 according to the embodiment, the leg portion 232 of each of the first correcting plate 230*a* and the first correcting plate 230*b* is disposed with respect to the first connection portion 226*a* and the second connection portion 226*b* as described above. With this configuration, the leg portion 232 of the first correcting plate 230 is not necessary to be disposed on the outer sides of all of the first connection portions 226*a* in the first direction X and outer sides of all of the second connection portions 226*b* in the first direction X, and thus it is possible to realize the miniaturization of the size in the first direction X.

Further, not shown particularly, the first connection portion and the second connection portion overlap with each other in a plan view of the circuit board 220, the recording head may be configured to have the width of the leg portion 232 in the first direction X smaller than the width of the opening portion 233 in the first direction X.

According to the recording head which is configured described above, since the first connection portion and the second connection portion overlap with each other, it is possible to shorten the interval of the head main body 200 which are in the line in the first direction X. With this, it is possible to realize the miniaturization of the recording head in the first direction X. Furthermore, it is possible to dispose the second head main body group 202B which is connected to the second connection portion via the wiring substrate 121 on the first head main body group 202A which is connected to the first connection portion via the wiring substrate 121 so as to overlap with each other in the first direction X. In addition, the width of the leg portion 232 is smaller than the width of the opening portion 233, and thus it is possible to realize the miniaturization in the first direction X.

Of course, in a plan view of the circuit board 220, the recording head may have a configuration that the first connection portion and the second connection portion do not overlap with each other. In addition, the recording head may be configured to have the width of the leg portion 232 in the first direction X equal to or greater than the width of the opening portion 233 in the first direction X.

In the liquid ejecting head as described above, in the flow path member 240 which is common to the head main body 200 on the X1 side of the first head main body group 202A and the head main body 200 on the X1 side of the second head main body group 202B, the liquid is supplied from the first supply path 313 to the nozzle row on the Y1 side of the head main body 200Y2 of the first head main body group 202A and the nozzle row on the Y1 side of the head main body 200 of the second head main body group 202B, and the liquid is supplied from the second supply path 323 to the nozzle row on the Y2 side of the head main body 200 of the first head main body group 202A and the nozzle row on the Y2 side of the head main body 200 of the second head main body group 202B.

Figure 27:
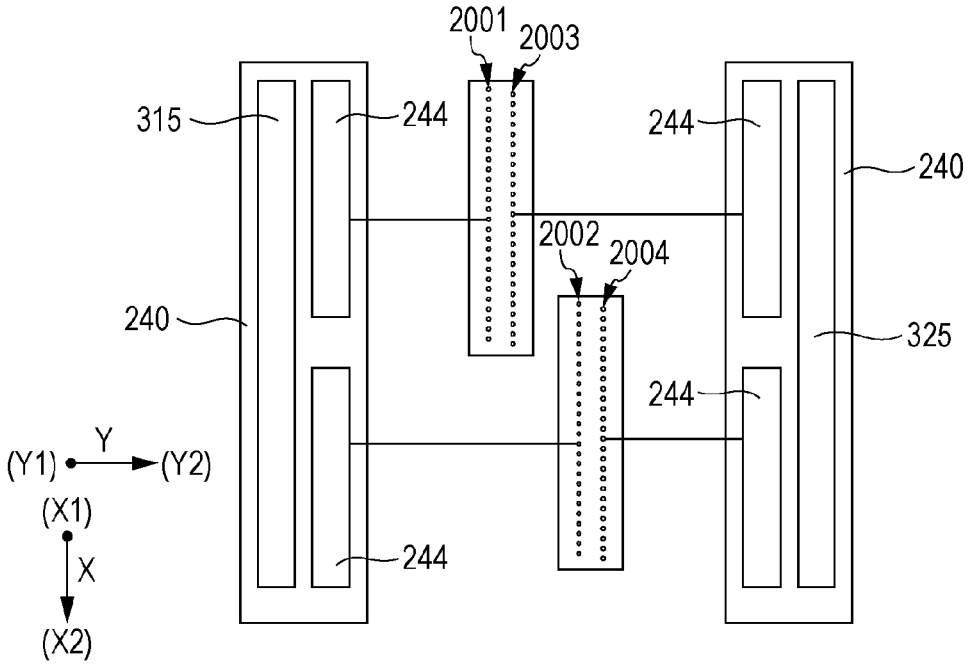
FIG. 27 is a schematic diagram illustrating a relationship between the flow path member and the nozzle row in the first embodiment.

A schematic diagram of this connection state is illustrated FIG. 27. FIG. 27 is a diagram seen through the nozzle row from the upper side, and a first nozzle row 2001 and a third nozzle row 2003 are provided in one nozzle plate, and the positions in the first direction X overlap with each other, but do not overlap with each other in the second direction Y. In addition, a second nozzle row 2002 and a fourth nozzle row 2004 are provided in one nozzle plate, and the positions in the first direction X overlap with each other, but do not overlap with each other in the second direction Y. In addition, the positions of the first nozzle row 2001 and the third nozzle row 2003, and the positions of the second nozzle row 2002 and the fourth nozzle row 2004 are different from each other in the second direction Y. In this nozzle arrangement, the air bubble chambers 315 and 325 corresponding to two nozzle rows which are provided in parallel with the first direction X are common to each other, and correspond to the communication air bubble chamber in which the air bubbles can move to each other; however, in the second direction Y, the air bubble chamber 315 and the air bubble chamber 325 are separated from each other. As described above, in the second direction Y, the air bubble chamber 315 and the air bubble chamber 325 are separated from each other, and thus it is possible to reduce the variation of the amount of the air bubbles which are stored in each of the air bubble chamber 315 and the air bubble chamber 325 which are separated from each other by the partition wall 247 even in a case where the liquid is ejected over the width of a portion of the recording head 2 instead of that the liquid is ejected over the entire width of the recording head 2 in the first direction X. As a result, it is possible to prevent the air bubbles which are variably stored on either one of the air bubble chambers 315 and 325 from being moved to the negative pressure side to enter the upstream filter chambers 3121 and 3221.

Figure 28:
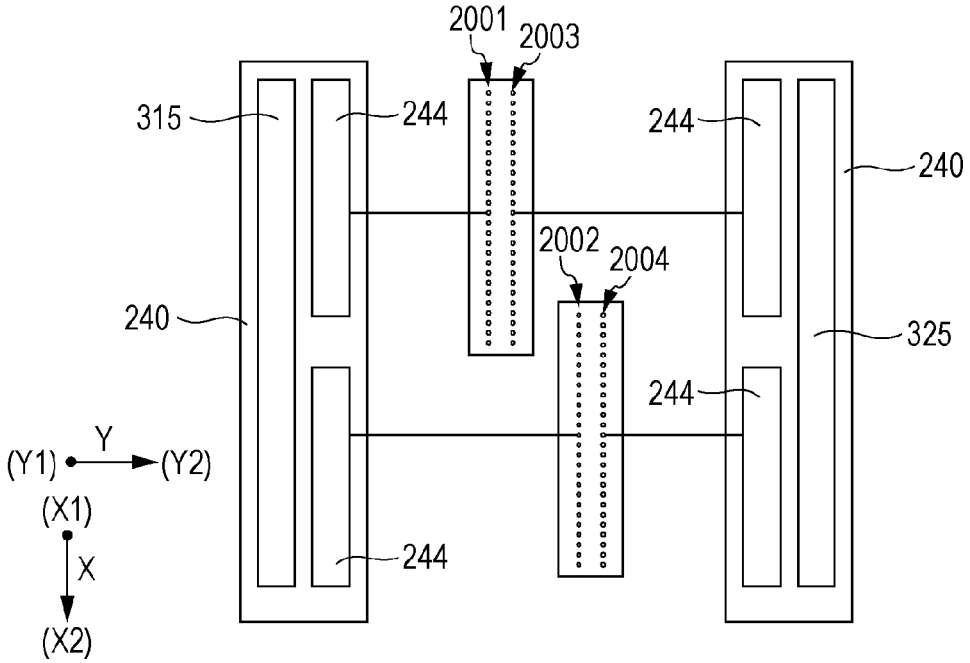
FIG. 28 is a schematic diagram illustrating a relationship between the flow path member and the nozzle row in a modification example.

Here, in order for the nozzle rows to overlap with each other in the first direction X, as illustrated in FIG. 27, the first nozzle row 2001 and the third nozzle row 2003 may be deviated by a half pitch, or may not be deviated by a half pitch as illustrated in FIG. 28. In addition, in a case where the positions of the nozzle rows are different from each other in the first direction X, as illustrated in FIG. 27 and FIG. 28, some parts overlap with each other.

Figure 29:
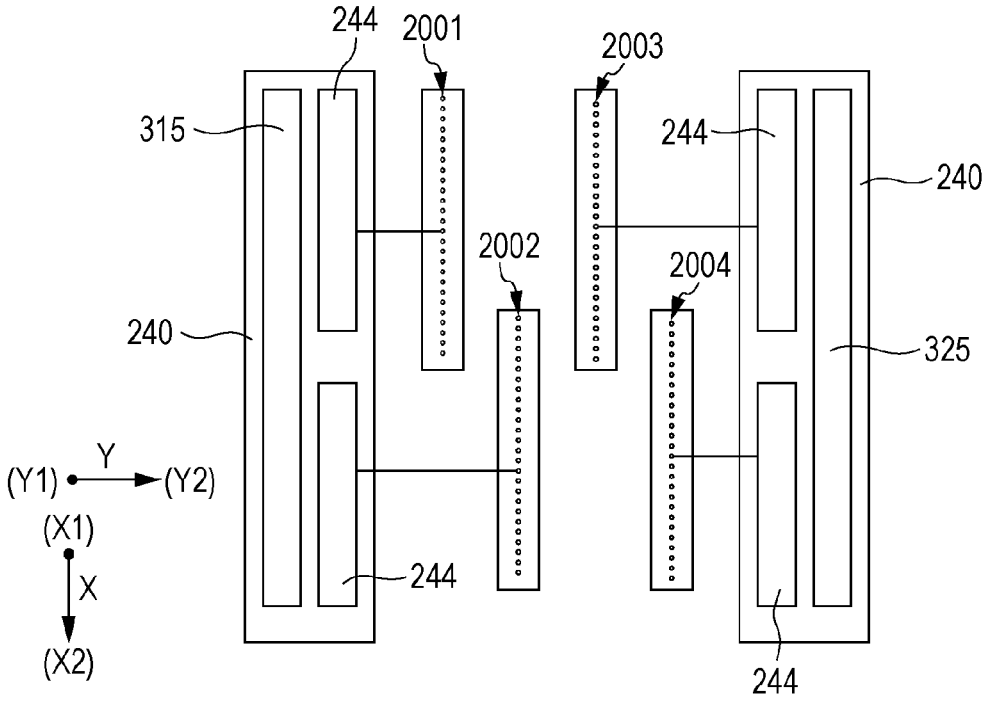
FIG. 29 is a schematic diagram illustrating a relationship between the flow path member and the nozzle row in the modification example.
Figure 30:
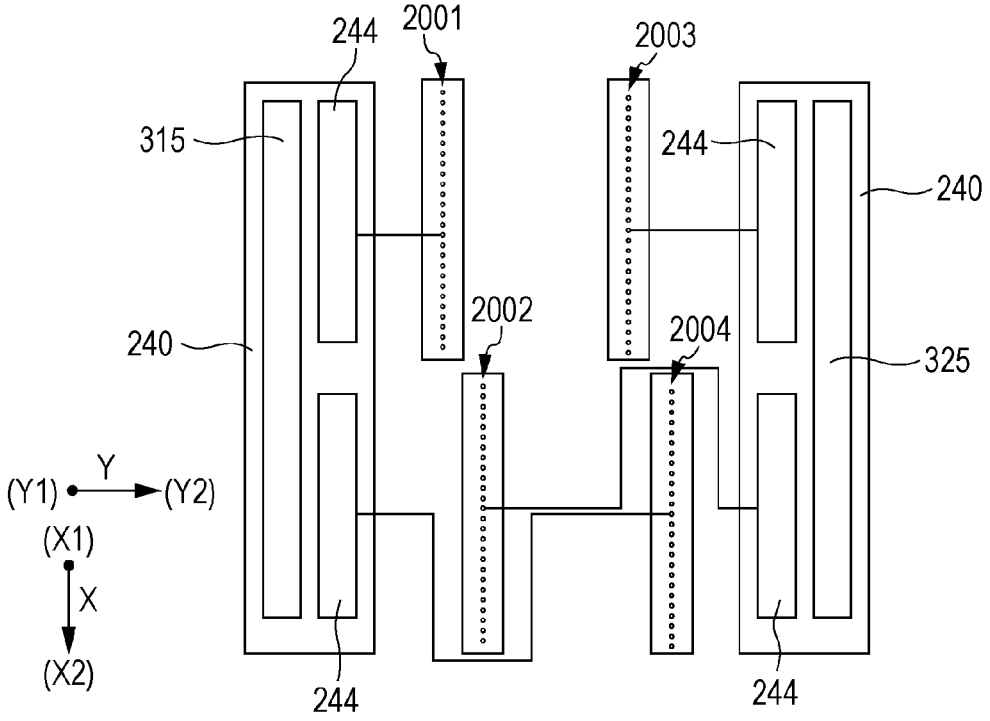
FIG. 30 is a schematic diagram illustrating a relationship between the flow path member and the nozzle row in the modification example.

In addition, by providing two the nozzle rows on one nozzle plate, a dimension in the second direction Y can be small, and thus positioning between two nozzle rows can be easily performed; however, one nozzle row may be provided on one nozzle plate. For example, as illustrated in FIG. 29, the first to fourth nozzle rows 2001 to 2004 may be respectively provided on different nozzle plate. In addition, the air bubble chamber 315 and the air bubble chamber 325 overlap with each other in the first direction X, and when corresponding to different the nozzle rows in the second direction Y, for example, as illustrated in FIG. 30, the air bubble chamber 315 may be connected to the fourth nozzle row 2004, and the air bubble chamber 325 may be connected to the third nozzle row 2003.

In addition, in the nozzle rows in which the positions in the second direction Y are different from each other, and the positions in the first direction X overlap with each other in at least a portion, the air bubble chamber 315 and the air bubble chamber 325 may be separated from each other by the partition wall 247, and the number of the nozzle rows which are connected to the air bubble chamber 315 or the air bubble chamber 325 is not limited two. In a case where a group of the nozzle rows which are connected to the air bubble chamber 315 is set to a first nozzle group, and a group of the nozzle rows which are connected to the air bubble chamber 325 is set to a second nozzle group, the positions of the first nozzle group and the second nozzle group are different from each other in the second direction Y, and the positions in the first direction overlap with each other in at least a portion. Therefore, even in a case the variation of the liquid consumption amount between the filter chambers, as the positions in the first direction overlap with each other in at least a portion, the variation of the storage amount of the air bubbles in the air bubble chamber is less likely generated. Accordingly, it is possible to prevent the stored air bubbles from clogging a certain filter chamber. Meanwhile, regardless of that the first nozzle group is provided on one nozzle plate, and the second nozzle group is not provided on one nozzle plate, it is possible to easily arrange the nozzle groups in a long line in the first direction by forming the first and second the nozzle groups with the plurality of nozzle rows.

Second Embodiment

Figure 21:
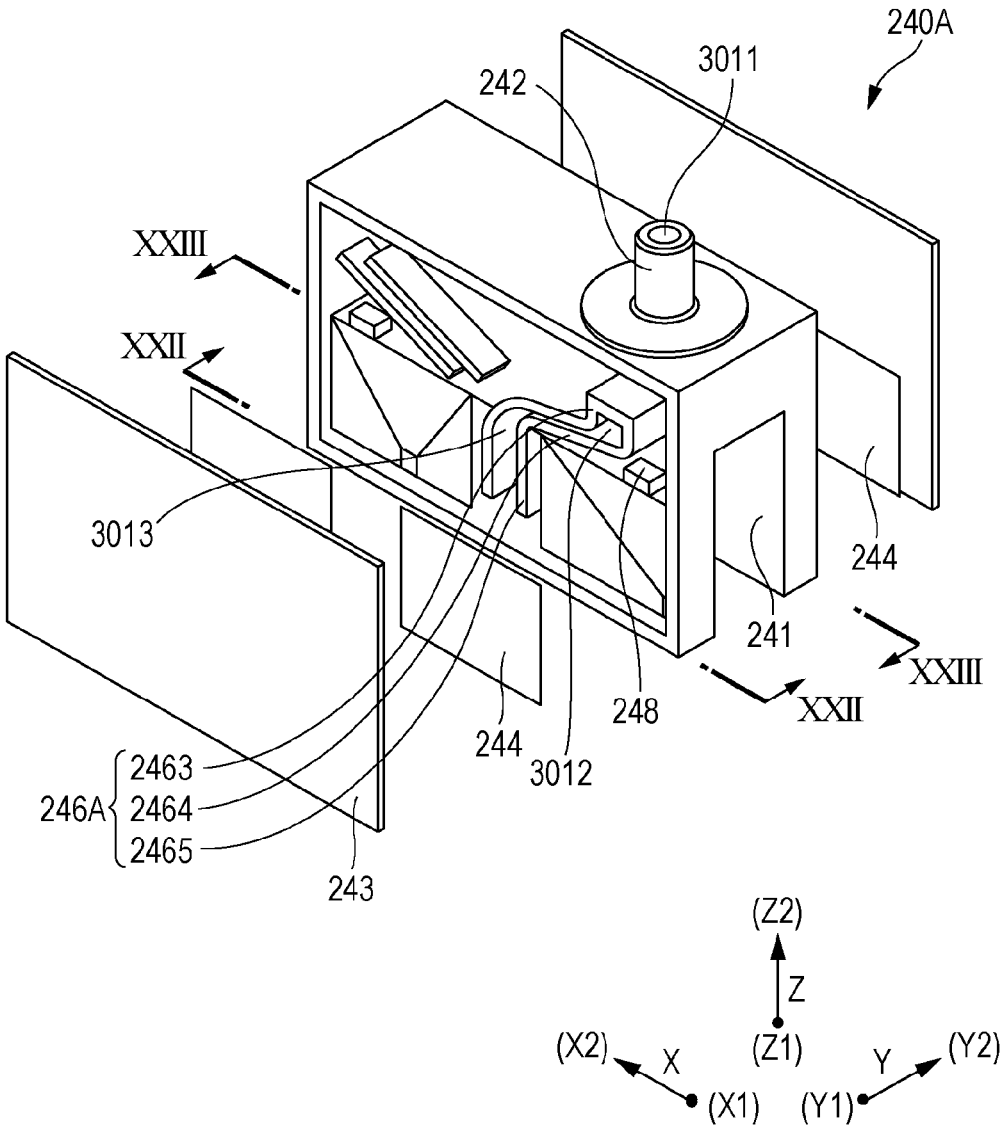
FIG. 21 is an exploded perspective view of the flow path member according to a second embodiment.
Figure 22:
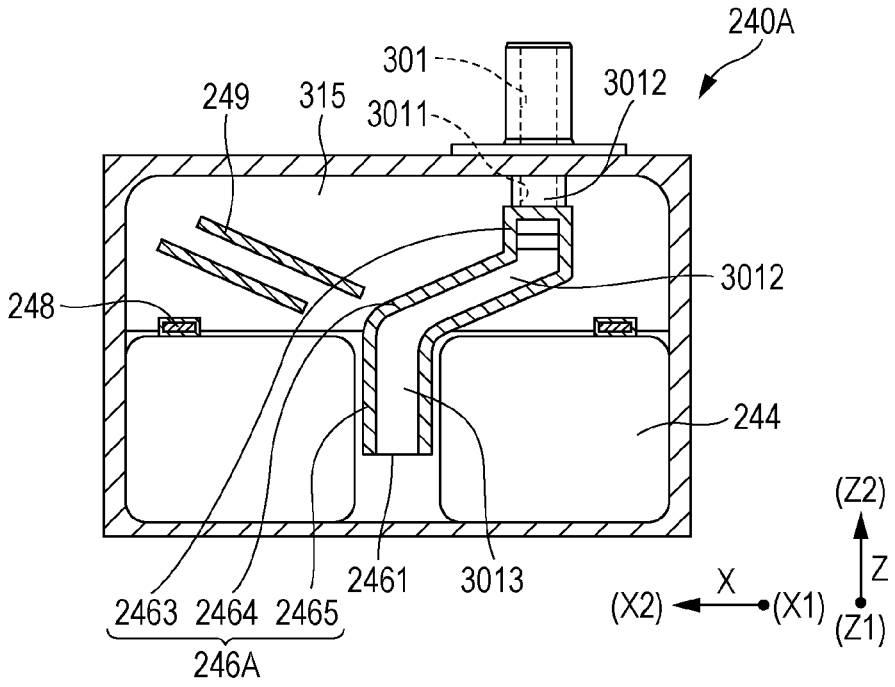
FIG. 22 is a cross-sectional diagram of FIG. 21, taken along line IIX-IIX.
Figure 23:
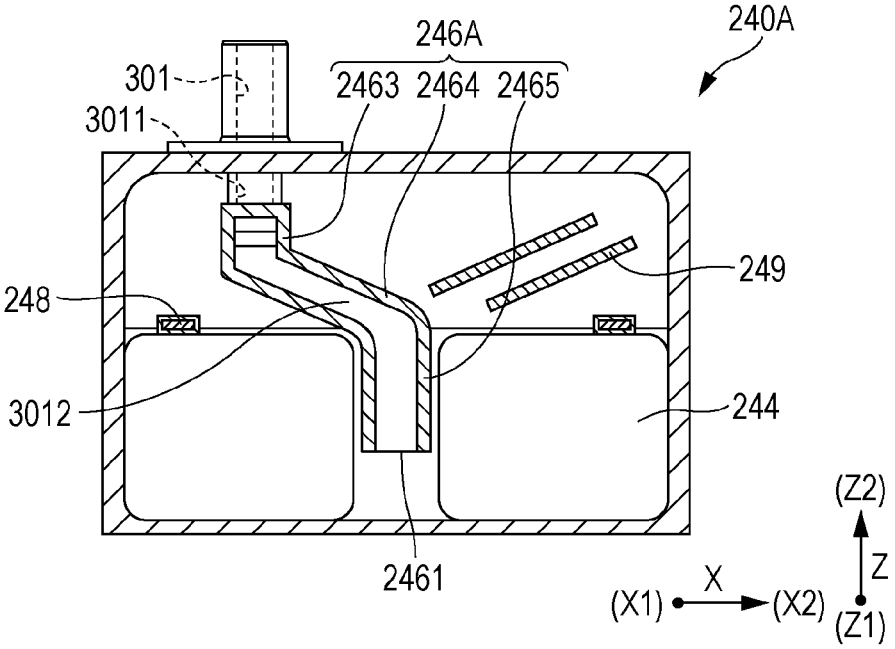
FIG. 23 is a cross-sectional diagram of FIG. 21, taken along line IIXI-IIXI.

Here, a flow path member 240A according to another embodiment will be described. FIG. 21 is an exploded perspective view of the flow path member of a flow path member 240A, FIG. 22 is a cross-sectional diagram of FIG. 21, taken along line IIX-IIX in the second direction Y and the third direction Z, FIG. 23 is a cross-sectional diagram of FIG. 21, and taken along line IIXI-IIXI in the second direction Y and the third direction Z. Note that, the same constituent elements as in FIG. 16 to FIG. 19 are given the same reference numerals, and repeated description will be omitted.

As illustrated FIG. 21 to FIG. 23, in the flow path member 240A, the feeding needle 242 is not disposed in the center portion in the first direction X, but is disposed at a position close to the X1 direction, and the branched flow path 3011 which communicates with the introduction path 301 inside the feeding needle 242 is provided immediately below the feeding needle 242. Accordingly, a flow path wall portion 246A which defines a communication flow path 3013 communicating the branched flow path 3011 includes a communication portion 2463 which communicates with a branched flow path 3011 immediately below the feeding needle 242, an inclination portion 2464 which is inclined downward in the center direction, and a leaner portion 2464 which downwardly extends between two filters 244, and a tip end of the leaner portion 2465 corresponds to an outlet part 2461.

In addition, in the embodiment, a fixing wall portion 249 which has a shape substantially the same as the inclination portion 2463 is provided at a position which is linearly symmetrical with the flow path wall portion 246A with respect to the vertical direction. The fixing wall portion 249 corresponds to a welding portion of the film 243 similar to the flow path wall portion 246A. With this, since the film 243 is held by the symmetrically provided welding portion, the film 243 is further reliably held. Of course, the fixing wall portion 249 is not necessarily provided.

Meanwhile, the inclination portion 2463 of the flow path wall portion 246A or the fixing wall portion 249 can be provided in horizontal direction without being inclined, but is preferably provided to be inclined. When providing the inclination portion 2463 of the flow path wall portion 246A or the fixing wall portion 249 in horizontal direction, there is a concern that the air bubbles are stored along the lower portion of the wall surface, but when the inclination portion 2463 of the flow path wall portion 246A or the fixing wall portion 249 is provided to be inclined, it is possible to reliably move the air bubbles to the upper side in the vertical direction. In addition, it is preferable that the flow path wall portion 246A or the fixing wall portion 249 is discontinuous from the outer wall portion 245. This is for that the movement of the air bubbles is not disturbed.

Other Embodiments

Hereinbefore, embodiments of the invention are described, but the basic configuration of the invention is not limited to thereto.

For example, in the flow path members 240 and 240A of the above-described embodiment, the first liquid storage portion 312 and the second liquid storage portion 322, and the air bubble chambers 315 and 325 are provided on both sides in the second direction Y, but may be provided on one side in the second direction Y.

In addition, in the flow path members 240 and 240A of the above-described embodiment, the film 243 is used as the fixing member, but may use a plate member having rigidity.

In addition, in the flow path members 240 and 240A of the above-described embodiment, the filter 244 is provided in parallel with the vertical direction, but may be provided to be slightly inclined from the vertical direction. It can be said that this is also provided along the vertical direction.

Further, in the flow path members 240 and 240A of the above-described embodiment, two communication flow paths 3012 are branched from one feeding needle 242 which is an introduction port of the liquid, but there may be two introduction ports. Furthermore, the configuration of forming the branched flow path 3011 or a branching position is not limited to the configuration of the above described embodiment.

In addition, in the flow path members 240 and 240A of the above-described embodiment, the communication flow path is formed by fixing the fixing member to the flow path wall portion, but is not necessarily fixed to the flow path wall portion.

In addition, a fixing trace of the fixing member and the outer wall portion, and a fixing trace of the flow path wall portion and the fixing wall portion are discontinuous, but are not necessarily to be discontinuous.

In addition, in the first embodiment, as illustrated in FIG. 11, the ceiling 256 of the cover member 250 is disposed to be closer to the Z1 side in the third direction Z than the connector 221 of the circuit board 220. However, the disposition is not limited to this way. That is, at least a portion of the connector 221 of the circuit board 220 may be disposed to closer to the Z1 side of the third direction Z than the ceiling 256 of the cover member 250. For this reason, since the feeding needle 242 of the flow path member 240, the connector 221 of the circuit board 220 can be disposed at the same position in the third direction Z, it is possible to realize the miniaturization of the recording head 2 in the third direction Z while forming the size which is required for the circuit board 220 or the flow path member 240 in the inner space 259. Meanwhile, the same position means that at least a portion of the feeding needle 242 and at least a portion of the connector 221 may be the same in the third direction Z.

In addition, in the first embodiment, the flow path member 240 is provided with respect to each of two head main bodies 200 in the vicinity of the second direction Y, that is, the flow path member 240 which is common to the head main body 200 on the X1 side of the first head main body group 202A and of the head main body 200 on the X1 side the second head main body group 202B, and the flow path member 240 which is common to the head main body 200 on the X2 side of the first head main body group 202A and the head main body 200 on the X2 side of the second head main body group 202B. However, the flow path member 240 is not limited thereto. For example, one flow path member 240 may be provided with respect to one head main body 200, or one flow path member 240 may be provided with respect to four head main bodies 200.

In the flow path member 240 which is common to the head main body 200 on the X1 side of the first head main body group 202A and the head main body 200 on the X1 side of the second head main body group 202B, the liquid is supplied from the first supply path 313 to the nozzle row on the Y1 side of the head main body 200 of the first head main body group 202A and the nozzle row on the Y1 side of the head main body 200 of the second head main body group 202B, and the liquid is supplied from the second supply path 323 to the nozzle row on the Y2 side of the head main body 200Y2 of the first head main body group 202A and the nozzle row on the Y2 side of the head main body 200 of the second head main body group 202B. However, it may be any connection of the nozzle rows from the first supply path 313 and the second supply path 323 of the flow path member 240, and the first head main body group 2020A and the second head main body group 202B.

In addition, in the above-described first embodiment, the first correcting plate 230 is smaller than the width of the holder member 210 in the first direction X. However, the size of the first correcting plate 230 is not limited to the above description. As long as the shape is a planar shape facing each of both surfaces of the circuit board 220, the size or the thickness is not particularly limited.

In addition, the recording head 2 according to the first embodiment is provided with the first correcting plate 230 and the second correcting plate 280. However, the configuration is not limited to the above description. That is, the recording head 2 may be provided with at least the first correcting plate 230 and may not be provided with the second correcting plate 280.

In addition, the recording head 2 according to the first embodiment is provided with the second correcting plate 280 which is formed into the planar shape parallel with the liquid ejecting surface 20*a*. However, the second correcting plate 280 may not be parallel with the liquid ejecting surface 20*a*. In addition, the second correcting plate 280 may be formed of a material having the rigidity equal to or lower than that of the holder member 210 without being limited to a case of being formed of a material having the rigidity equal to or higher than that of the holder member 210. Further, in the surface in parallel with the liquid ejecting surface 20*a*, the second correcting plate 280 includes the size for covering the liquid ejecting surface of the entire head main body 200. However, the embodiment is not limited thereto.

Further, the regulation portion 218 is provided in the holder member 210, but a regulation portion may not be provided without being limited thereto. In addition, the regulation portion 218 may be integrated with the holder member 210 or may be a separated member.

The recording head 2 according to the first embodiment is provided with the exposing portion 290. However, the configuration of the recording head is not limited thereto. For example, the opening which exposes the feeding needle 242 to the cover member 250 may be provided. That is, the exposing portion 290 may not provided with the side wall portion 291, the ceiling portion 292, and the notch 295 which form the exposing portion 290.

The recording head 2 according to the first embodiment is provided with the sealed part 253, which is formed by two-color molding, between the holder member 210 and the cover member 250. However, the configuration is not limited thereto. For example, the sealing member which is formed of another member having a circular-type elastic material and is not formed by two-color molding may be used.

The recording head 2 according to the first embodiment has the Young's modulus of the holder member 210 greater than the Young's modulus of the rigid part 254 of the cover member 250. However, the configuration is not limited thereto.

In the above-described first embodiment, one recording head 2 is provided in the carriage 3. However, the number of the recording heads is not particularly limited thereto, for example, two or more of the recording heads 2 may be provided in the carriage 3.

In the above-described first embodiment, the configuration that one type of ink is ejected from one recording head 2 is exemplified. However, the type of the ink is not particularly limited thereto, for example, various types of ink may be ejected for each nozzle row.

In the above-described first embodiment, the juxtaposed direction of the head main body 200 of the recording head 2 is set to the first direction X when being mounted on the ink jet type recording apparatus 1. However, the juxtaposed direction is not particularly limited thereto. For example, the juxtaposed direction of the head main body 200, that is, the juxtaposed direction of the nozzle opening 21 may be the direction inclined with respect to the first direction X of the ink jet type recording apparatus 1. That is, the head main body 200 which forms the head main body group 202 may be provided in parallel with the axial direction of the carriage axis. In the same way, the juxtaposed direction of the head main body group 202 is set to the second direction Y. However, the juxtaposed direction is not limited thereto; for example, the juxtaposed direction of the head main body group 202 may be the direction which is inclined with respect to the second direction Y.

In the above-described first embodiment, the thin film-type piezoelectric actuator 130 is described as an example of the pressure generating unit which causes the pressure generating chamber 12 to generate the pressure change. However, the type of the actuator is not particularly limited thereto, for example, it is possible to use a thick film-type piezoelectric actuator which is formed by a method of attaching a green sheet or the like, or a longitudinal vibration-type piezoelectric actuator which extends or contracts a piezoelectric material and an electrode forming material by being stacked with each other in the axial direction. In addition, as the pressure generating unit, it is possible to use a unit that disposes a heat generating element in the pressure generating chamber, and ejects the ink droplet form the nozzle opening by the bubbles which are generated due to the heat from the heat generating element, and an electrostatic type actuator that generates static electricity between the vibrating plate and the electrode, and ejects the ink droplet from the nozzle opening by deforming the vibrating plate by applying an electrostatic force thereto.

Meanwhile, in the above-described embodiment, the ink jet type recording head as an example of the liquid ejecting head, and the ink jet type recording apparatus as an example of the liquid ejecting apparatus are described, the invention is intended to be applied to a general liquid ejecting head and liquid ejecting apparatus which typically include the liquid ejecting head, and thus the invention can be applied to the liquid ejecting head and the liquid ejecting apparatus which eject the liquid other than ink. Example of other liquid ejecting heads include an ink jet type recording head of various types used for an image recording apparatus, such as a printer, a coloring material ejecting head used to manufacture a color filter for a liquid crystal display or the like, an electrode material ejecting head used to form an electrode for an organic EL display, a field emission display (FED) or the like, or a bio-organic material ejecting head used to manufacture a biochip. In this way, the invention can also be applied to the liquid ejecting head and the liquid ejecting apparatus which include the above-described liquid ejecting head.

What is claimed is:

1. A liquid ejecting head comprising:

a head main body that ejects an ink droplet from a nozzle group having nozzle openings of which positions on a liquid ejecting surface are different from each other in a first direction;

a flow path member that includes a flow path which supplies a liquid to the head main body, a filter which is provided in the middle of the flow path, a filter chamber which is formed of an upstream filter chamber on a upstream side and a downstream filter chamber on a downstream side of the filter and accommodates the filter, and an air bubble chamber which communicates with the filter chamber on the upstream side and stores air bubbles removed by the filter;

a first nozzle group and a second nozzle group of which positions on the liquid ejecting surface in a second direction orthogonal to the first direction are different from each other, and the positions are overlapped with each other at least in a portion in the first direction; and a branched flow path in which the flow path of the flow path member is branched in the middle of the path and then communicates with the first nozzle group and the second nozzle group, wherein the air bubble chamber is provided for each branched flow path.

2. The liquid ejecting head according to claim 1, wherein the first nozzle group includes a first nozzle row and a second nozzle row along the first direction, and the second nozzle group includes a third nozzle row and a fourth nozzle row along the first direction, wherein regarding the position in the first direction, an amount of overlap between the first nozzle row and the second nozzle row is smaller than an amount of overlap of the first nozzle row and the third nozzle row, wherein regarding the position in the first direction, an amount of overlap between the third nozzle row and the fourth nozzle row is smaller than an amount of overlap between the second nozzle row and the fourth nozzle row, wherein a first communication air bubble chamber to which the air bubbles in the air bubble chamber corresponding to the nozzle row are mutually movable is commonly provided in the first nozzle row and the second nozzle row, wherein a second communication air bubble chamber to which the air bubbles in the air bubble chamber corresponding to the nozzle row are mutually movable is commonly provided in the third nozzle row and the fourth nozzle row, and wherein the first communication air bubble chamber is one air bubble chamber which is provided for each branched flow path, and the second communication air bubble chamber is the other air bubble chamber which is provided for each the branched flow path.

3. The liquid ejecting head according to claim 2, wherein the head main body is configured that the first nozzle row and the third nozzle row are provided on a single nozzle plate, and the second nozzle row and the fourth nozzle row are provided on a single nozzle plate.

4. The liquid ejecting head according to claim 2, wherein the head main body are in plural, and each of head main bodies includes a plurality of nozzle rows corresponding to the first communication air bubble chamber, and a plurality of nozzle rows corresponding to the second communication air bubble chamber.

5. The liquid ejecting head according to claim 2, wherein the flow path includes a first branch point that branches in the middle of the flow path, and a second branch point which branches closer to the downstream side than the first branch point, wherein the first communication air bubble chamber corresponds to one filter chamber of a flow path branched at the first branch point, and wherein the second communication air bubble chamber corresponds to the other filter chamber of a flow path branched at the first branch point.

6. The liquid ejecting head according to claim 1, wherein the air bubble chamber is two-dimensionally disposed on a surface in parallel with the liquid ejecting surface, wherein the first branch point is a branch point which branches out the flow path extending to one side in the direction orthogonal to the first direction and the flow path extending to the other side, and wherein the second branch point is a branch point which branches out the flow path extending to one side in the first direction and the flow path extending to the other side.

7. A liquid ejecting apparatus comprising the liquid ejecting head according to claim 1.

* * * * *